US006981459B2

(12) United States Patent
Kitazawa et al.

(10) Patent No.: US 6,981,459 B2
(45) Date of Patent: Jan. 3, 2006

(54) SEWING MACHINE

(75) Inventors: Hiroshi Kitazawa, Aichi (JP); Masayuki Hori, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 94 days.

(21) Appl. No.: 10/451,734

(22) PCT Filed: Dec. 25, 2001

(86) PCT No.: PCT/JP01/11336

§ 371 (c)(1),
(2), (4) Date: Jun. 25, 2003

(87) PCT Pub. No.: WO02/053822

PCT Pub. Date: Jul. 11, 2002

(65) Prior Publication Data

US 2004/0099190 A1 May 27, 2004

(30) Foreign Application Priority Data

Dec. 20, 2000 (JP) ..... 2000-398264
Dec. 27, 2000 (JP) ..... 2000-398263
Dec. 27, 2000 (JP) ..... 2000-398265
Dec. 27, 2000 (JP) ..... 2000-398266

(51) Int. Cl.
*D05B 49/00* (2006.01)

(52) U.S. Cl. ..... 112/225; 112/302

(58) Field of Classification Search ..... 112/241–247, 112/250, 254, 255, 225, 259; 223/99
See application file for complete search history.

(56) References Cited

U.S. PATENT DOCUMENTS

| | | | | |
|---|---|---|---|---|
| 3,749,039 A | | 7/1973 | Fritts | |
| 4,241,678 A | * | 12/1980 | Tullman | 112/225 |
| 4,301,978 A | * | 11/1981 | Herr et al. | 242/150 R |
| 4,651,660 A | * | 3/1987 | Oshima et al. | 112/225 |
| 4,784,072 A | * | 11/1988 | Kessler | 112/302 |
| 5,003,900 A | * | 4/1991 | Ogawa | 112/242 |
| 5,086,718 A | * | 2/1992 | Ogawa | 112/225 |

FOREIGN PATENT DOCUMENTS

| | | |
|---|---|---|
| JP | A 55-81693 | 6/1980 |
| JP | A 5-293284 | 11/1993 |
| JP | B-7-24715 | 3/1995 |
| JP | B-63-64997 | 12/1998 |
| JP | B-2917477 | 4/1999 |

* cited by examiner

*Primary Examiner*—Ismael Izaguirre
(74) *Attorney, Agent, or Firm*—Oliff & Berridge, PLC

(57) ABSTRACT

A sewing machine includes a thread take-up lever and a thread tension regulator each disposed along a predetermined needle thread passage from a thread bobbin to a needle, an arm having a front face, and a movable controller disposed in the front of the arm so as to be movable at least within a predetermined range. The movable controller does not protrude out of the front face of the arm when moved in the predetermined range. The needle thread is engaged with at least one of the thread take-up lever and the thread tension regulator when the movable controller is moved within the predetermined range while the needle thread has been drawn from the thread bobbin near to the needle substantially along the predetermined needle thread passage.

49 Claims, 48 Drawing Sheets

SEWING MACHINE

TECHNICAL FIELD

The present invention relates to a sewing machine, which is provided at its arm with a movable controller made movable at least within a predetermined range, a thread take-up lever and a thread tension regulator and, more particularly, to a sewing machine, which can automatically engage a thread with the thread take-up lever and the thread tension regulator or can automatically pass a thread through a needle.

BACKGROUND ART

In an ordinary sewing machine, there are arranged a thread take-up lever mechanism to be driven in an arm by a spindle and a needle bar drive mechanism. A thread take-up lever is partially protruded from a vertical slit in an arm head and is reciprocally driven up and down. The arm is provided with a thread bobbin mount on its upper end side and with a thread tension regulator and a thread tension spring on its front side. A tension dial for the thread tension regulator is provided rear the thread tension regulator. A needle bar protrudes downward of the arm head, and a needle is attached to the lower end portion of the needle bar. A presser foot for pressing a cloth to be sewn and a presser bar for supporting the presser foot can be switched between a bottom position, at which the cloth is pressed by a lifting lever, and an upward retracted position.

In case the sewing is interrupted to exchange the thread bobbin for a needle thread, the presser foot is moved to the retracted position, and the thread tension regulator is brought in a released state. In this state, the thread bobbin is exchanged, and the needle thread fed out from the thread bobbin is guided through a plurality of thread guides to the thread tension regulator. The thread is engaged between a pair of thread tension discs in the released state, with a thread tension spring and further with a thread guard of the thread take-up lever. After this, the needle eye of a needle is threaded with the end portion of the needle thread. When the thread bobbin of the needle thread is to be thus exchanged, the thread has to be engaged with the thread tension regulator, the thread tension spring and the thread guard of the thread take-up lever and has to be passed through the needle eye. These thread engagement and passing operations are troublesome for the user because they are accompanied by the complicated operations, and the user has needed some getting used to doing those operation properly.

Therefore, U.S. Pat. No. 3,749,039 discloses the technique, in which the threading is simplified by mounting the needle thread cassette having the thread bobbin housed therein, removably on the arm. At a transverse center portion of the arm of the sewing machine, there is disposed a cassette mount, in which the needle thread cassette can be removably mounted. In association with the mounting action of the needle thread cassette, moreover, the needle thread fed out from the thread bobbin in said needle thread cassette is automatically engaged with the thread tension regulator, the thread tension spring and the thread guard of the thread take-up lever.

In JP-A-55-81693, on the other hand, there is proposed a cassette type threading device for a sewing machine. This cassette type threading device is provided with a thread take-up lever travel region of an arm, a cassette mount disposed on the right side of the region, and a cover member for opening/closing the cassette mount. The needle thread cassette having the thread bobbin housed therein is removably mounted in that cover member. A thread tension regulator and a thread take-up spring protrude into the cassette mount. The cover member is opened by turning it 90 degrees forward and is set with the needle thread cassette. By doing the action to close the cover member with the thread take-up lever being at the lowermost position, the needle thread is automatically engaged with the thread tension regulator and the thread take-up spring. When the thread take-up lever is then raised, the needle thread is automatically engaged with the thread guard of the thread take-up lever.

As disclosed in JP-A-5-293284, for example, there is practiced a sewing machine, which is constructed to have an automatic threading mechanism at the arm of the sewing machine so that the end of the needle thread is passed through the eye of a needle by moving the control lever of the mechanism downward by a predetermined distance.

DISCLOSURE OF THE INVENTION

By mounting the needle thread cassette which is described in U.S. Pat. No. 3,749,039 or JP-A-55-81693, in the cassette mount of the sewing machine, it is surely possible to engage the thread automatically with the thread guard of the thread take-up lever and with the paired thread tension discs and the thread tension spring of the thread tension regulator. In the sewing machine of the aforementioned publications, however, no consideration is taken into the thread engagement and the thread passing through the needle eye following the thread engagement with the aforementioned thread take-up lever and thread tension regulator.

After the thread guard of the thread take-up lever and the thread tension regulator were threaded as described above, therefore, it is necessary to pass the end of the needle thread manually through the needle eye. In case the needle thread pulled out from the needle thread cassette at present is not sufficiently long, however, it may not be sufficiently handled to the thread guard or the needle eye. Even if the needle thread is attempted to be pulled so that its sufficient length may be let off from the aforementioned needle thread cassette, however, it may be unable to be smoothly pulled out, after the needle thread cassette was mounted, due to the resistance received from the already engaged portion. If the needle thread is excessively forcibly pulled out unintentionally, on the contrary, the thread take-up lever or the thread tension regulator may be damaged, or the needle thread may be unintentionally loosened in the course of the pulling passage. As a result, the needle thread may be twisted, tensed or broken. Moreover, it is inefficient to pass the end of the needle thread manually through the needle eye, raising an obstruction to the improvement in the efficiency of the subsequent sewing operations.

In JP-A-5-293284, there is disclosed an automatic needle eye threading mechanism. However, the above described automatic threading mechanism of the prior art is premised by the facts that it is manually controlled in itself and that it is used for the threading operation after the thread was engaged with the thread tension regulator and the thread guard of the thread take-up lever. Therefore, it is difficult to pass the thread through the needle in association with the thread engagement, and to execute the thread engagement and passing in a series of continuous operations.

In the sewing machine with the needle thread cassette described in the aforementioned USP, moreover, with the thread guard of the thread take-up lever being retained at the lowermost position (or the thread loosening position) by turning the spindle manually, the needle thread cassette is mounted in the cassette mount. In the state where the needle thread cassette is mounted in the cassette mount, the first and second resistance applying portions are released. When the thread take-up lever moves to the uppermost position (or the thread tightening position) at the sewing starting time, therefore, the needle thread is not always fed out from the thread bobbin, and the needle thread in the needle eye may be pulled to come out of the eye.

In case the sewing machine is to be interrupted, it normally stops with its needle bar being at the uppermost position. At this time, the thread take-up lever is also at a position in the thread tightening course near the uppermost position. In the aforementioned USP, however, when the needle thread cassette is to be mounted, the thread take-up lever has to be switched to the lowermost position by the manual operation, but this operation is troublesome. This trouble is also likewise experienced in the sewing machine of the latter publication.

In the sewing machine of the prior art, moreover, a presser foot for pressing a cloth to be sewn and a presser bar for supporting the presser foot can be switched by the control of a presser foot lever between a bottom position, at which the cloth is pressed, and an upward retracted position. In order to work the cloth or thread easily after the presser foot was retracted, moreover, the sewing machine generally has a mechanical link, in which the thread tension discs of the thread tension regulator are opened/closed in association with the position of the presser foot. Specifically, the thread tension discs are opened, when the presser foot is at the retracted position, and are closed when the presser foot is at the bottom position.

In case the needle thread is to be engaged or passed in the sewing machine in which the position of the presser foot and the opening/closing operation of the thread tension discs are thus linked, it never fails that the needle thread is handled after the presser foot was brought into the retracted position and after the thread tension discs were brought into the open state. In case the user has accidentally brought the presser foot into the bottom position or in case the user desires to press the cloth with the presser foot, however, the user cannot or fails to engage or pass the needle thread.

The present invention has been conceived in view of those problems and has an object to provide a sewing machine, which can engage a needle thread fed out from a thread bobbin, from a partially engaged state where the thread is pulled out in advance to a needle along a predetermined feed passage to a needle, in a normal state with a thread take-up lever or a thread tension regulator in association with the movement of a movable controller. Moreover, the object is to provide a sewing machine, which is enabled to pass the needle thread through a needle eye by actuating an automatic threading mechanism, too.

In order to achieve the aforementioned object, according to the invention, there is provided a sewing machine comprising a thread take-up lever and a thread tension regulator each disposed along a predetermined needle thread passage from a thread bobbin to a needle, an arm having a front face, and a movable controller provided in the front of the arm so as to be movably at least within a predetermined range, the movable controller not protruding out of the front face of the arm when moved in the predetermined range, wherein the needle thread is engaged with at least one of the thread take-up lever and the thread tension regulator when the movable controller is moved within the predetermined range while the needle thread has been drawn from the thread bobbin near to the needle substantially along the predetermined needle thread passage.

In order to achieve the aforementioned object, there is also provided a sewing machine comprising: a thread take-up lever for reciprocating while being timed with the motion of a needle to take up a needle thread fed out from a thread bobbin; an automatic threading mechanism for passing the needle thread through a needle eye; an arm having a front face; and a movable controller provided in the front of the arm so as to be movable at least within a predetermined range, the movable controller not protruding out of the front face of the arm when moved in the predetermined range, wherein said movable controller is moved within said predetermined range to control and set the needle thread in a thread guard of the thread take-up lever and to actuate said automatic threading mechanism to pass the needle thread through the needle eye.

Here, the movable controller may be a needle thread cassette having the thread bobbin of the needle thread housed therein, a removable control member having no thread bobbin housed for engaging with the thread like the needle thread cassette, or a threading control member connected to the arm through a link mechanism or a locking lever.

The movable controller is so disposed in the arm of the sewing machine as to be movable at least within the predetermined range. In case the needle thread is engaged in the former construction with at least one of said thread take-up lever or said thread tension regulator, the needle thread, as fed out from the thread bobbin by the operator, is pulled out at first along a predetermined needle thread passage (or a feed passage) to the position of the needle. In this case, the needle thread may be moved and engaged in a normal state with said thread take-up lever or said thread tension regulator by the subsequent moving control of said movable controller. Therefore, said needle thread may be arranged not only at a position where it can be instantly engaged along the needle thread passage with said thread take-up lever or said thread tension regulator but also in the vicinity of said thread tension regulator or at a position corresponding to the moving locus of the thread take-up lever. Moreover, the needle thread may also be arranged either at a distance from said predetermined needle thread passage or in a mode similar to the needle thread passage (such that the portion corresponding to the horizontal portion of said needle thread passage is horizontally arranged at a more or less spacing from the normal position). By moving said movable controller in this state within said predetermined range, said needle thread can be engaged in the normal state with at least one of said thread take-up lever or said thread tension regulator. Therefore, the engagement of the thread with said thread take-up lever or said thread tension regulator can be simplified to enhance the operating efficiency.

In the latter construction, moreover, the needle thread can be passed through the needle eye while being engaged with the thread guard of the thread take-up lever, in association with the moving action of the movable controller. Therefore, the engagement of the thread with the thread guard of the thread take-up lever and the passing of the thread through the needle eye can be simplified to enhance the operating efficiency.

Another object of the invention is to provide a sewing machine, which can mount a needle thread cassette while a thread take-up lever being retained at a position on the threading tightening side and which can engage the thread with the thread take-up lever and the thread tension regulator at the time of mounting the needle thread cassette.

In order to achieve the aforementioned object, according to the invention, there is provided a sewing machine comprising a needle thread cassette mounted removably in a cassette mount formed in an arm, for housing a thread bobbin to feed a needle thread fed out from the thread bobbin to a thread take-up lever, wherein the thread take-up lever includes a thread guard reciprocated between a position at a thread tightening side and a position at a side opposed to the thread tightening side; said cassette mount is disposed near a region of reciprocation of the threaded guard; and with the thread guard of said thread take-up lever being retained at a position on the thread tightening side, the needle thread is engaged with the thread guard of the thread take-up lever in association with the mounting action to mount the needle thread cassette in the cassette mount.

When the sewing machine is to be stopped, the needle bar normally takes the uppermost position, and the thread take-up lever takes a position on the thread tightening side on the way to the top position. In this sewing machine, with the thread guard of the thread take-up lever being retained at the position on the threading tightening side, in association with the mounting action to mount the needle thread cassette in the cassette mount disposed near the region of reciprocation of the threaded guard, the needle thread can be engaged with the thread guard of the thread take-up lever. In short, with the position of the thread take-up lever being retained at the instant when the sewing machine is stopped, the needle thread cassette can be mounted, and the thread can be engaged with the thread guard of the thread take-up lever.

Still another object of the invention is to provide a sewing machine, which can mount the needle thread cassette irrespective of the position of the presser foot and which can engage the needle thread fed out from the thread bobbin, in a normal state with the thread take-up lever and the thread tension regulator in association with the travel of the movable controller.

In order to achieve the aforementioned object, according to the invention, there is provided a sewing machine comprising: a control member for moving a presser foot up and down; up and down and a thread tension regulator having thread tension discs adapted to be released, when the presser foot is moved up by said control member, and closed when the presser foot is moved down; a movable controller made movable at least within a predetermined range; and an interlocking mechanism including a cam formed in the movable controller, a cam driven member having one of ends capable of abutting the cam and the other end traverting a pressing force said one end receive from the cam to an operation thereof, and an actuating plate driven by said other end of the cam driven member to open the thread tension disc, the interlocking mechanism opening the threat tension disc in association with the movement of the movable controller within the predetermined range while the presser foot is retained at a bottom position, wherein the needle thread is engaged with the thread tension disc in said open state in the course of the moving action of said movable controller within said predetermined range.

The construction, in which the presser foot is moved up and down and switched by the control member and in which the thread tension discs are opened/closed, is shared with the existing sewing machine. With the presser foot being retained at the bottom position through the control member, however, said interlocking mechanism acts, at the time of mounting the needle thread cassette, to open the thread tension discs in association with the mounting action of the needle thread cassette. The needle thread can be engaged with the thread tension discs in the open state.

BRIEF DESCRIPTION OF THE DRAWINGS

FIG. 5 is a front elevation of a needle bar lifting mechanism, an automatic threading mechanism and so on.

FIG. 10 is a longitudinally sectional side elevation of a threading slider actuating mechanism, the needle thread cassette and so on.

FIG. 36 is a side elevation of the needle thread cassette and shows a thread holding portion and so on.

FIG. 37 is a front elevation of a foot lifting lever, a thread tension regulator, an interlocking mechanism and so on.

FIG. 38 is a side elevation of the foot lifting lever, the thread tension regulator, the interlocking mechanism and so on.

FIG. 39 is a top plan view of the foot lifting lever, the thread tension regulator, the interlocking mechanism and so on.

BEST MODE FOR CARRYING OUT THE INVENTION

Figure 1:
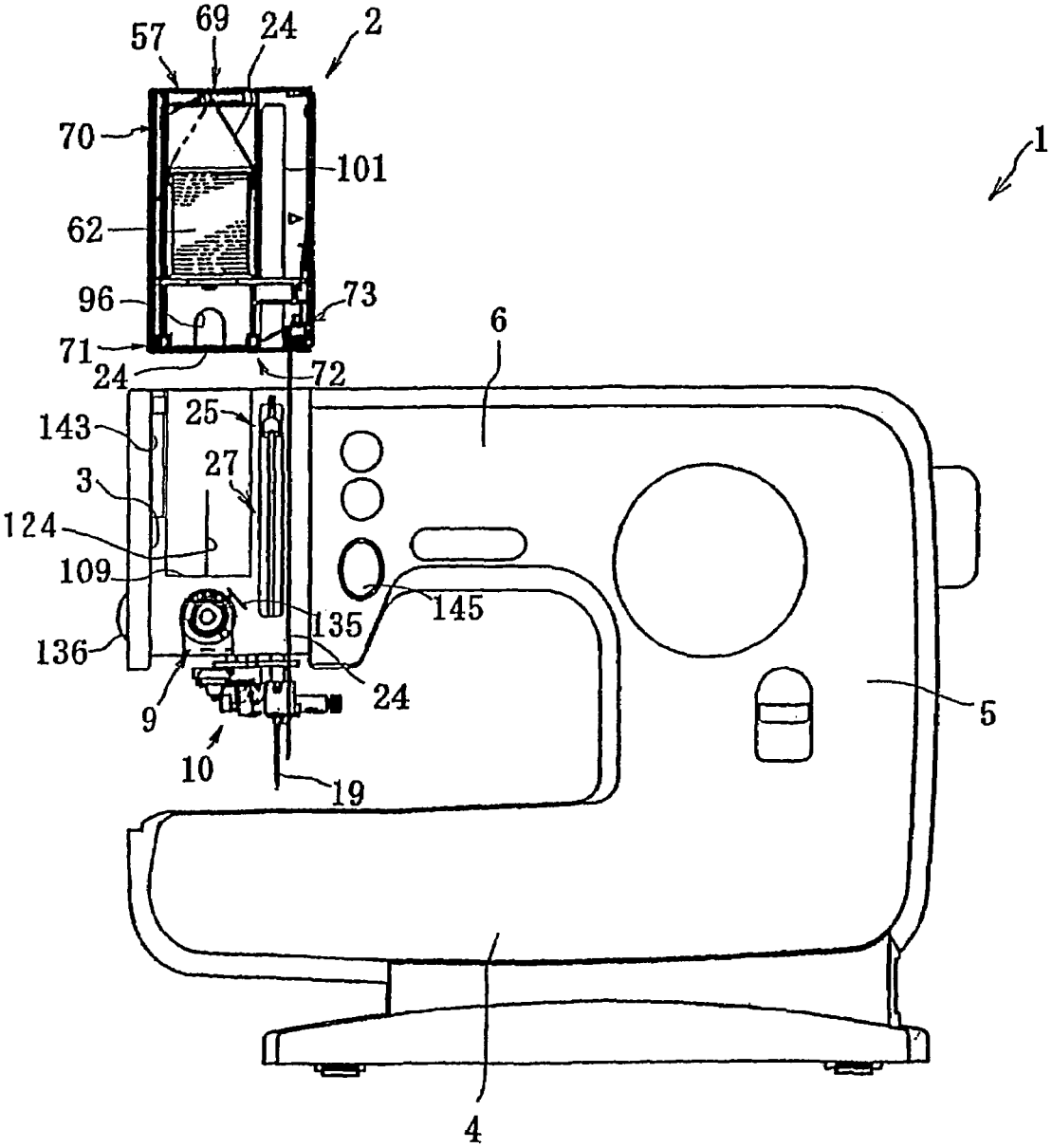
FIG. 1 is a front elevation of an electronic control sewing machine of an embodiment of the invention and its needle thread cassette.

An embodiment of the invention will be described with reference to the accompanying drawings. This electronic control sewing machine is constructed such that an needle thread cassette housing a thread bobbin can be mounted in a cassette mounting portion of an arm head, and such that an needle thread is engaged with the thread guard of a thread take-up lever and a thread tension regulator and is introduced into the eye of a needle in association with the mounting action to mounting an needle thread cassette 2.

The description will be made at first on the basic structure of the sewing machine 1 and on a threading mechanism 10, and then on the needle thread cassette 2, a cassette mount 3, a thread take-up lever 8, a transmission mechanism 115 for the threading operation, and an interlocking mechanism 134 for a thread tension regulator 9 sequentially in the recited order. Here, the following description is made by assuming that the front/back and left/right are taken from an operator of the sewing machine.

Figure 2:
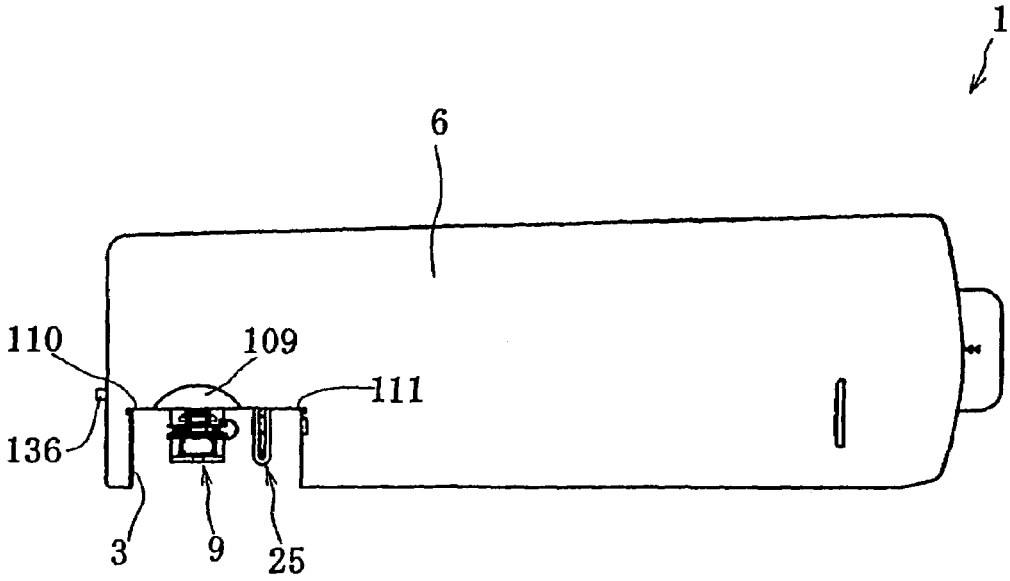
FIG. 2 is a top plan view of the sewing machine in the state where the needle thread cassette is removed.
Figure 3:
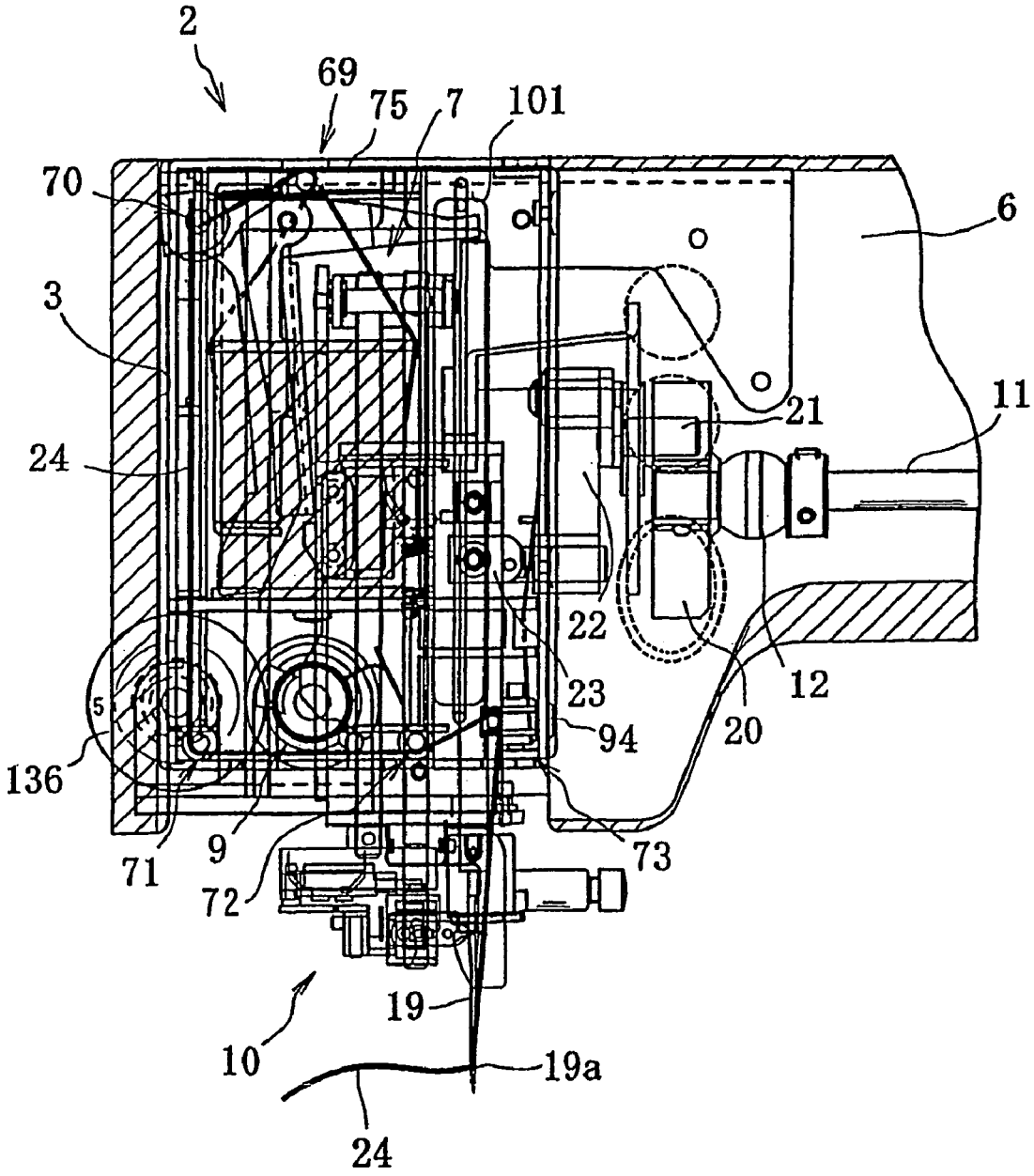
FIG. 3 is a longitudinal section showing the internal structure near a cassette mounting portion.

As shown in FIG. 1 to FIG. 3, this electronic control sewing machine 1 includes a bed 4, a column 5 erected from the right end portion of the bed 4, and an arm 6 extending leftward from the upper end of the column 5. The arm 6 is provided with a needle bar lifting mechanism 7, the cassette mount 3, the thread take-up lever mechanism 8, the thread tension regulator 9 and the automatic threading mechanism 10. Here, the cassette mount 3 is provided in the head (or arm head) of the arm 6. In this arm 6, a spindle 11 is rotatably supported through a pair of bearings 12 and is rotationally driven by the driving force of the not-shown sewing machine motor.

Next, the needle bar lifting mechanism 7 will be briefly described because it has a general structure. At the arm head of the arm 6, as shown in FIG. 1 and FIG. 3 to FIG. 8, there is upright arranged a needle bar bed frame 13, which is provided with a rear wall portion 14 and a left wall portion 15. A lower support portion 14*a* and an upper support portion 14*b*, which extend forward, are formed integrally with the lower end and the upper end of the rear wall portion 14, respectively. At the upper end portion of the left wall portion 15, there is formed a hinged arm portion 15*a*, which extends upward of the upper support portion 14*b*. A needle bar 18 is so inserted into the upper support portion 14*b* and the lower support portion 14 as to move up and down.

On the upper end portion of the hinged support portion 15*a*, there is fixed a transverse pin member 16*a*, to which a hinged member 16 having a generally C-shape opened on the front face is fixedly connected. The hinged member 16 is so supported on the sewing machine frame through a longitudinal and horizontal support pin 17 as to rock so that the needle bar bed frame 13 can rock transversely (or in a needle deflecting direction) on the support pin 17. Here, the mechanism for rocking/driving the needle through the needle bar bed frame 13 by the stepping motor is omitted in its description because it is a general one.

The needle bar 18 is vertically movably supported on the upper support portion 14*b* and the lower support portion 14*a*, and carries a needle 19 removably at its lower end.

As shown in FIG. 3 and FIG. 11 to FIG. 13, the spindle 11 is provided on its left end side with a thread take-up lever crank 20 of the thread take-up lever mechanism 8, to which a needle bar crank 22 is turnably connected through a crank pin 21. On the substantially intermediate portion of the needle bar 18, there is fixed a needle bar connecting bracket 23, to which the needle bar crank 22 is connected. At the sewing time, the spindle 11 is rotationally driven by the sewing machine motor so that the needle bar 18 is vertically reciprocated by the needle bar crank 22.

As shown in FIG. 11 to FIG. 15 and FIG. 17, the arm 6 is provided with the thread take-up lever mechanism 8, which is equipped with a thread take-up lever 25 for taking up an needle thread 24 in synchronism with the vertical travel of the needle 19.

At the leading end portion of the thread take-up lever 25, there is formed a thread guard 26, which can thread from above. Throughout the height of the right end side portion of the cassette mount 3, there is formed a thread take-up lever travel region 27, in which the thread guard 26 of the thread take-up lever 25 can reciprocate up and down. The thread tension regulator 9 for applying a passing resistance to the needle thread is provided to protrude to the lower portion of the cassette mount 3.

This thread tension regulator 9 can be opened/closed by a foot lifting lever 29 for moving a presser foot 28 up and down, and is opened/closed, too, when the needle thread cassette 2 is mounted, as will be described hereinafter. Here, a generally upright vertical shaft is arranged in the column 5 and is interlocked with and connected to the spindle 11 through a gear mechanism so that its driving force is transmitted to a thread catching hook in the bed 4. As in the general electronic control sewing machine, a cloth 30 is sewn by the coactions among the needle 19, the thread catching hook and the cloth feeding mechanism, which is driven by the stepping motor.

Next, the automatic threading mechanism 10 for threading the eye 19*a* of the needle 19 with the needle thread 24 will be described with reference to FIG. 5 to FIG. 10, FIG. 14, FIG. 15, FIG. 17 and FIG. 19.

On the upper support portion 14*b* and the lower support portion 14*a* of the needle bar bed frame 13, there are vertically movably supported a threading pin 31 and a slider guide pin 32, which are located on the left side of the needle bar 18. The upper end portion of the threading pin 31 is inserted into the clearance between the bracket 16 and the pin member 16*a*, and a horizontally protruding slide pin 33 is fixed on a substantially intermediate portion of the threading pin 31.

A hook retaining member 34 made of a synthetic resin is fixed at the lower end portion of the threading pin 31, and a first thread guide member 35 (as referred to FIG. 17) having a general C-shape in a side view is rotatably supported at its upper support portion and at its lower support portion by the threading pin 31 corresponding to the upper side and the lower side of the hook retaining member 34. At a vertical connecting wall 36 connecting the upper support portion and the lower support portion of the first thread guide member 35, there is notched a thread guide 36*a* for engaging with the needle thread 24 to guide it.

Figure 9A:
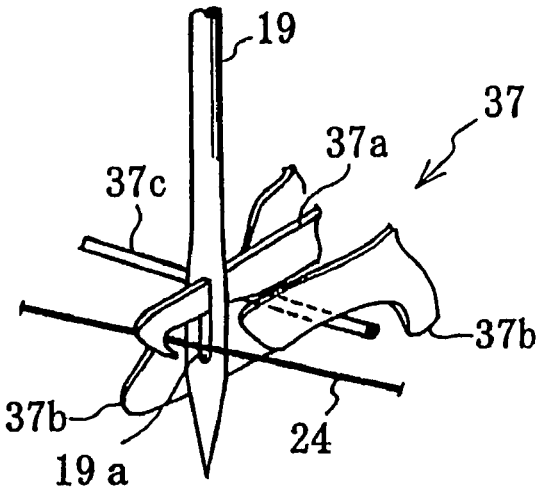
FIG. 9A is a perspective view showing the state immediately before the threading by a threading hook.
Figure 9B:
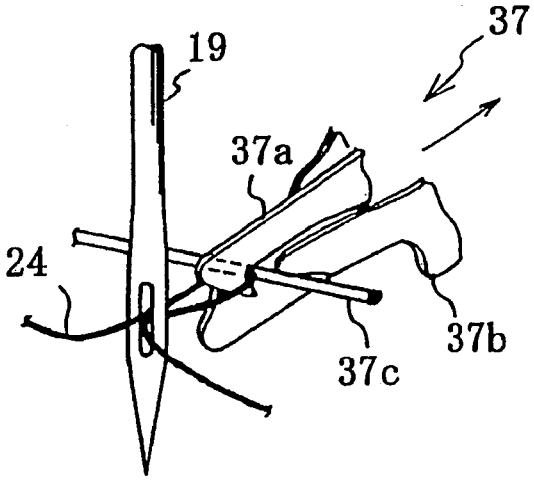
FIG. 9B is a perspective view showing the state immediately after the threading.
Figure 9C:
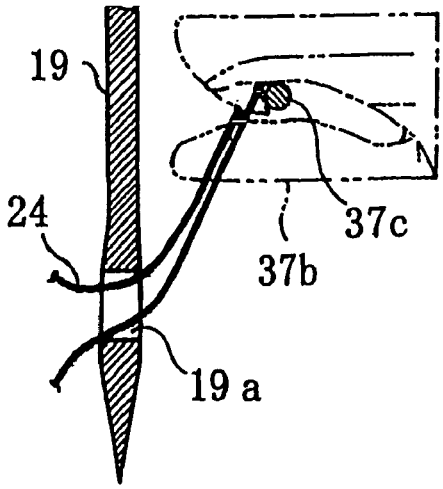
FIG. 9C is a section of an essential portion in the state where the threading hook has risen after the threading.

As shown in FIG. 9A to FIG. 9C, a hook mechanism 37 is fixed on the hook retaining member 34. The hook mechanism 37 is constructed of a threading hook 37*a*, two guide members 37*b* positioned on the two sides of the threading hook 37*a*, and a thread retaining wire 37*c* extending horizontally through those threading hook 37*a* and guide members 37*b*. At the leading end portion of the threading hook 37*a*, there is formed a hook portion, which is inserted at the threading into the eye 19*a* so that the needle 19 hooks the needle thread 24 which is positioned just ahead the eye 19*a* while being guided by the aforementioned guide member 37*b*.

On the hook retaining member 34, there is integrally fixed a second thread guide member 38, which is bent downward generally near its leading end portion so that the bent portion functions as a thread guide portion 38*a*. This thread guide portion 38*a* is positioned substantially on the opposite side of the hook mechanism 37 with respect to the threading pin 31 and spaced at a predetermined distance. In short, the second thread guide member 38 and the hook mechanism 37 are disposed integrally with the threading pin 31 while retaining a predetermined positional relation.

Here will be described a turning mechanism for turning the threading pin 31 by a predetermined angle.

Around the upper end portions of the threading pin 31 and the slider guide pin 32 on the back side of the needle bar bed frame 13, as shown in FIG. 5 to FIG. 8, FIG. 14, FIG. 15, FIG. 17 and FIG. 19, there is vertically movably fitted a threading slider 40, which is made of a synthetic resin. Specifically, this threading slider 40 is equipped with an upper hinge portion 41, a lower hinge portion 42, an outer circumferential wall portion 43 and a threading slider pawl 44.

The upper hinge portion 41 and the lower hinge portion 42 are extended over the threading pin 31 and the slider guide pin 32. The outer circumferential wall portion 43 is formed to connect those upper hinge portion 41 and the lower hinge portion 42 vertically and to cover about one half of the outer circumference of the aforementioned upper end portion of the threading pin 31. A threading slider cam portion 43*a* of a helical shape is formed at the outer circumferential wall portion 43. To the left end portions of the upper hinge portion 41 and the lower hinge portion 42, there is connected the threading slider pawl 44, which has a pawl portion 44*a* at a substantially intermediate portion of its left end.

Through the substantially intermediate portion of the threading pin 31 and at a position corresponding to the just upper side of the lower hinge portion 42, there is fixed the slide pin 33 of a predetermined length, which engages at its deep end portion with the threading slider cam portion 43*a*. A spring receiving pin 45 is fixed through the side of the threading pin 31 at a position lower than the slide pin 33 by a predetermined length. A compression coil spring 46 is mounted around the threading pin 31 and between the lower hinge portion 42 and the spring receiving pin 45. Around the slider guide pin 32 and between the lower hinge portion 42 and the lower support portion 14*a* of the needle bar bed frame 13, there is mounted a compression coil spring 47 for biasing the threading slider 40 upward.

Here will be described an offset member 48. As shown in FIG. 4 to FIG. 8, this offset member 48 is so mounted on the threading pin 31 and the slider guide pin 32 as to move vertically on the back side of the threading slider 40 and within a range of about three quarters as long as the height between the upper support portion 14*b* and the lower support portion 14*a* of the needle bar bed frame 13. This offset member 48 is constructed to include an upper support portion 49, a lower support portion 50 and a vertical connecting wall 51 connecting those upper support portion 49 and lower support portion 50. The upper support portion 49 penetrates into the threading pin 31 and the slider guide pin 32, and the lower support portion 50 penetrates only into the threading pin 31.

A threading positioning member 52 is fixed as an engaging member immediately above the needle bar connecting bracket 23 of the needle bar 18, and the right end portion of the upper support portion 49 of the offset member 48 is so constructed that it can abut against the threading positioning member 52 from above. With the right end portion of the upper support portion 49 abutting against the threading positioning member 52, the threading hook takes the same height position as that of the eye 19*a* of the needle 19 (as referred to FIG. 6). At the left end lower portion of the connecting wall 51, there is formed an offset member cam portion 53, which includes a slope portion 53*a* protruding more leftward as it goes more downward, and a flat portion 53*b* extending vertically downward from the lower end of the slope portion 53*a* and protruding more leftward than the pawl portion 44*a* of the threading slider pawl 44.

Figure 5:
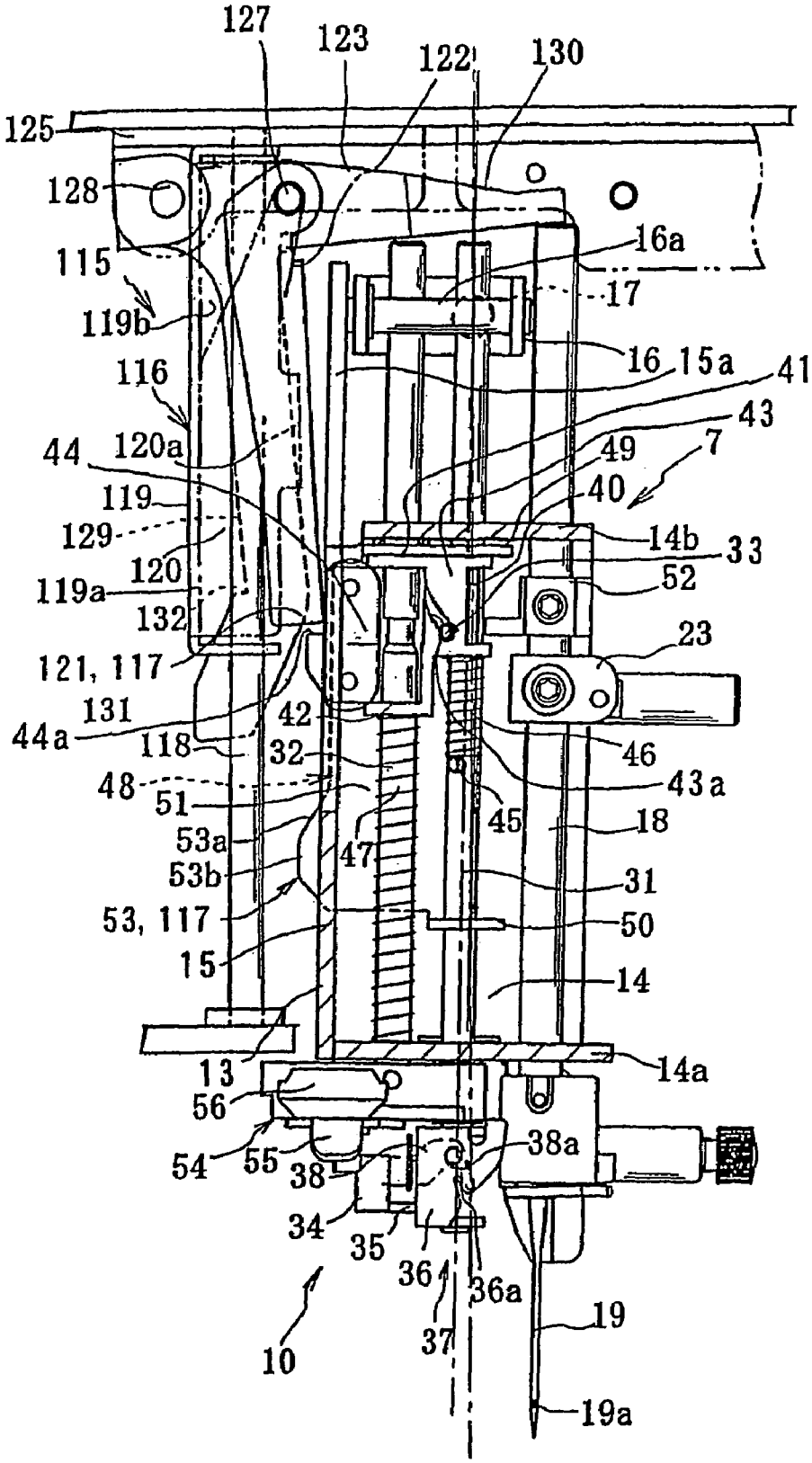

Accordingly as the threading slider 40 is pressed downward from the upper limit position, as shown in FIG. 5, by a later-described needle thread cassette 2 against the biasing force of the compression coil spring 47, the threading pin 31, the slider guide pin 32 and the offset member 48 move down and stop when the upper support portion 49 of the offset member 48 comes into abutment against the threading positioning member 52 (as referred to FIG. 6). At this time, the threading slider 40 moves down relative to the threading pin 31 and the slider guide pin 32 so that the slide pin 33 moves along the threading slider cam portion 43*a* having the helical shape. The threading is effected when the threading pin 31 is turned by a predetermined angle clockwise, as viewed in a top plan view (as referred to FIG. 9A to FIG. 9C).

In this threading operation, the hook mechanism 37 is turned in a direction toward the needle 19 so that the aforementioned threading hook penetrates into the needle eye 19*a*. Simultaneously with this, the second guide member 38 is turned clockwise (or in the direction away from the needle 19) in synchronism with the hook mechanism 37. There is further provided a link mechanism 54 for turning the first thread guide member 35, which is turnably supported on the lower end portion of the threading pin 31, in the threading operation in the direction away from the second thread guide member 38. When the threading pin 31 in a standby state before turned for the threading operation, more specifically, the second thread guide member 35 takes a forward posture, and its thread guide portion 38*a* is positioned immediately inside of the thread guide 36*a* of the connecting wall 36.

When the threading pin 31 turns after it went to the lower limit position, the hook mechanism 37 and the second thread guide member 38 integrally rotate clockwise, as viewed in the top plan, and the first thread guide member 35 turns counterclockwise through the link mechanism 54. In short, the first thread guide member 35 moves apart from the second thread guide member 38 and toward the hook mechanism 37. Here, a support plate 55 for clamping the needle thread 24 under a slight pressure and a thread guide disc 56 are also disposed near the link mechanism 54.

Here will be described the needle thread cassette 2.

As shown in FIG. 1, FIG. 10 and FIG. 14 to FIG. 36, the needle thread cassette 2 acting as a movable operation member includes: a cassette case 57 having a shape similar to an elongated box having a small transverse width; a thread bobbin housing portion 57*a* for housing a thread bobbin 62; a thread bobbin retaining portion 58 for retaining the thread bobbin 62 in the thread bobbin housing portion 57*a*; the thread bobbin 62 retained in the thread bobbin retaining portion 58; a thread passage 59 for guiding the needle thread 24, as supplied from the thread bobbin 62, to a thread exit 68; a thread take-up lever travel region 57*b*, in which the thread guard 26 of the thread take-up lever 25 of the thread take-up lever mechanism 8 reciprocates up and down; and a thread tension regulator housing portion 57*c* for penetrating the thread tension regulator 9 thereinto. Here, the thread exit 68 is formed in the bottom wall of the cassette case 57 near the right end.

The cassette case 57 is equipped with a cassette body 60 made of a synthetic resin and an openable cover 61, of which the openable cover 61 is openably connected to the right end portion of the cassette body 60. However, the openable cover 61 may also be so constructed that it may be opened/closed by sliding it up and down with respect to the cassette body 60. As thread color discriminating means for discriminating the color of the needle thread 24 of the thread bobbin 62, the openable cover 61 is made of a transparent material so that it may be able to discriminate the thread color of the thread bobbin 62 in the cassette case 57. Here, another thread color discriminating means may also be exemplified either by forming an open hole in the openable cover 61 for inspecting the thread bobbin 62 or by adhering a seal in the same color as that of the needle thread 24 of the thread bobbin 62 to a portion of the surface of the cassette case 57.

As shown in FIG. 10, FIG. 16 and FIG. 28 to FIG. 33: the thread take-up lever travel region 57*b* is formed on the right side of the cassette case 57 to have a width of about one third of the cassette case 57; the thread bobbin housing portion 57*a* is at the upper two thirds of the left two thirds of the cassette case 57; and the thread tension regulator housing portion 57*c* is at the lower one third of the left two thirds of the cassette case 57. The regions for the thread passage 59 are partitioned by partitions 66 and 99 on the left end portion in the cassette body 60

In the thread take-up lever travel region 57*b* and in the rear wall of the cassette body 60, there is formed an elongated slit 101 for penetrating the thread guard 26 of the thread take-up lever 25 and a later-described thread guide 106A. In the thread tension regulator housing portion 57*c* and in the rear wall and the bottom wall of the cassette body 60, there is formed a notch 96 for introducing the thread tension regulator 9 into the thread tension regulator housing portion 57*c*. Vertical partitions 67 and 100 are formed between the thread take-up lever travel region 57*b* and the thread bobbin housing portion 57*a* and the thread tension regulator housing portion 57*c*, and a horizontal support wall 63 for protruding toward the openable cover 61 is formed between the thread bobbin housing portion 57*c* and the thread tension regulator housing portion 57*a*.

The thread bobbin retaining portion 58 is constructed to retain the thread bobbin 62 vertically of its axis so that it can reduce the transverse width of the cassette case 57 and the sizes of the cassette case 57 and the cassette mount 3. The thread bobbin retaining portion 58 is constructed of the support wall 63 (corresponding to the wall of the housing portion) and a thread bobbin retaining pin 64. This thread bobbin retaining pin 64 is protruded upward from the support wall 63. The thread bobbin retaining pin 64 is divided into three portions in the circumferential direction so that it can be elastically deformed in a radially widening direction thereby to retain the thread bobbin 62 having axial bores of various sizes.

Of the support wall 63 and at the front end portion abutting against the lower end (or one axial end) of the thread bobbin 62, there is formed a recess 65 for pushing the thread bobbin 62 from below to take it up from the thread bobbin retaining pin 64. This recess 65 is formed into a shape notched radially inward of the outer circumference of the thread bobbin 62 so that the needle thread 24 may not go into the clearance between the thread bobbin 62 and the support wall 63 even if it becomes slack.

Here will be described the thread passage 59. As shown in FIG. 14, FIG. 15 and FIG. 17 to FIG. 21, the thread passage 59 is an needle thread guide passage, which is based on a feed-out point 79 from the thread bobbin 62 retained on the thread bobbin retaining portion 58, for guiding the needle thread 24 fed out upward from the thread bobbin 62 to the thread exit 68 of the cassette case 57. The thread passage 59 includes a first guide portion 69, a first clamp portion 70, a second guide portion 71, a third guide portion 72 and a second clamp portion 73. With the thread bobbin 62 being retained by the thread bobbin retaining portion 58, the needle thread 24, as fed out upward from the thread bobbin 62, is guided through the first guide portion 69, the first clamp portion 70, the second guide portion 71, the third guide portion 72 and the second clamp portion 73 in the recited order to the thread exit 68 at the lower end portion near the right end of the cassette case 57.

As shown in FIG. 17, FIG. 19 and FIG. 22 to FIG. 25, the first guide portion 69 and the first clamp portion 70 are disposed in the upstream portion of the thread passage 59. The first guide portion 69 is disposed at the top of the cassette case 57. The first guide portion 69 is constructed to include a pin support member 74 formed in the cassette body 60, a guide pin 75 having an L-shape, as viewed in a top plan, protruding forward from the pin support member 74 and bent rightward, and a rib 76 formed on the openable cover 61 for preventing the thread from coming out.

The guide pin 75 is equipped with a thread guide portion having a predetermined length in the longitudinal direction. Notched rectangular openings 77 and 78 are so formed in an opposed shape in the top walls of the cassette body 60 and the openable cover 61 as to cause the thread guide portion to face the outside, so that the needle thread fed from the thread bobbin of the outside can be introduced from the openings 77 and 78 into the first guide portion 69. The needle thread 24 fed out from the thread bobbin 62 is so engaged with the thread guide portion of the guide pin 75 as to move freely in the longitudinal direction. Even in case the distance between the thread bobbin 62 and the first guide portion 69 is not so long, therefore, the needle thread 24 can be smoothly pulled out from the thread bobbin 62.

Figure 23:
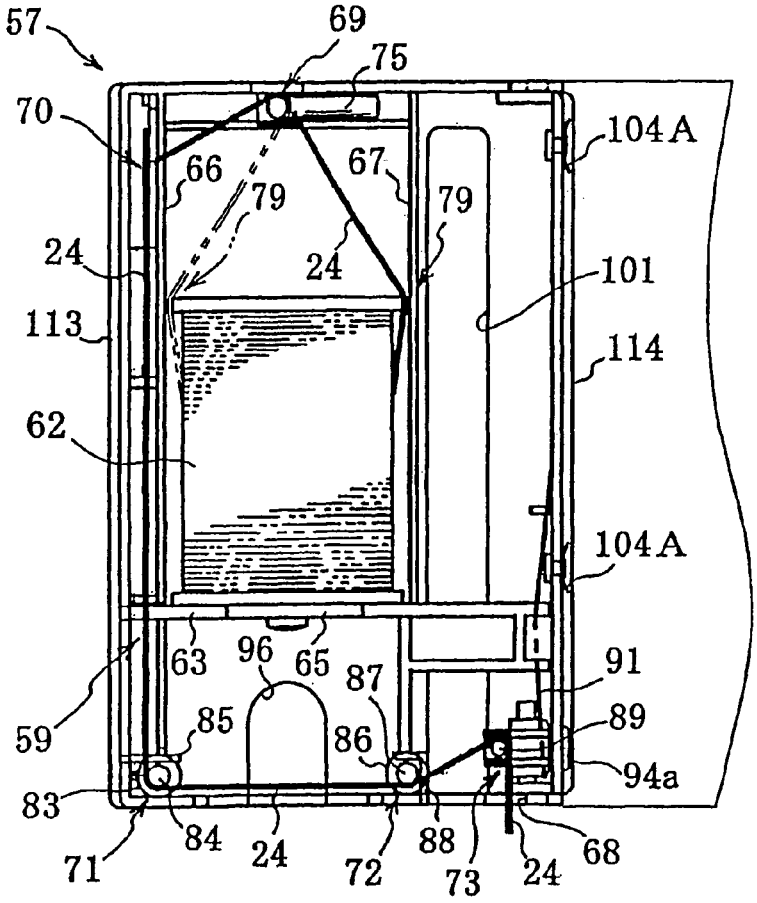
FIG. 23 is a front elevation of the needle thread cassette (in the state where an openable cover is opened).
Figure 24:
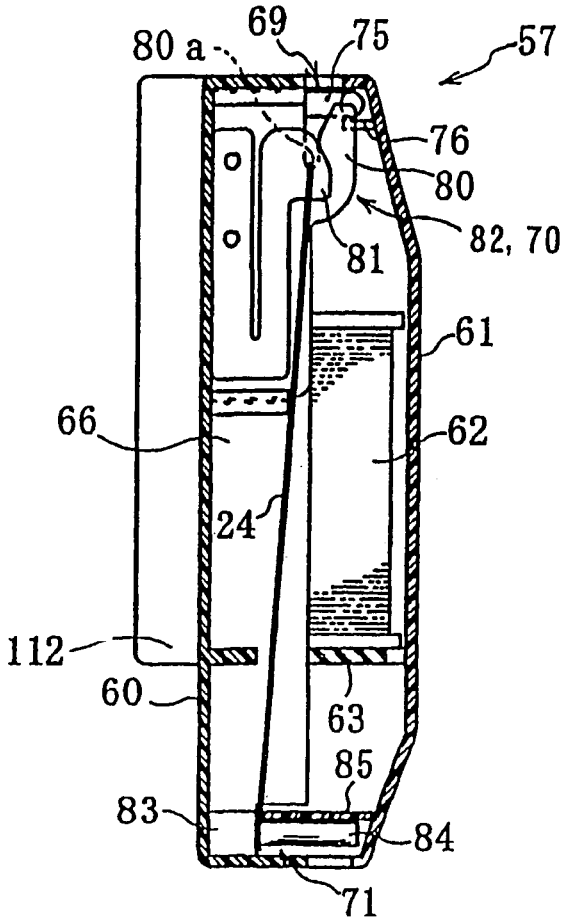
FIG. 24 is a longitudinally sectional side elevation of the needle thread cassette.
Figure 25:
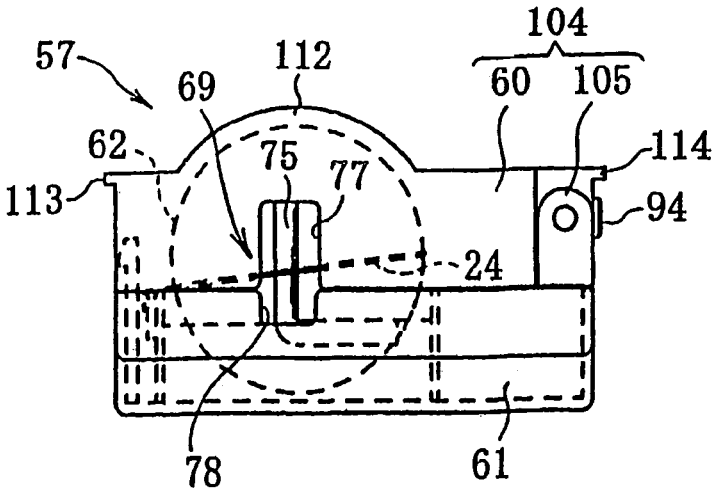
FIG. 25 is a top plan view of the needle thread cassette.
Figure 26:
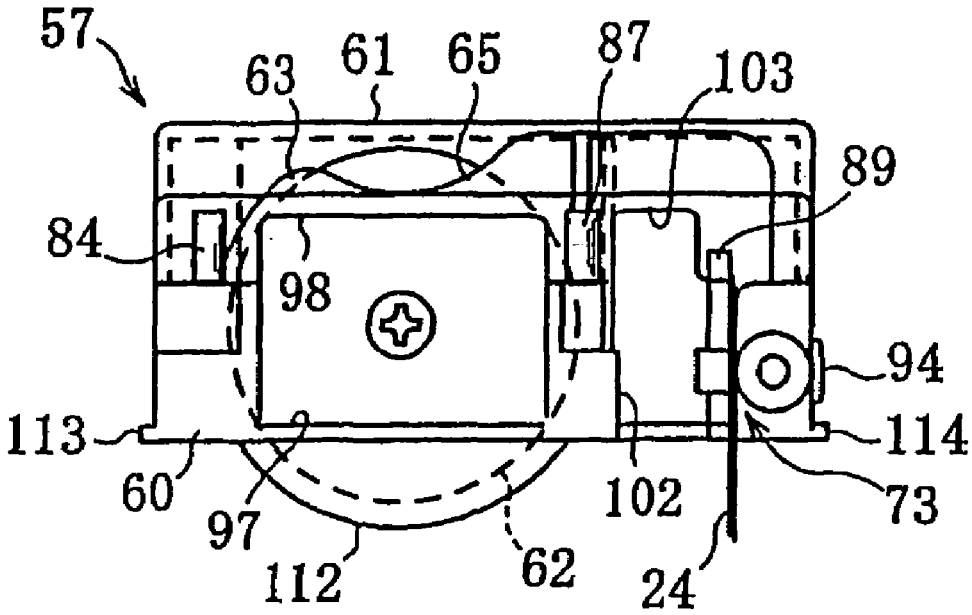
FIG. 26 is a bottom view of the needle thread cassette.
Figure 27:
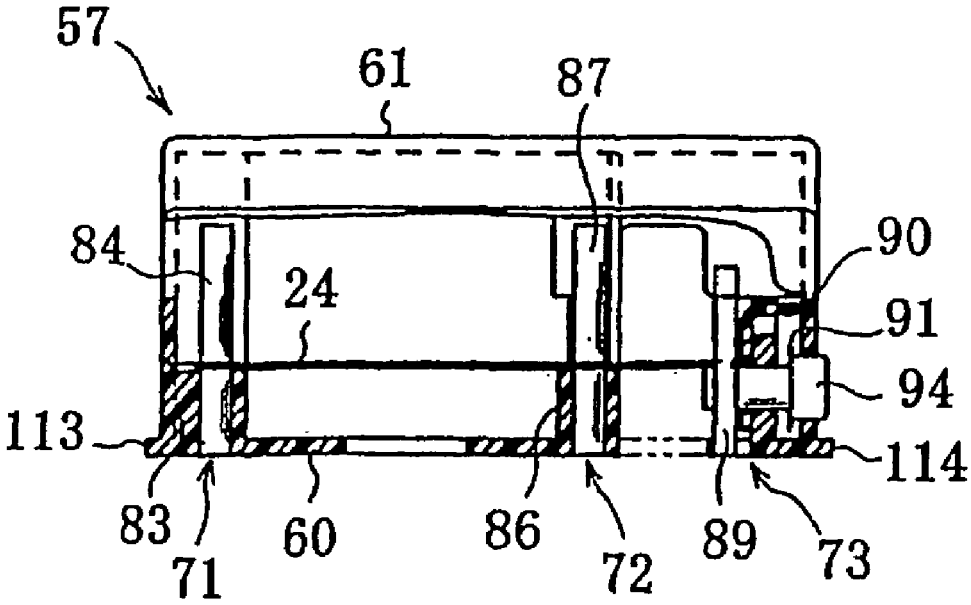
FIG. 27 is a partially cut-away transverse top plan view of the needle thread cassette and shows the downstream portion of a thread passage.
Figure 28:
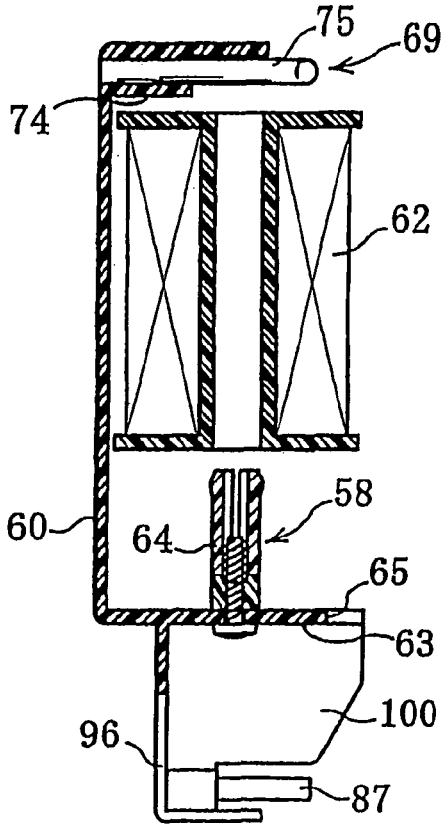
FIG. 28 is a longitudinally sectional side elevation of a cassette body and a thread bobbin (in the state before mounted).
Figure 29:
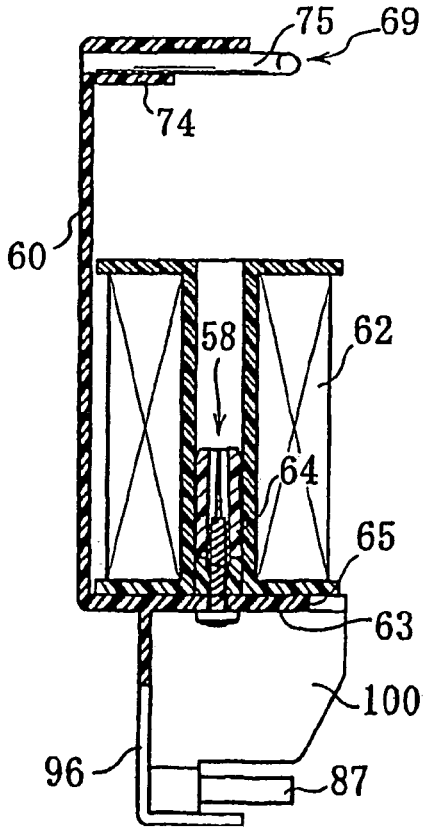
FIG. 29 is a longitudinally sectional side elevation of the cassette body and the thread bobbin (in the state after mounted).
Figure 30:
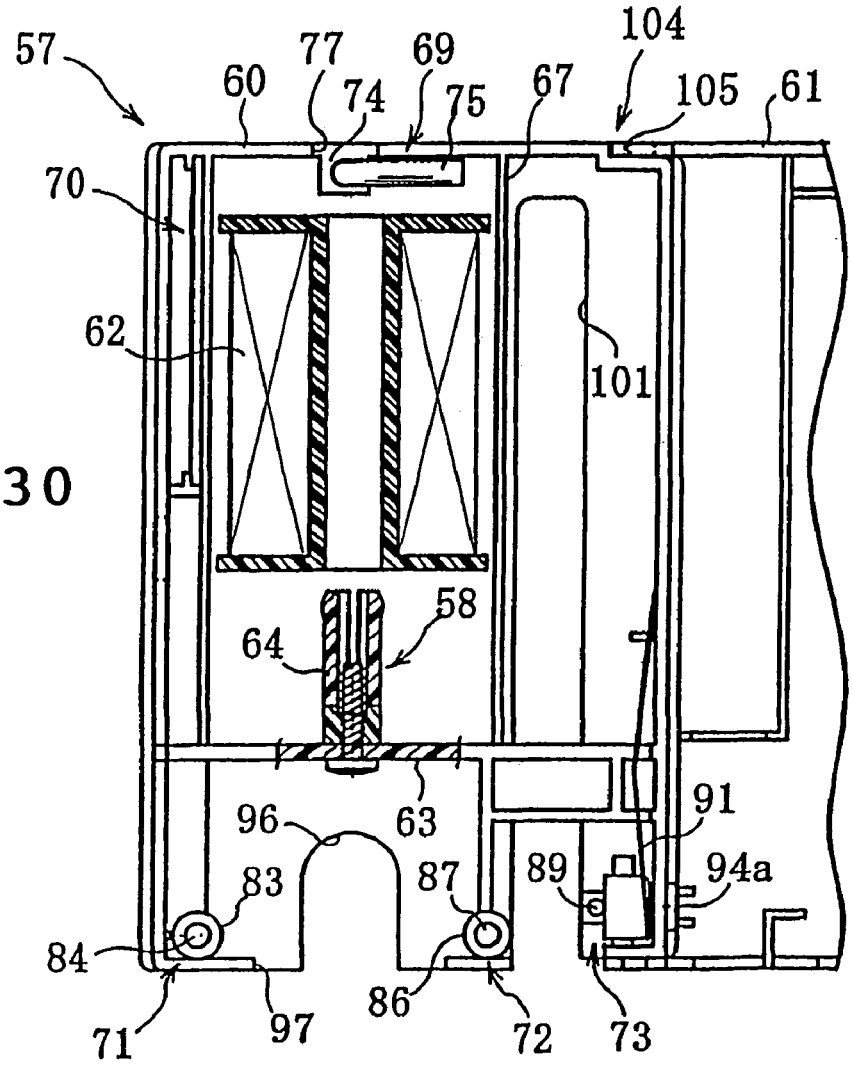
FIG. 30 is a front elevation of the needle thread cassette (in the state where the openable cover is opened).
Figure 31:
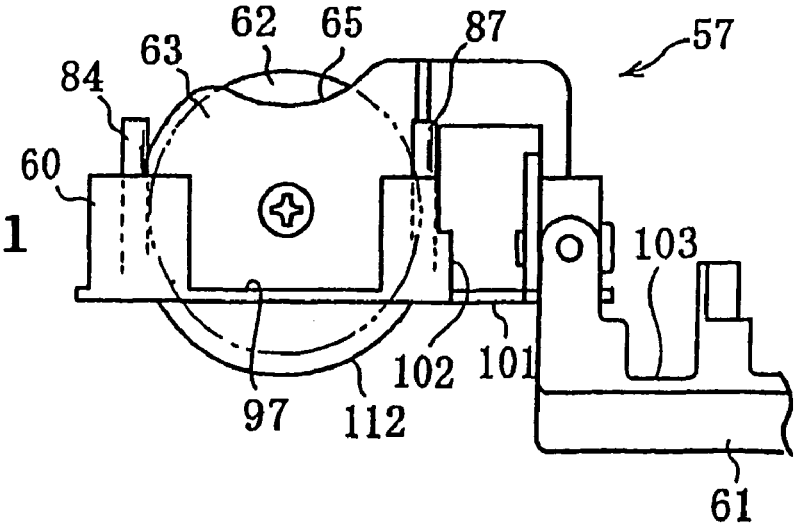
FIG. 31 is a bottom view of the needle thread cassette (in the state where the openable cover is opened).
Figure 32:
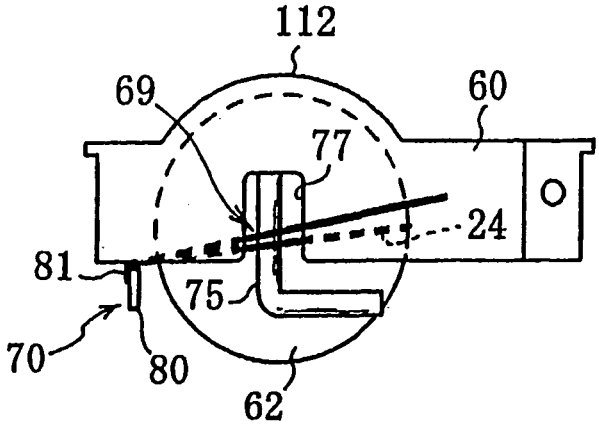
FIG. 32 is a top plan view of the cassette body and shows a first guide portion.
Figure 33:
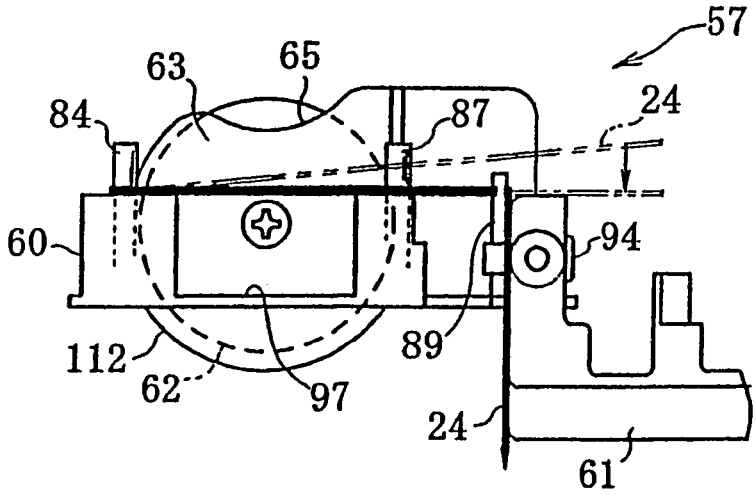
FIG. 33 is a bottom view of the needle thread cassette and shows second and third guide portions and the second clamping portion.
Figure 34:
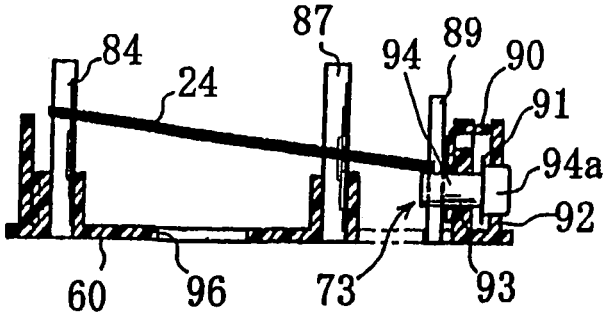
FIG. 34 is a transverse section of the cassette body and shows the second and third guide portions and the second clamping portion.
Figure 35:
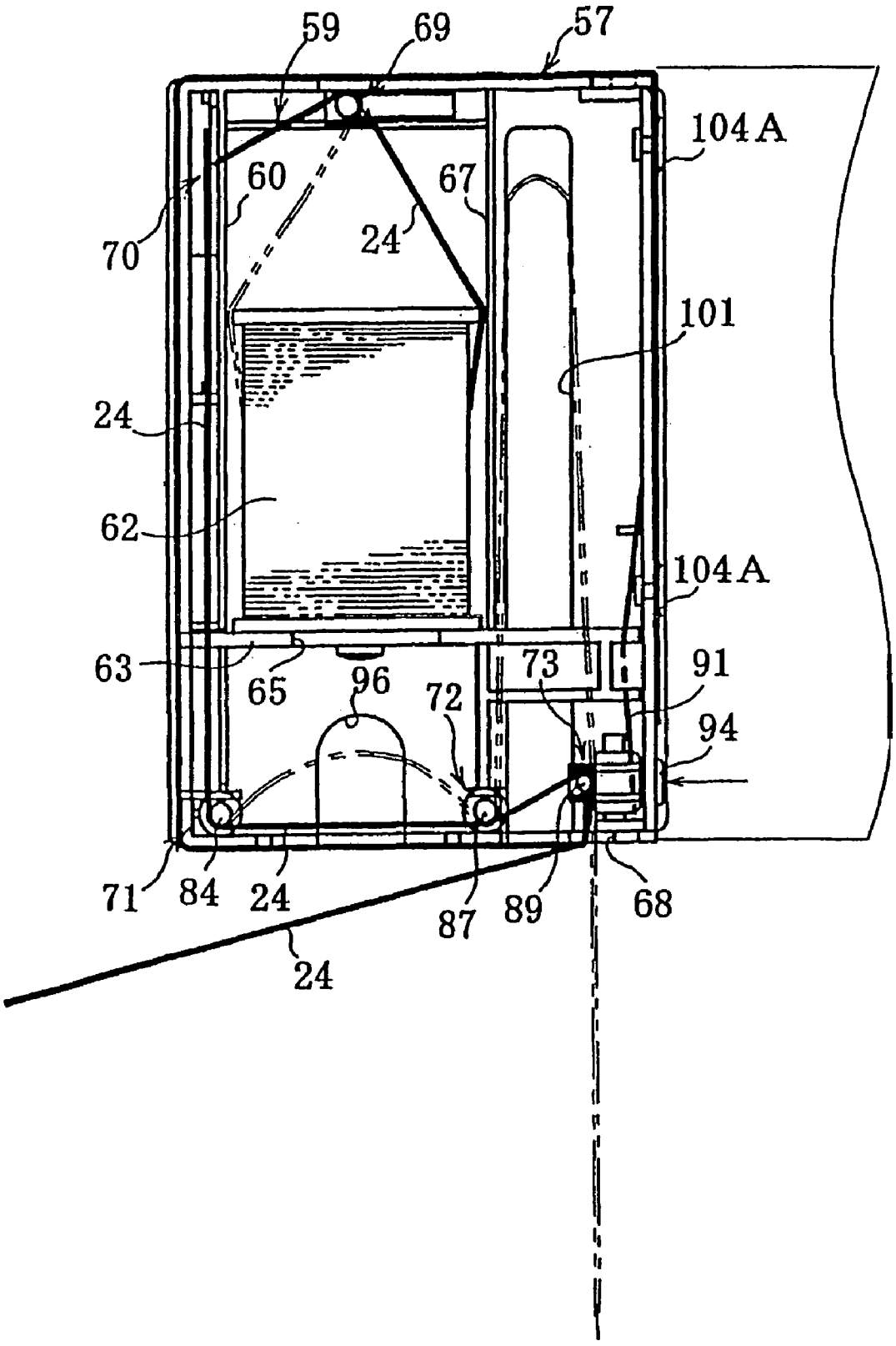
FIG. 35 is a front elevation of the needle thread cassette for explaining a thread holding procedure.
Figure 36:
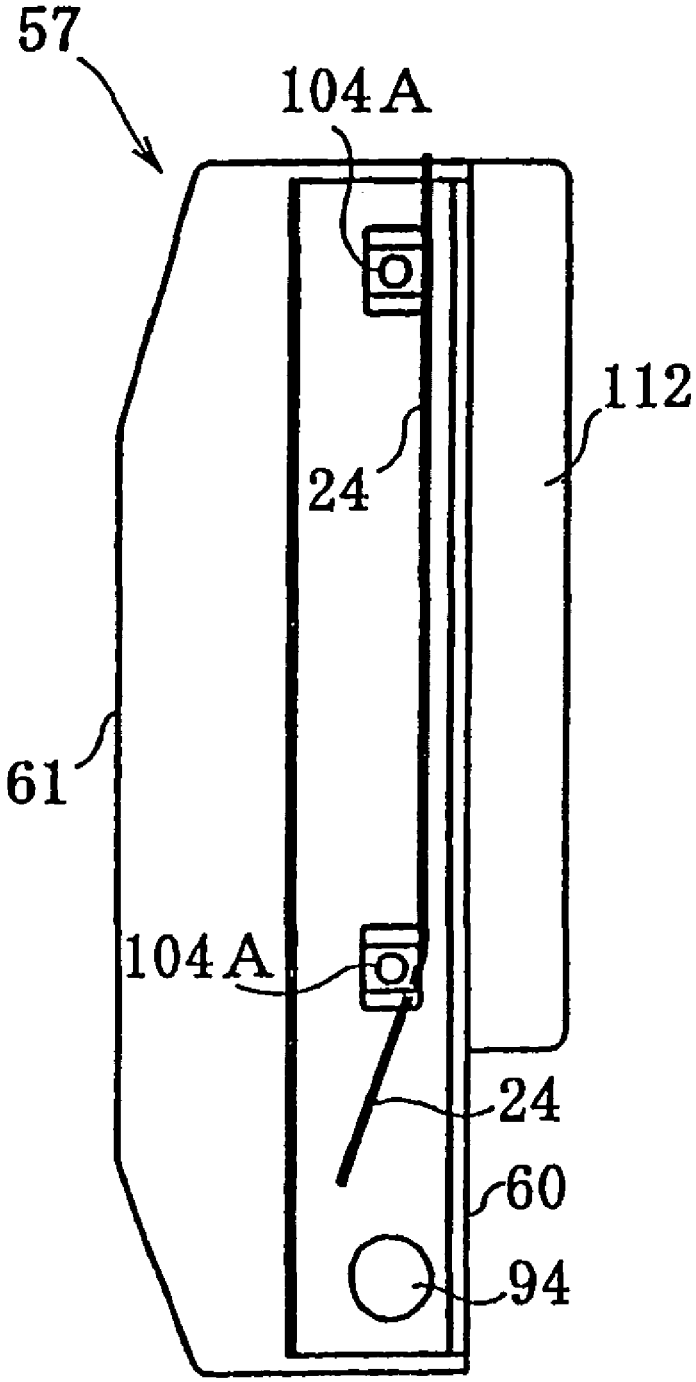
Figure 37:
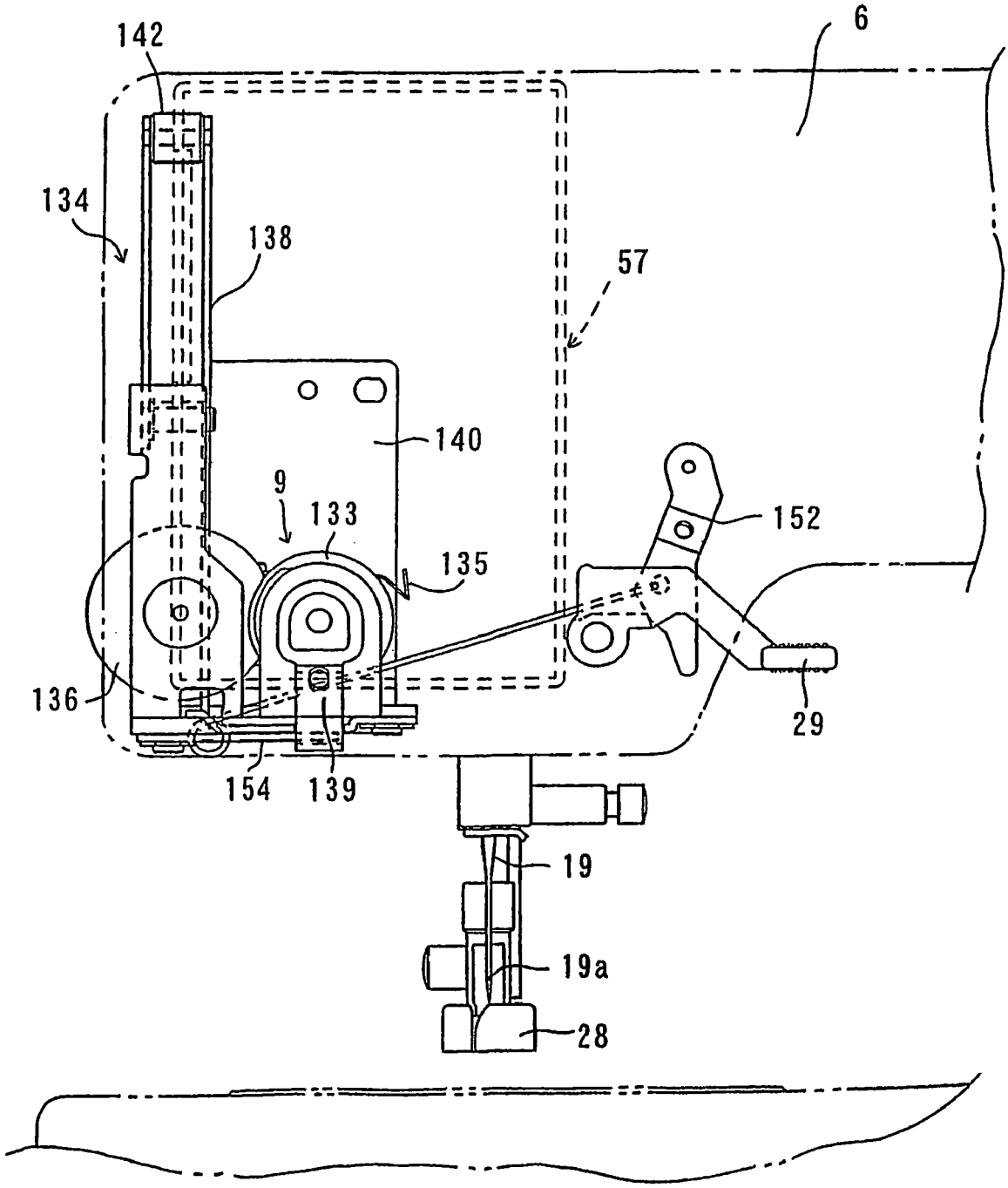
Figure 38:
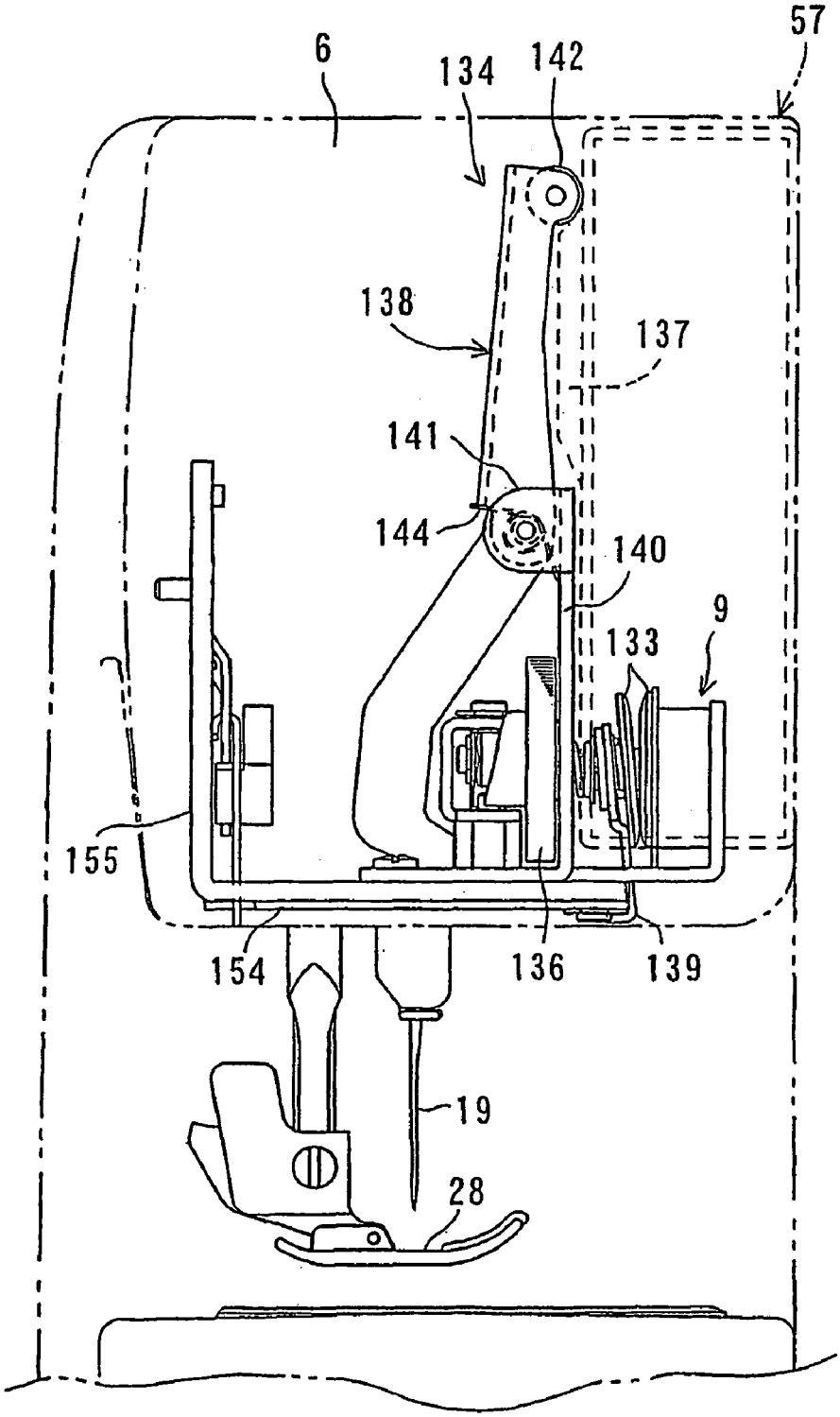
Figure 39:
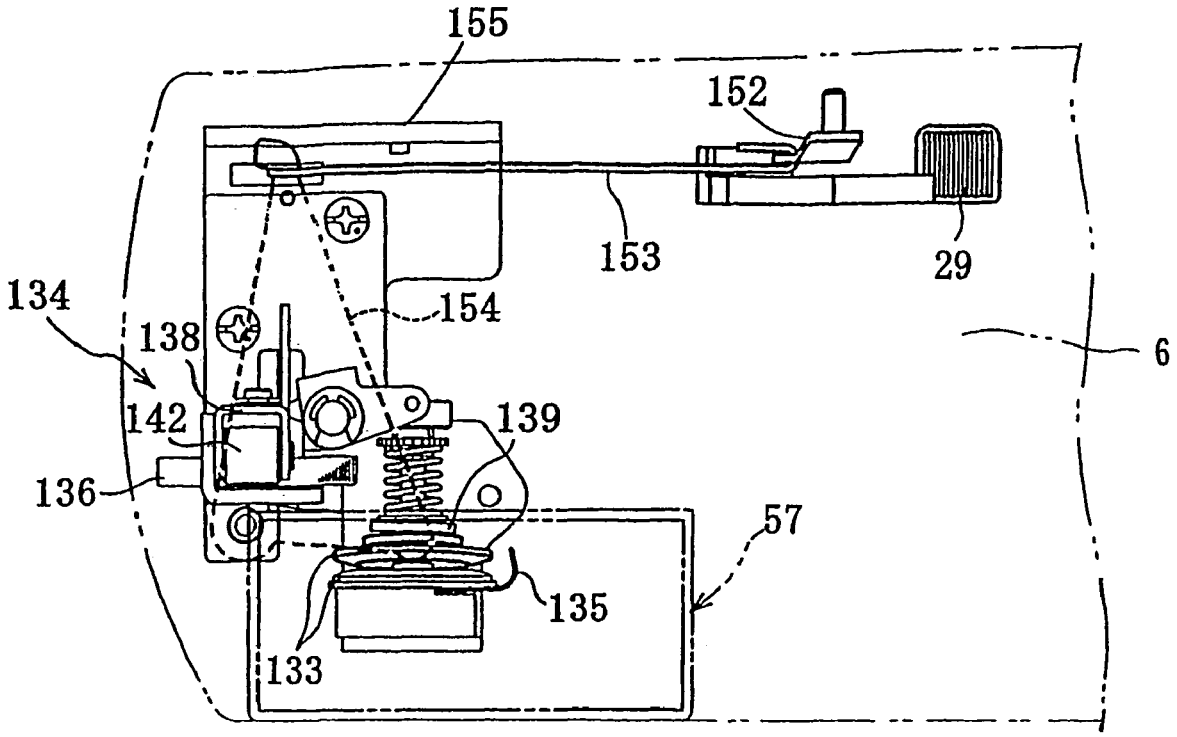
Figure 40:
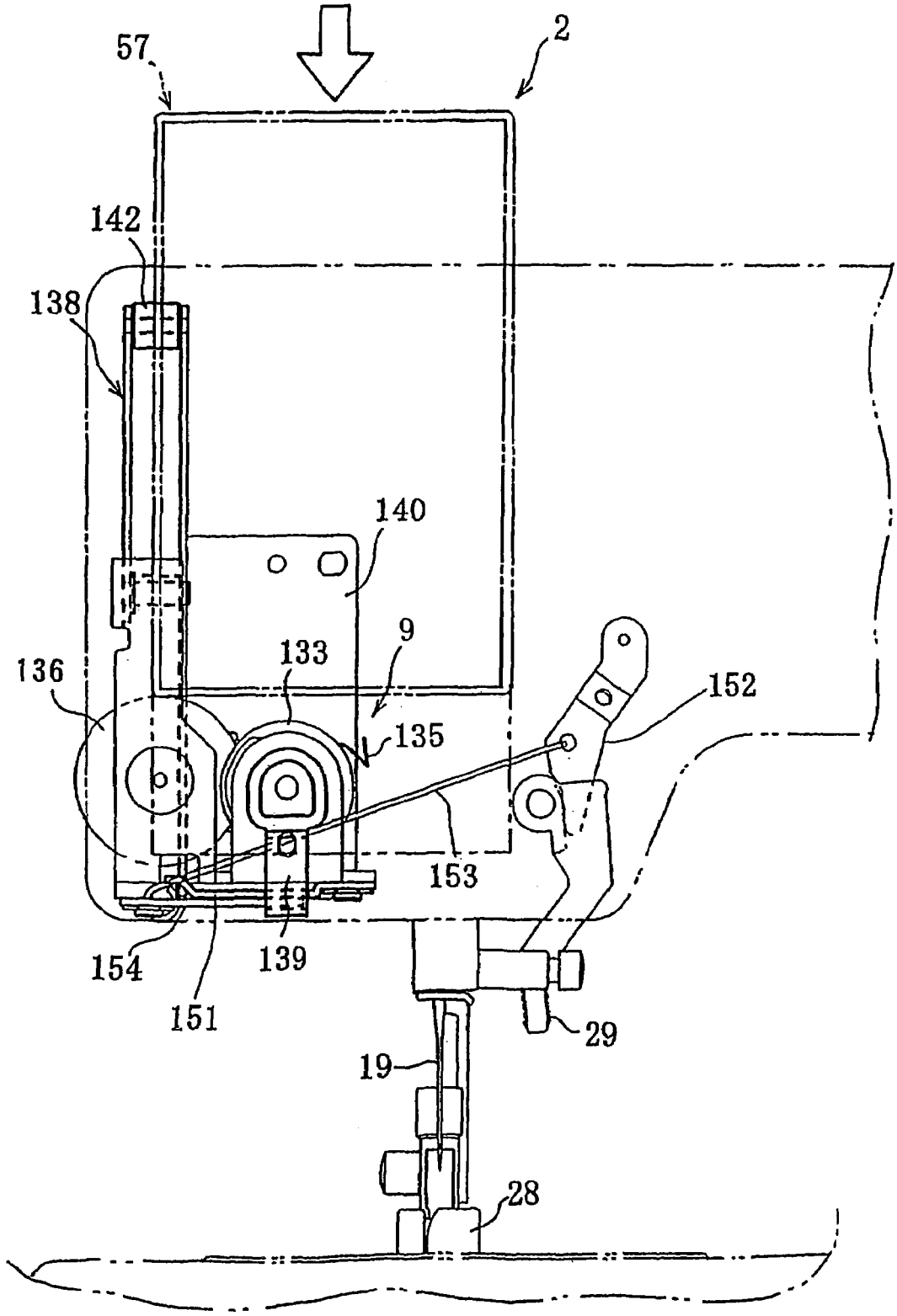
FIG. 40 is a view corresponding to FIG. 37 and shows the state where the needle thread cassette is mounted.
Figure 41:
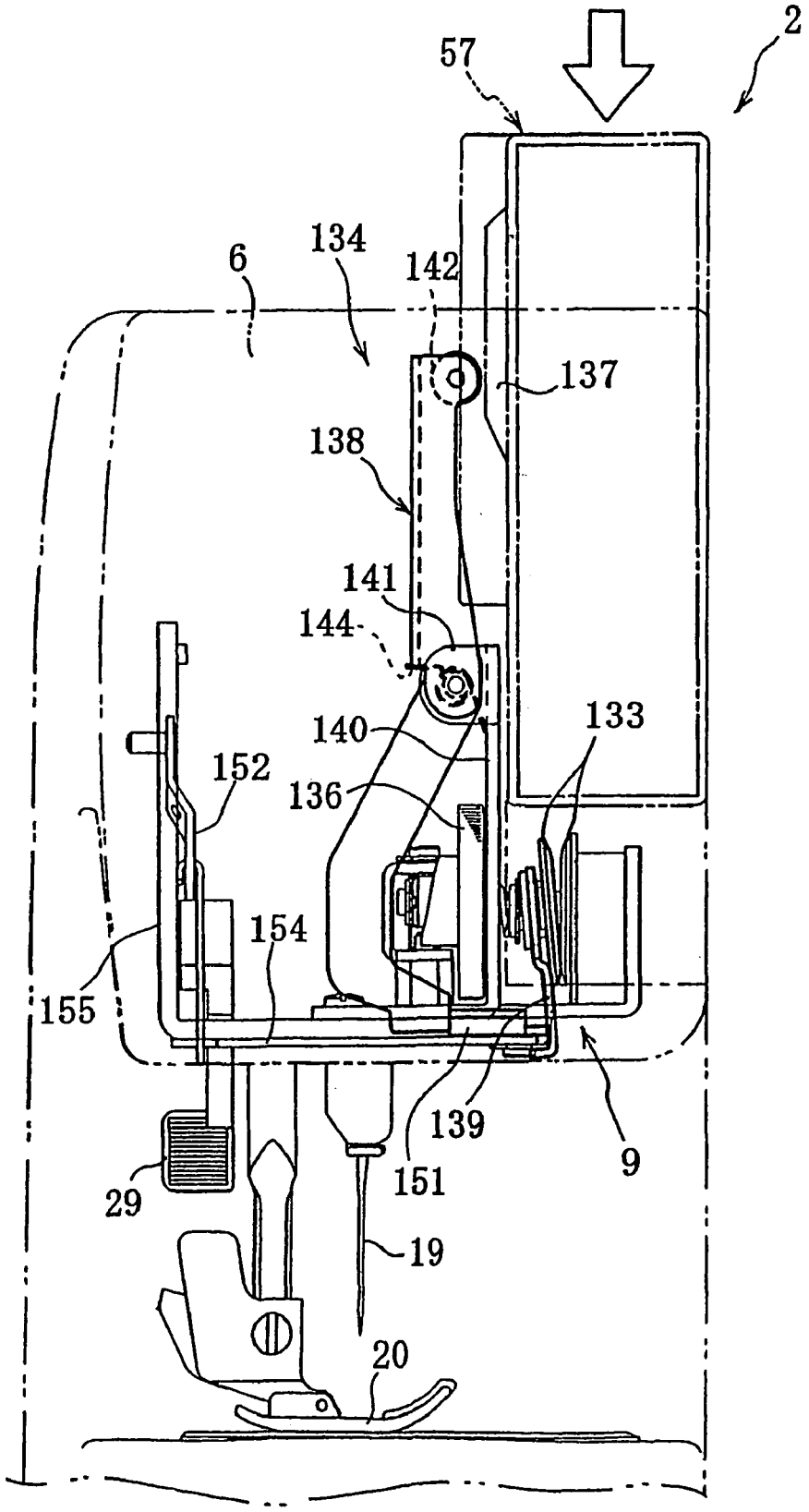
FIG. 41 is a view corresponding to FIG. 38 and shows the state where the needle thread cassette is mounted.
Figure 42:
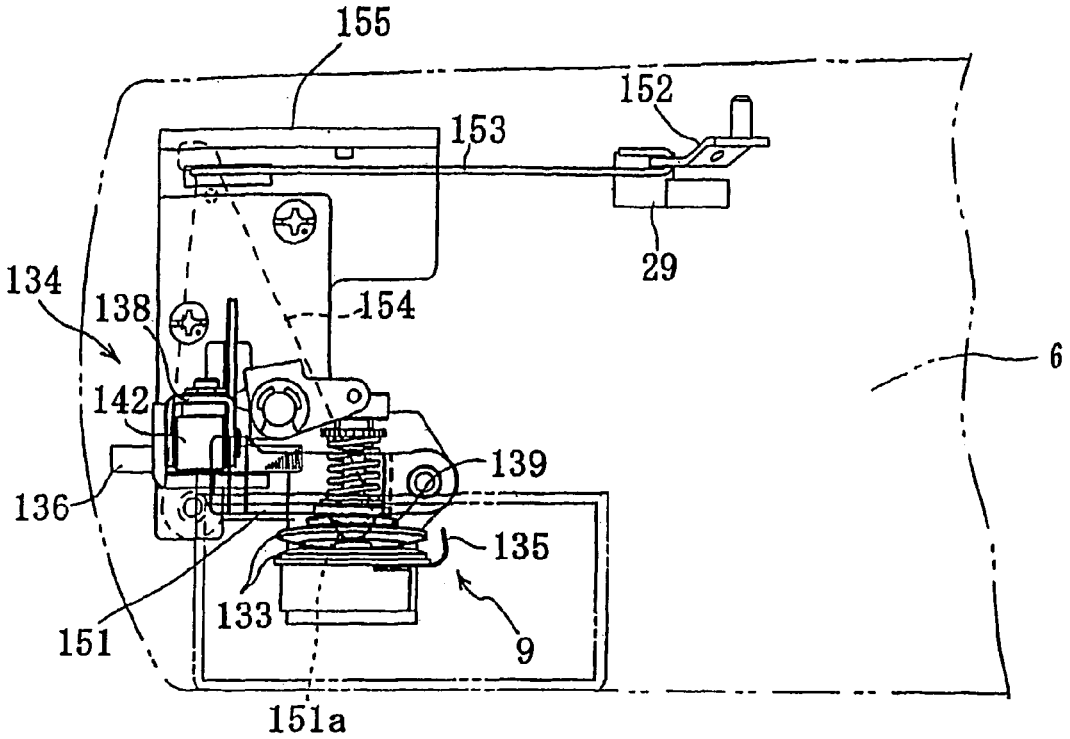
FIG. 42 is a view corresponding to FIG. 39 and shows the state where the needle thread cassette is being mounted.
Figure 43:
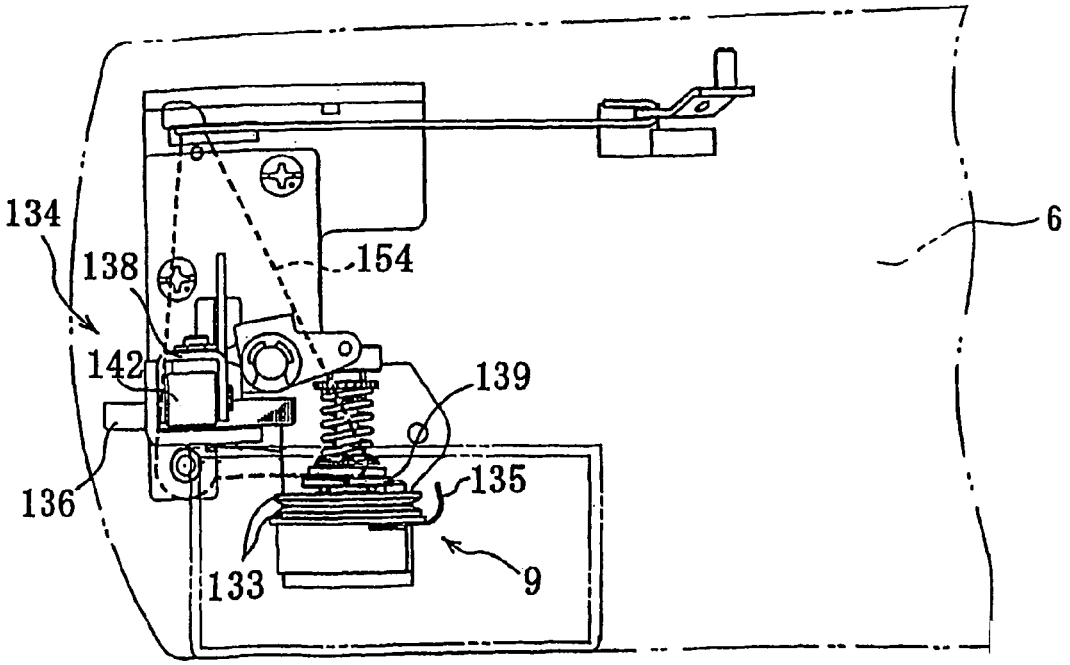
FIG. 43 is a view corresponding to FIG. 39 and shows the state after the mounting of the needle thread cassette is completed.
Figure 44:
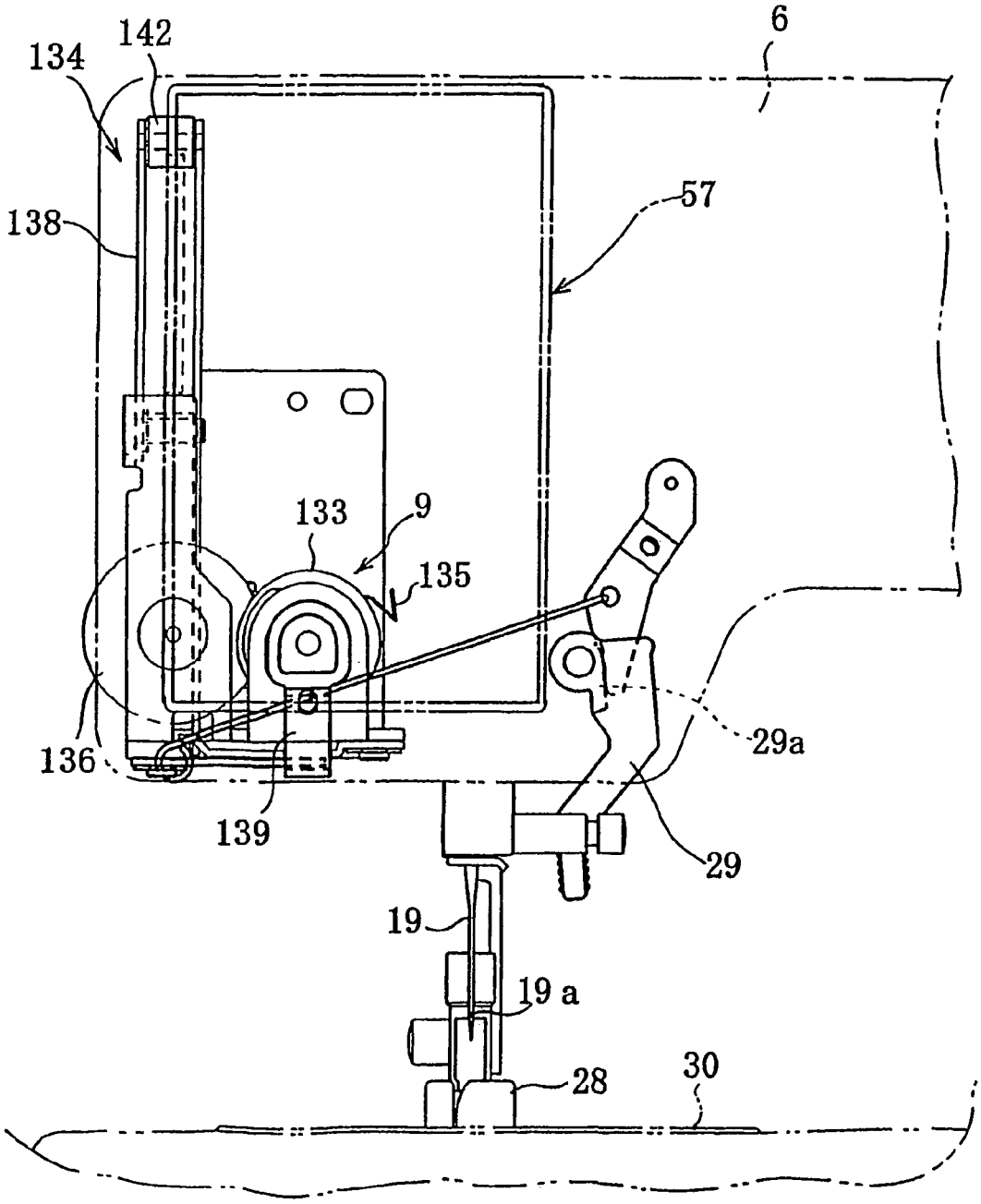
FIG. 44 is a view corresponding to FIG. 37 and shows the state after the mounting of the needle thread cassette is completed.
Figure 45:
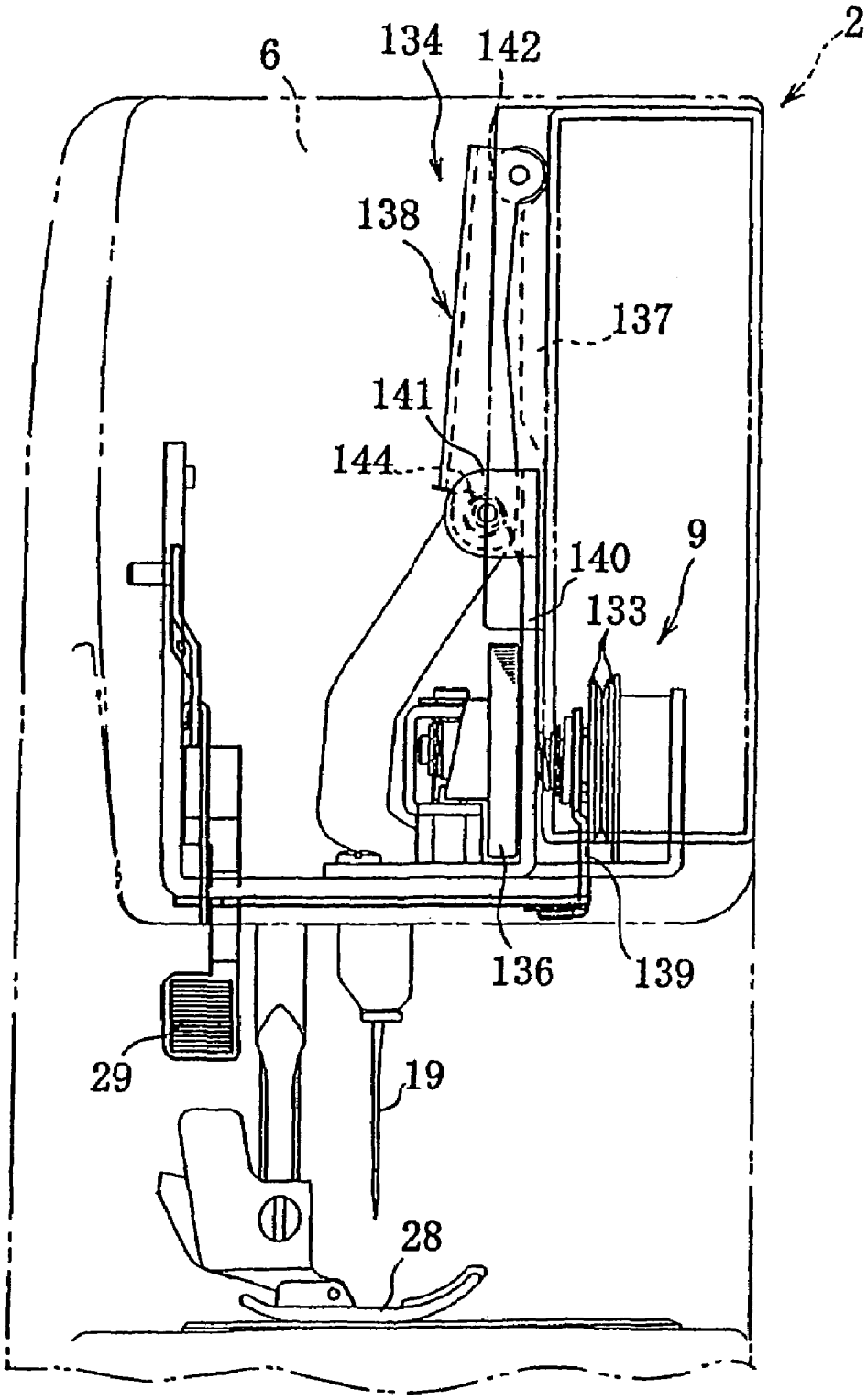
FIG. 45 is a view corresponding to FIG. 38 and shows the state after the mounting of the needle thread cassette is completed.

The first clamp portion 70 will be described in the following. As shown in FIG. 23 and FIG. 24, the first clamp portion 70 applies the passing resistance to the needle thread 24 in the upstream portion of the thread passage 59 and prevents the thread from being twisted and interlaced with each other. This first clamp portion 70 is disposed near the upper end of the left end portion in the cassette case 57. The first clamp portion 70 is constructed of a thread twist preventing mechanism 82 including a presser plate 80 having a thread guide portion 80*a* and a leaf spring 81 for pressing the needle thread 24 onto the presser plate 80.

The presser plate 80 and the leaf spring 81 are fixed on the partition 66 of the cassette body 60.

The thread guide portion 80*a* of the presser plate 80 is a narrow notch opened upward and protruding forward of the cassette body 60. The leaf spring 81 abuts against the left side face of the thread guide portion 80*a* to clamp the needle thread 24 between itself and the thread guide portion 80*a*, and applies the passing resistance to the needle thread 24 to prevent the needle thread 24 from being twisted and interlaced.

Next, the second and third guide portions 71 and 72 and the second clamp portion 73 are disposed in the downstream portion of the thread passage 59, as shown in FIG. 14, FIG. 15, FIG. 17 to FIG. 21, FIG. 26 and FIG. 27. The second guide portion 71 is located at the lower end portion of the left end portion in the cassette case 57; the third guide portion 72 is located at the lower end portion of the boundary between the thread tension regulator housing portion 57*c* and the thread take-up lever travel region 57*b* in the cassette case 57; and the second clamp portion 73 is located near the lower end of the right end in the cassette case 57.

The needle thread 24 extends obliquely from the first guide portion 69 to the first clamp portion 70, vertically from the first clamp portion 70 to the second guide portion 71, horizontally from the second guide portion 71 to the third guide portion 72, and generally horizontally or at an inclination from the third guide portion 72 to the second clamp portion 73. Thus, the needle thread 24 is guided to cross along the lower end portion of the cassette case 57.

The second guide portion 71 is constructed of a pin support portion 83 disposed at the rear wall portion of the cassette body 60, a guide pin 84 fixed on the pin support portion 83 and protruding forward, and a rib 85 formed on the openable cover 61 for preventing the thread from coming out. The pin support portion 83 and the rib 85 set the longitudinal position of the needle thread 24 properly. The third guide portion 72 is constructed of a pin support portion 86 disposed at the rear wall portion of the cassette body 60, a guide pin 87 fixed on the pin support portion 86 and protruding forward, and a rib 88 formed on the openable cover 61 for preventing the thread from coming out. The pin support portion 86 and the rib 88 set the longitudinal position of the needle thread 24 properly.

The second clamp portion 73 will be described in the following. As shown in FIG. 14, FIG. 15, FIG. 17 to FIG. 21 and FIG. 33 to FIG. 36, the second clamp portion 73 applies the passing resistance to the needle thread 24 in the vicinity of the thread exit 68. No matter whether the needle thread cassette 2 might be neither mounted in the cassette mount 3 nor completely mounted, the second clamp portion 73 is constructed to apply a higher passing resistance to the needle thread 24 than the first clamp portion 70. When the needle thread 24 is engaged with the thread guard 26 of the thread take-up lever 25 and the thread tension regulator 9 at the time of mounting the needle thread cassette 2, therefore, the needle thread 24 is kept in the tensed state between the second guide portion 71 and the second clamp portion 73. Therefore, the thread guard 26 of the thread take-up lever 25 and the thread tension regulator 9 can be reliably threaded, and the needle thread 24 necessary for the threading operation can be reliably fed out from the thread bobbin 62. In other words, the third guide portion 72 and the second clamp portion 73 function as the needle thread control portion for controlling the needle thread 24 when the thread guard 26 of the thread take-up lever 25 is to be threaded.

The second clamp portion 73 is constructed of a movable pin member 94 having an axis directed horizontally in the transverse direction, a guide pin 89 for guiding the needle thread 24, a thread retaining plate 90 and a leaf spring member 91. The movable pin member 94 is composed of a radially smaller pin portion, and a radially larger control button 94*a*, which is enabled to go into and out of the right side face of the lower end portion of the cassette body 60. The movable pin member 94 is so mounted in vertical wall portions 92 and 93 near the right end and the lower end of the cassette body 60 as to move horizontally in the transverse direction, and is elastically biased rightward by the leaf spring member 91.

The guide pin 89 is longitudinally inserted and fixed at its rear end portion in the left end portion of the movable pin member 94, and the thread retaining plate 90 for retaining the needle thread 24 between itself and the guide pin 89 is fixed between the guide pin 89 and the left side face of the vertical wall portion 93, so that the passing resistance is applied to the needle thread 24 by clamping the needle thread 24 between the guide pin 89 biased rightward together with the movable pin member 94 and the thread retaining plate 90.

Figure 14:
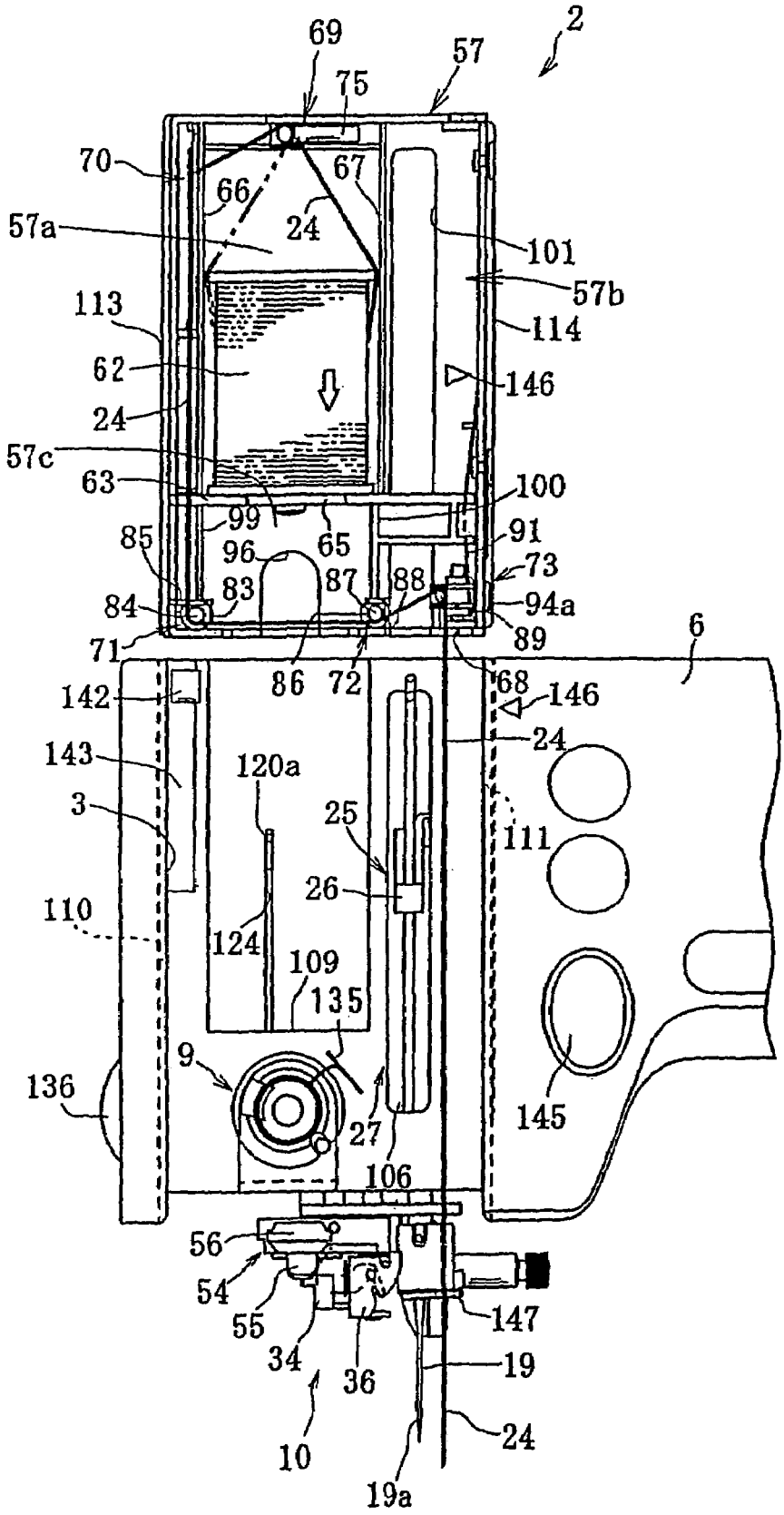
FIG. 14 is a front elevation of the needle thread cassette (in the state immediately before mounted) and the cassette mounting portion.
Figure 18:
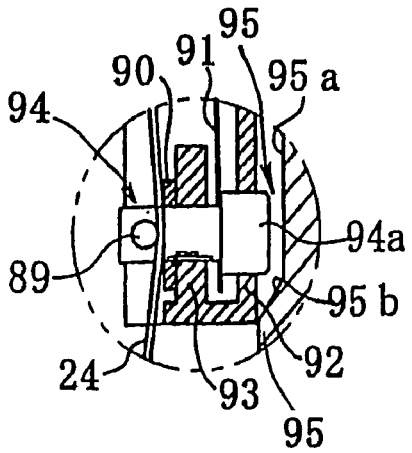
FIG. 18 is a partially enlarged section of a second clamping portion and a cam.

In the state where the needle thread cassette 2 is taken out from the cassette mount 3, as shown in FIG. 14 and FIG. 18, the leading end portion of the control button 94*a* is protruded from the right side face of the cassette body 60 by the biasing force of the leaf spring member 91. In case the needle thread 24 is fed out from the thread bobbin 62 while the needle thread cassette 2 is not mounted in the cassette mount 3, therefore, the movable pin member 94 and the guide pin 89 are moved leftward to open the second clamp portion 73 by pushing the control button 94*a* with the finger of the operator, so that the needle thread 24 can be fed out against the passing resistance of the first clamp portion 70. With the needle thread cassette 62 is completely mounted in the cassette mount 3, therefore, the second clamp portion 73 takes an open state to apply no passing resistance to the needle thread 24, as will be described hereinafter.

Figure 19:
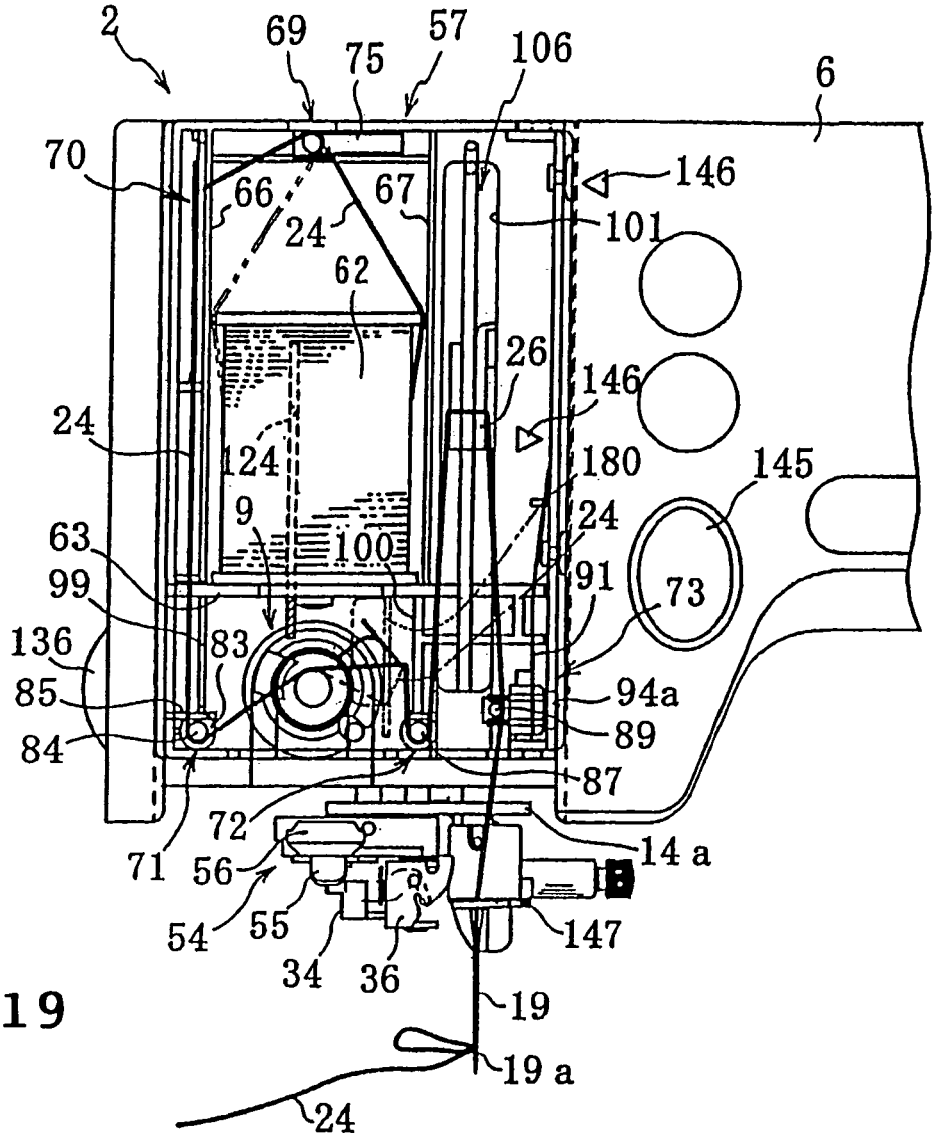
FIG. 19 is a front elevation of the needle thread cassette (in the state after the mounting was completed) and the arm head.
Figure 20:
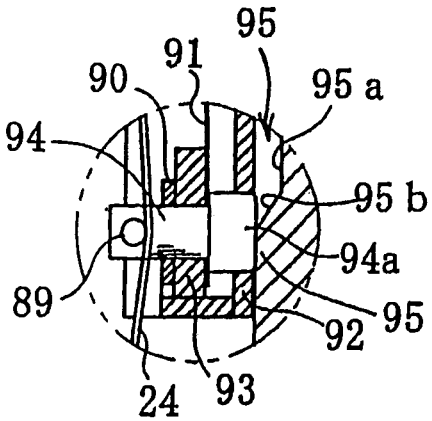
FIG. 20 is a view corresponding to FIG. 18 and shows the second clamping portions (in the opened state) and the cam.

Even in the state where the needle thread cassette 2 is completely mounted in the cassette mount 3, as shown in FIG. 19 and FIG. 20, the second clamp portion 73 is brought into the open state. For this, the cassette mount 3 is provided at its right side wall with a vertical groove 95*a* for releasing the control button 94*a*, and an needle thread releasing cam 95 for bringing the control button 94*a* into a retracted state in the state where the needle thread cassette 2 is completely mounted. These components will be described together with the description of the cassette mount 3.

With the needle thread cassette 2 being completely mounted in the cassette mount 3, the second clamp portion 73 takes an open state, but the needle thread 24 is clamped by the thread tension regulator 9 being penetrated into the thread tension regulator housing portion 57*c* of the needle thread cassette 57 and is given the passing resistance, so that the needle thread 24 between the first clamp portion 70 and the thread tension regulator 9 keeps the tensed state. This prevents the needle thread 24 in the thread passage 59 upstream of the thread tension regulator 9 from being twisted or interlaced.

Here, the thread tension regulator 9 need not be mounted in the arm 6 but can be mounted in the needle thread cassette 2. In this modification, too, the needle thread 24 between the first clamp portion 70 and the thread tension regulator 9 can be kept in the tensed state thereby to prevent the thread from being twisted or interlaced.

As described above, the needle thread 24 is clamped by the first clamp portion 70 and is clamped between later-described thread tension discs of the thread tension regulator 9 and given the passing resistance so that the needle thread is tensed between the discs. When the needle thread is clamped and resisted in this case at the entrance portion of the thread tension discs of the thread tension regulator 9, its structurally intrinsic twist is intensified at that portion. Therefore, the twist intensified more than the structurally intrinsic one is always given to the needle thread portion between the first clamp portion 70 and the thread tension discs of the thread tension regulator 9.

If the needle thread portion becomes slack, it is partially bent to cause the phenomenon that the threads are interlaced with each other at that part into a linear or entangled shape. If this interlaced part is guided to the thread tension discs of the thread tension regulator 9, it is caught by the discs so that it is cut or frayed.

By clamping the needle thread 24 with the first clamp portion 70 and the thread tension discs of the thread tension regulator 9 to tense the clamped thread portion, however, it is possible to eliminate the aforementioned interlaced phenomenon. Here, the needle thread portion having passed through the thread tension discs of the thread tension regulator 9 is released from the intensified twist.

Here will be described the construction for penetrating the thread tension regulator 9 into the thread tension regulator housing portion 57*c* in the cassette case 57 when the needle thread cassette 2 is to be mounted in the cassette mount 3. Below the thread tension regulator housing portion 57*c*, as shown in FIG. 1, FIG. 14, FIG. 15, FIG. 23, FIG. 26, FIG. 30 and FIG. 31, notched rectangular openings 97 and 98 are formed in an opposed shape in the bottom walls of the cassette body 60 and the openable cover 61, and the partially elliptic notch 96 leading to the opening 97 is formed in the rear wall portion of the cassette body 60. When the needle thread cassette 2 is to be mounted, the thread tension regulator 9 is penetrated and housed in the thread tension regulator housing portion 57*c* through the notch 96 and the openings 97 and 98.

Below the thread take-up lever travel region 57*b*, as shown in FIG. 1, FIG. 3, FIG. 11 to FIG. 15, FIG. 26, FIG. 27, FIG. 30 and FIG. 31, notched rectangular openings 102 and 103 are formed in an opposed shape in the bottom walls of the cassette body 60 and the openable cover 61, and the elongated slit 101 leading to the opening 102 and extending from the lower end up to the upper end is formed in the rear wall of the cassette body 60. When the needle thread cassette 2 is to be mounted in the cassette mount 3, the thread guard 26 of the thread take-up lever 25 and the thread guide 106A are penetrated and introduced into the cassette case 57 through those openings 102 and 103 and slit 101.

Figure 21:
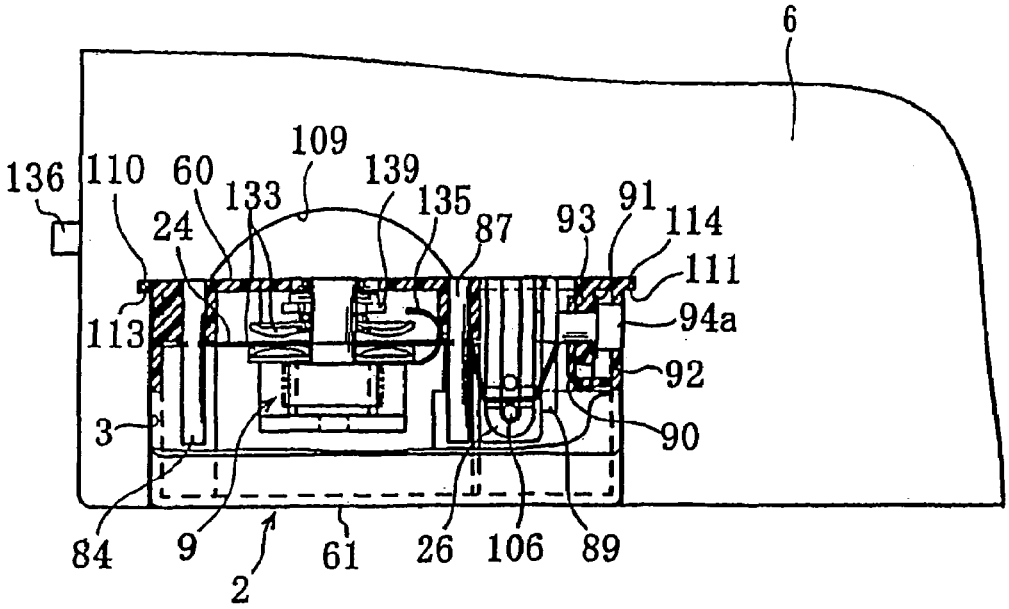
FIG. 21 is a transverse section of the needle thread cassette mounted in the cassette mounting portion.
Figure 22:
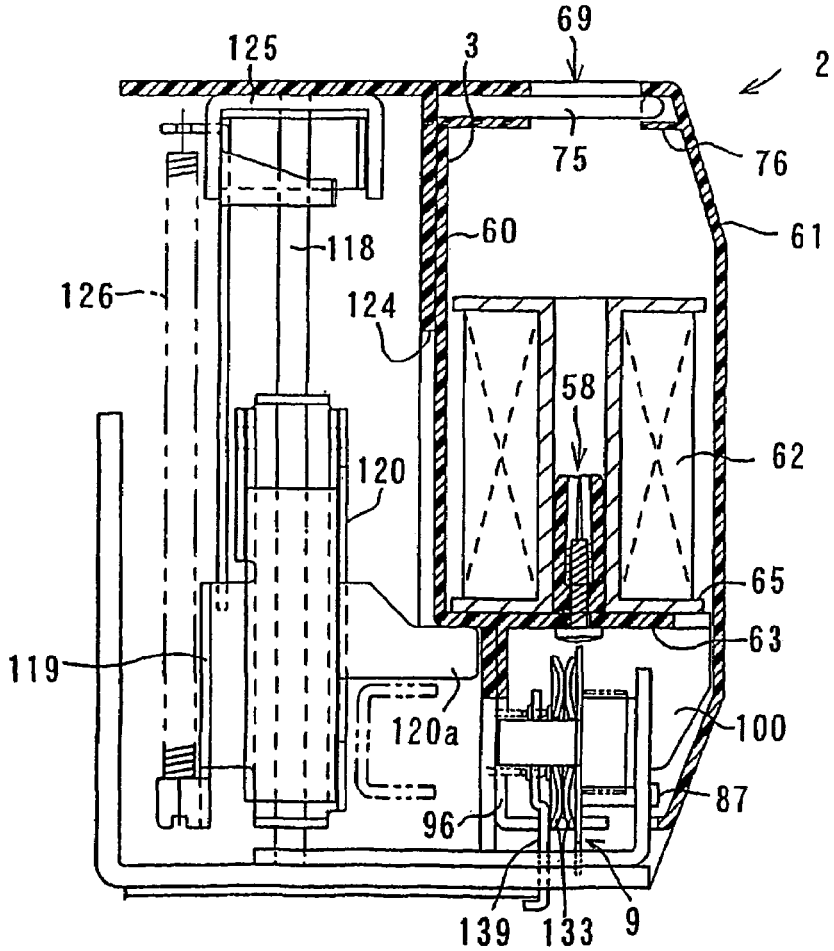
FIG. 22 is a longitudinally sectional side elevation of the needle thread cassette (in the state where the mounting is completed) and the cassette mounting portion.

As shown in FIG. 21, FIG. 22 and FIG. 24, such a rear wall of the cassette body 60 as faces the thread bobbin housing portion 57*a* bulges backward in a partially cylindrical shape for housing the thread bobbin 62, and the portion corresponding to the lower end of the partially cylindrical portion is provided with an engaging portion 112 for engaging from above with a later-described receiving portion 109 of the cassette mount 3 to determine the height position of the needle thread cassette 2. On the two left and right end portions of the rear wall of the cassette body 60, there are formed ridged engaging portions 113 and 114, which can engage with later-described guide grooves 110 and 111 of the cassette mount 3, respectively. With the needle thread cassette 2 being mounted in the cassette mount 3, the front face of the openable cover 61 is flush with the front face of the arm 6, and the upper walls of the cassette body 60 and the openable cover 61 are flush with the upper face of the arm 6 (as referred to FIG. 19 and FIG. 22).

Next, a thread holder 104 of the needle thread cassette 2 will be described in the following. As shown in FIG. 25, FIG. 30, FIG. 35 and FIG. 36, the thread holder 104 is constructed such that the end side portion of the needle thread 24 extending to the outside of the needle thread cassette 2 is temporarily held between a chamfered portion 105 of the hinged portion of the openable cover 61 of the outer face portion of the cassette case 57 and the cassette body 60 to contact with the chamfered portion 105 when the openable cover 61 is closed. The chamfered portion 105 and a portion of the cassette body 60 construct the thread holder 104. However, a thread holder 104A may also be constructed by providing the outer face portion of the cassette case 57 with a leaf spring member biased to the case and by holding the end portion of the needle thread 24 temporarily on the leaf spring member.

Here will be described the cassette mount 3 for mounting the needle thread cassette 2 removably from above. As shown in FIG. 1, FIG. 2, FIG. 4 and FIG. 21, the cassette mount 3 as the controller mount is so formed at the front face of the leading end portion (or the arm head) of the arm 6 of the sewing machine as to have a longitudinally long rectangular shape, as viewed in a front elevation, and a transversely short grooved section. The cassette mount 3 is provided on the right end side with the vertically long thread take-up lever travel region 27, in which the thread guard 26 of the thread take-up lever 25 reciprocates, and its substantial portion excepting the thread take-up lever travel region 27 is located on the left side of the thread take-up lever travel region 27.

The cassette mount 3 is shaped to have its upper end and lower end opened so that the needle thread cassette 2 may be able to be mounted from above in the vertical direction and removed to above in the vertical direction with the axis of the thread bobbin 62 retained in the thread bobbin retaining portion 58 being generally in parallel with the reciprocating direction of the thread guard 26 of the thread take-up lever 25. Near the lower end of the portion, as located rather on the left than the center, of the cassette mount 3, the thread tension regulator 9 is disposed to protrude forward with its axis being directed in the longitudinal direction. In the lower portion of the rear wall of the cassette mount 3, there is formed the stepped receiving portion 109 for receiving the engaging portion 112 of the needle thread cassette 2 to position the needle thread cassette 57 at a predetermined height. Near the rear ends of the left side wall and the right side wall of the cassette mount 3, respectively, there are formed the guide grooves 110 and 111 for introducing and guiding the engaging portions 113 and 114 of the needle thread cassette 2 slidably.

Here will be described the needle thread releasing cam 95, which is disposed at the cassette mount 3 for switching the second clamp portion 73 into the open state. At the rear portion of the right side wall of the cassette mount 3, as shown in FIG. 18 and FIG. 20, there are formed the aforementioned vertical groove 95*a* and the needle thread releasing cam 95 positioned on the terminal end side of the former. The vertical groove portion 95*a* continues from the upper end to the vicinity of the lower end of the cassette mount 3, and the needle thread releasing cam 95 continues to the lower end of the vertical groove portion 95*a* through a taper portion 95*b*, and protrudes to the left side of the vertical groove portion 95*a*.

Figure 17:
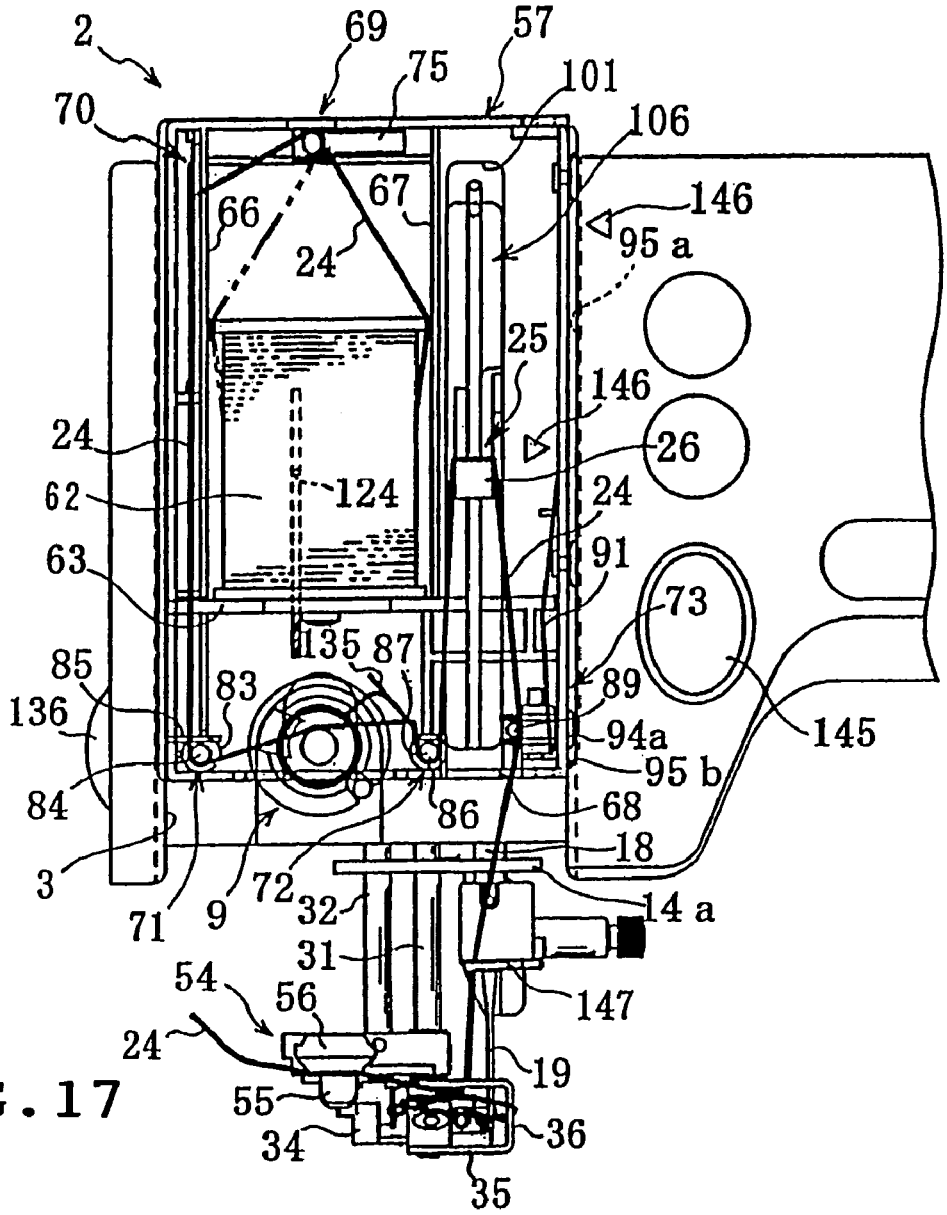
FIG. 17 is a front elevation of the needle thread cassette (in the state immediately before the mounting is completed) and an arm head.

As shown in FIG. 17 and FIG. 18, therefore, the control button 94 protruding from the right side face of the cassette body 60 moves along the groove portion 95*a* till immediately before the needle thread cassette 2 is completely mounted in the cassette mount 3. At this time, the second clamp portion 73 applies the passing resistance to the needle thread 24. When the needle thread cassette 2 is completely mounted in the cassette mount 3 so that the mounting is completed, the control button 94 comes into abutment against the needle thread releasing cam 95 and is pushed leftward. At this time, the second clamp portion 73 is released so that no passing resistance is applied to the needle thread 24.

Next, the thread take-up lever mechanism 8 will be described in detail.

As shown in FIG. 11 to FIG. 14, this thread take-up lever mechanism 8 is given such a specially devised structure as can thread the thread guard 26 with the needle thread 24 in association with the action to mount the needle thread cassette 2 in the cassette mount 3. This thread take-up lever mechanism 8 is exemplified by a cam type, but the following construction can likewise be applied to a link type thread take-up lever mechanism.

This thread take-up lever mechanism 8 is provided with the thread take-up lever 25 which is driven through the thread take-up lever crank 20 by the driving force of the spindle, and the thread guide 106A for forming a thread guide clearance 108 extending in a curved shape along the whole length of the moving locus of the thread guard 26 of the thread take-up lever 25. The thread take-up lever mechanism 8 can introduce the needle thread 24 from above into the thread guide clearance 108 thereby to thread the thread guard 26 with the needle thread 24.

The thread guide 106A is provided with a pair of thread guide members 106, which extend in a curved shape along the whole length of the moving locus of the leading end portion (or the thread guard 26) of the thread take-up lever 25 and which are longitudinally spaced from each other through the thread guide clearance 108. The paired thread guide members 106 are made of a single wire material (of a metal or a synthetic resin) continued at the lower end portion. The upper end portion of the thread guide member 106 on the rear side extends horizontally backward and is so supported on the top frame of the sewing machine frame as to turn through a hinge member 107 so that the lower end portion of the thread guide 106A is left as a free end. The upper end portion of the thread guide member 106 on the front side is bent forward to form an inlet port 108*a* for introducing the needle thread 24 from above into the thread guide clearance 108. Here, the thread guide 106A and the thread guard 26 of the thread take-up lever 25 protrude from the opening of the rear wall of the cassette mount 3 into the cassette mount 3.

The thread take-up lever 25 is equipped at its leading end side with a guide portion 25*a* having a U-shaped, as viewed in a top plan, which is formed by folding back the leading end portion of a predetermined length. The paired thread guide members 106 insert the U-shaped guide portion 25*a* slidably relative to each other. When the U-shaped guide portion 25*a* vertically reciprocates, the paired thread guide members 106 are guided, while being turned at their upper portions, by the U-shaped guide portion 25*a* so that their sliding resistance to the U-shaped guide portion 25*a* is so low as to generate no substantial noise. In the portion, as corresponds to the clearance (i.e., the thread guide clearance 108) between the paired thread guide members 106, of the U-shaped guide portion 25*a*, there is formed the thread guard 26, which has a threading U-shaped recess formed in its upper face for threading the needle thread 24 from above.

When the needle thread cassette 2 is mounted vertically from above with the axis of the thread bobbin 62 being generally in parallel with the reciprocating direction of the thread guard 26 of the thread take-up lever 25, therefore, the needle thread 24 between the third guide portion 72 and the second clamp portion 73 of the needle thread cassette 57 can be introduced from the inlet port 108*a* into the thread guide clearance 108 and can be easily engaged with the thread guard 26 of the thread take-up lever 25. Here, the thread guide 106A need not be made of the wire material but may be constructed of a sheet material made of a metal or a synthetic resin.

Here will be described the transmission mechanism 115 for transmitting the actions of the needle thread cassette 2 to the automatic threading mechanism 10. As shown in FIG. 5 to FIG. 8, this transmission mechanism 115 transmits the actions of the needle thread cassette 2 to the automatic threading mechanism 10 through a threading slider actuating mechanism 116, and is provided with an engaging mechanism 117 for releasing when engaged with the threading positioning member 52. This threading slider actuating mechanism 116 is constructed to include: a threading slider actuating shaft 118 (as will be called the "shaft"); a threading slider actuating member 119; a threading slider actuating lever 120 (as will be called the "lever 120"); a threading slider actuating pawl 121 (as will be called the "actuating pawl 121"); a threading slider actuating pawl spring 122 (as will be called the "torsion spring 122"); and a threading slider actuating stopper 123 (as will be called the "stopper 123").

Figure 4:
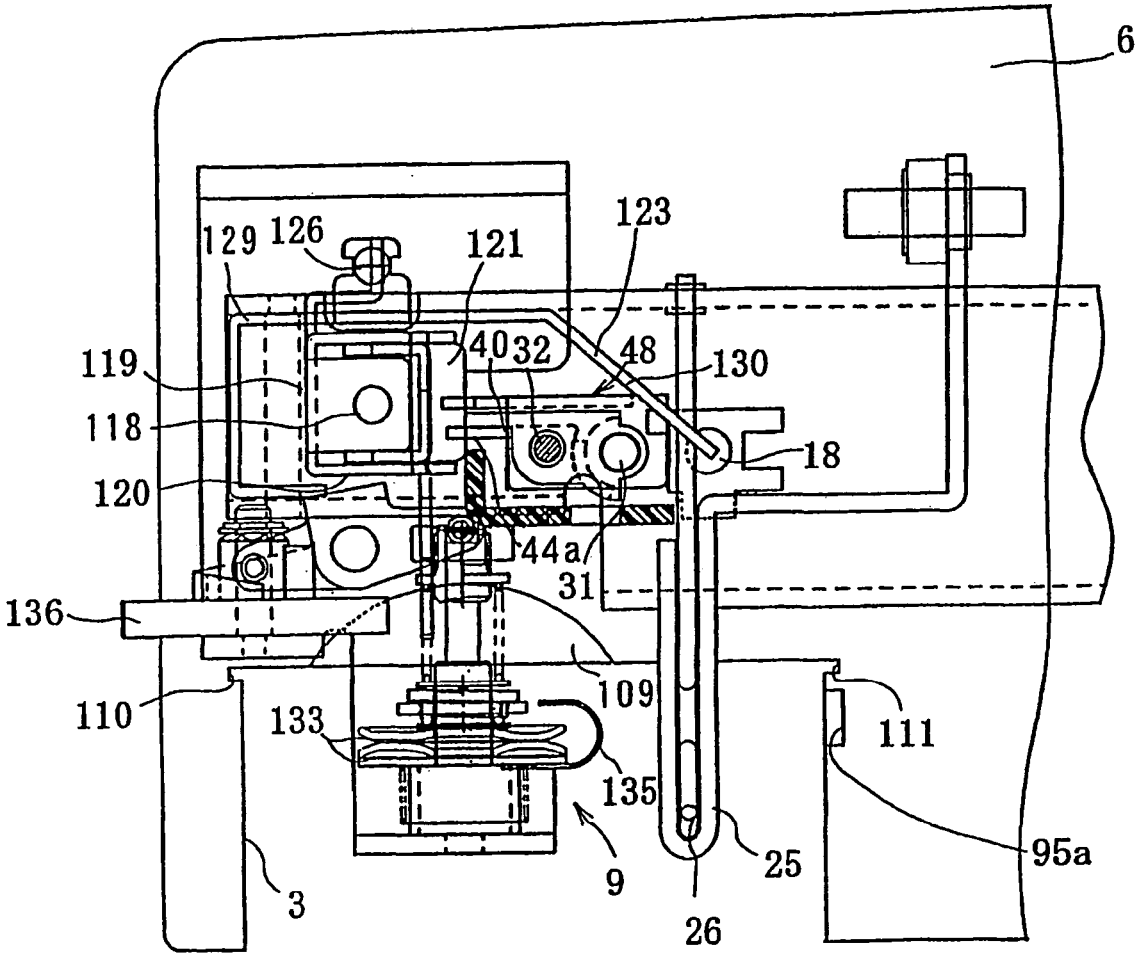
FIG. 4 is a top plan section showing an internal structure and so on near the cassette mounting portion.
Figure 10:
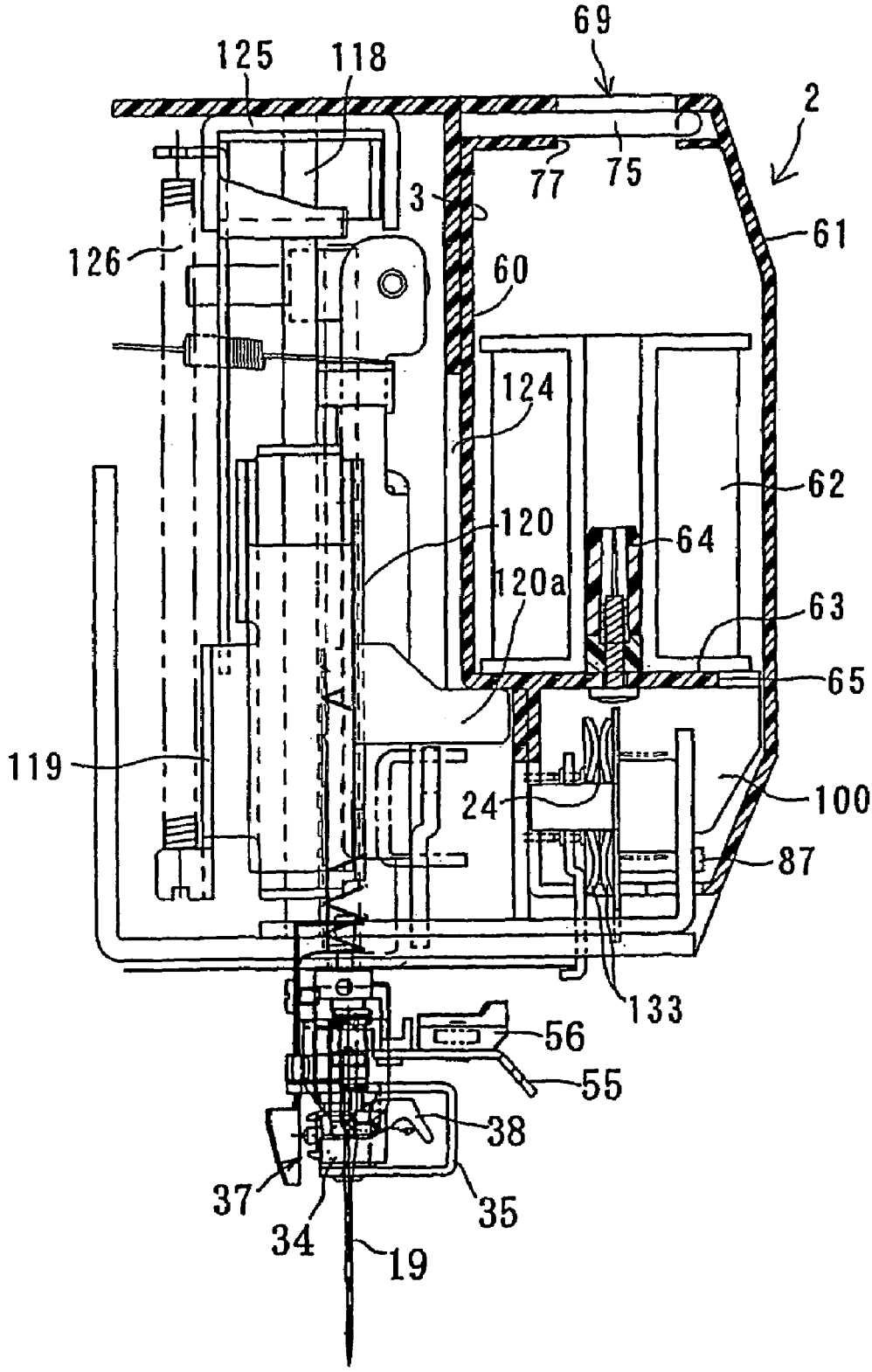
Figure 11:
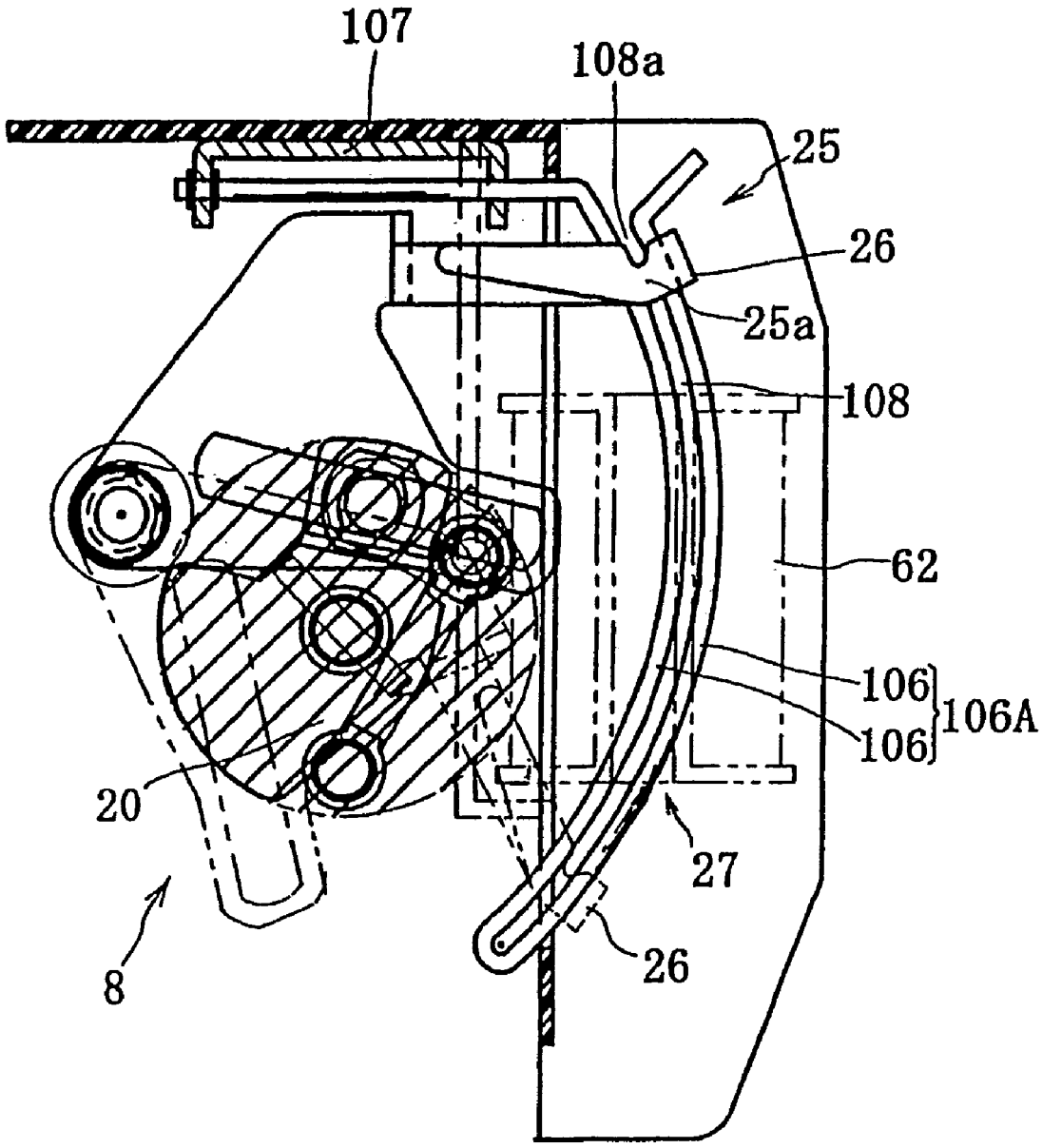
FIG. 11 is a longitudinally sectional side elevation of an essential portion showing a thread take-up lever mechanism and the cassette mounting portion.
Figure 12:
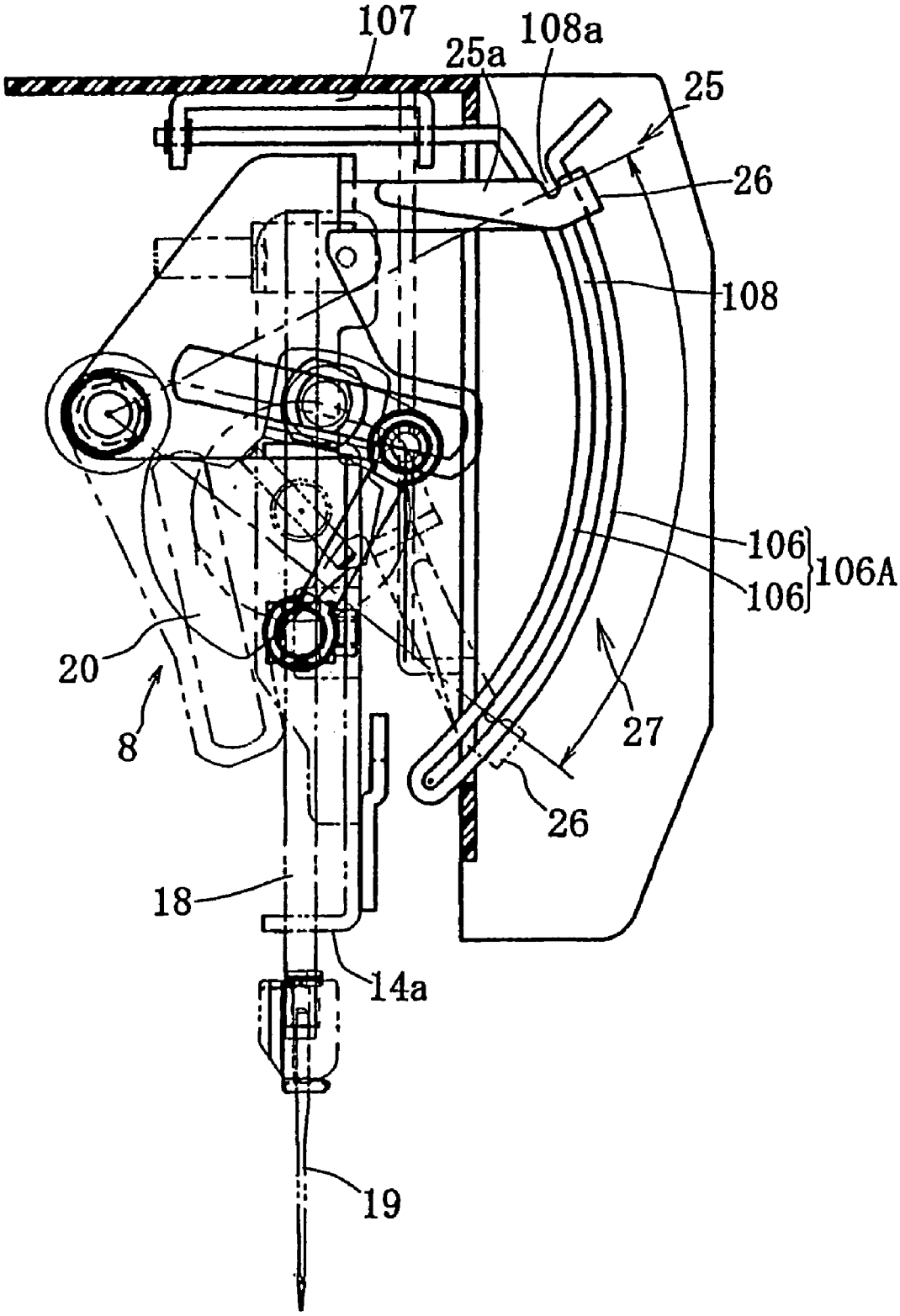
FIG. 12 is a longitudinally sectional side elevation of an essential portion and shows the moving range of thread guard of the thread take-up lever.

In the arm 6 near the cassette mount 3, as shown in FIG. 4, FIG. 5 and FIG. 10, there is vertically supported the shaft 118, on which the slider actuating member 119 having a general C-shape, as viewed in a side elevation, is vertically movably supported. On the threading slider actuating member 119, there is fixed the lever 120 having a C-shape, as viewed in a top plan. A plate-shaped lever portion 120*a* is so disposed at a substantially intermediate portion of the right end of the front plate portion of the lever 120 as to protrude forward. The leading end portion of the lever portion 120*a* is formed to protrude by a predetermined length from the inside of the arm 6 through the receiving portion 109 of the cassette mount 3. From the substantially intermediate portion to the lower end of the receiving portion 109, there is formed a slit 124, along which the lever portion 120*a* can move up and down.

A bracket 125 is fixed on the top plate near the upper end of the shaft 118, and a tension coil spring 126 is interposed on the back side of the shaft 118 over between the stopper 123 and the lever 120 thereby to bias the lever 120 (i.e., the lever portion 120*a*) upward. In order to retain the completely mounted state (or the sewing position) of the needle thread cassette 2, the frictional resistance to act between the control button 94 and the cam 95 is made higher than the biasing force of the tension coil spring 126.

Here will be described the engaging mechanism 117. At the right end upper portion of the lever 120, as shown in FIG. 4 to FIG. 8, there is hinged the actuating pawl 121. This actuating pawl 121 is constructed to rock over a lock position, in which its lower end portion can engage with the pawl portion 44*a* of the threading slider pawl 44, and a release position, in which the actuating pawl 121 is released from the engagement with the pawl portion 44*a*. Around a hinge pin 127, however, there is mounted the torsion spring 122 to act between the threading slider actuating member 119 and the actuating pawl 121, thereby to bias the actuating pawl 121 to the lock position side.

The lower end portion of the actuating pawl 121 is constructed to come into and out of abutment against the offset member cam portion 53. When the threading slider actuating member 119 is pushed down in the lock position, the lower end portion of the actuating pawl 121 abuts against the slope portion 53*a* of the offset member cam portion 53 and moves leftward along the slope portion 53*a*. In the state where the right end portion of the upper support portion 49 of the offset member 48 is abutting against the threading positioning member 52 from above, as shown in FIG. 6, the actuating pawl 121 is switched to the release position so that the engaging mechanism 117 is released. When the actuating pawl 121 is switched to the release position, the threading slider 40 and the offset member 48 are turned upward from the lower limit position, as shown in FIG. 6, by the biasing forces of the compression coil springs 46 and 47.

Here will be described the stopper 123. On the left end portion of the bracket 125, as shown in FIG. 4 to FIG. 8, there is longitudinally supported a stopper pin 128, to which the stopper 123 having a general L-shape, as viewed in a side elevation, is hinged. This stopper 123 is provided with: a vertical portion 129 extending generally vertically downward from the stopper pin 128; a horizontal portion 130 extending generally horizontally rightward from the stopper pin 128 to the top position of the needle bar 18; and the aforementioned coil spring 126 (as referred to FIG. 10) for biasing those vertical portion 129 and horizontal portion 130 clockwise in FIG. 8. At the lower end of the vertical portion 129, there is formed a slope portion 131, which is sloped the more leftward as it goes the more downward.

At the left end portion in which the slope portion 131 and the vertical portion 129 intersect, there is formed a stopper portion 132 (corresponding to a step portion). This stopper portion 132 can be engaged from above with a stopper engaging portion 119*a*, which is formed at the lower end portion of the threading slider actuating member 119. In case the upper end of the needle bar 18, i.e., the stopper 123 is within a proper range from 500A to 500B (as referred to FIG. 8), the stopper engaging portion 119*a* comes into contact with the slope portion 131 of the stopper 123 when the threading slider actuating member 119 is moved downward from the upper limit position, as shown in FIG. 5, by the needle thread cassette 2. After this, a guide wall 119*b* of the threading slider actuating member 119 slides with respect to the left end of the slope portion 131.

Figure 6:
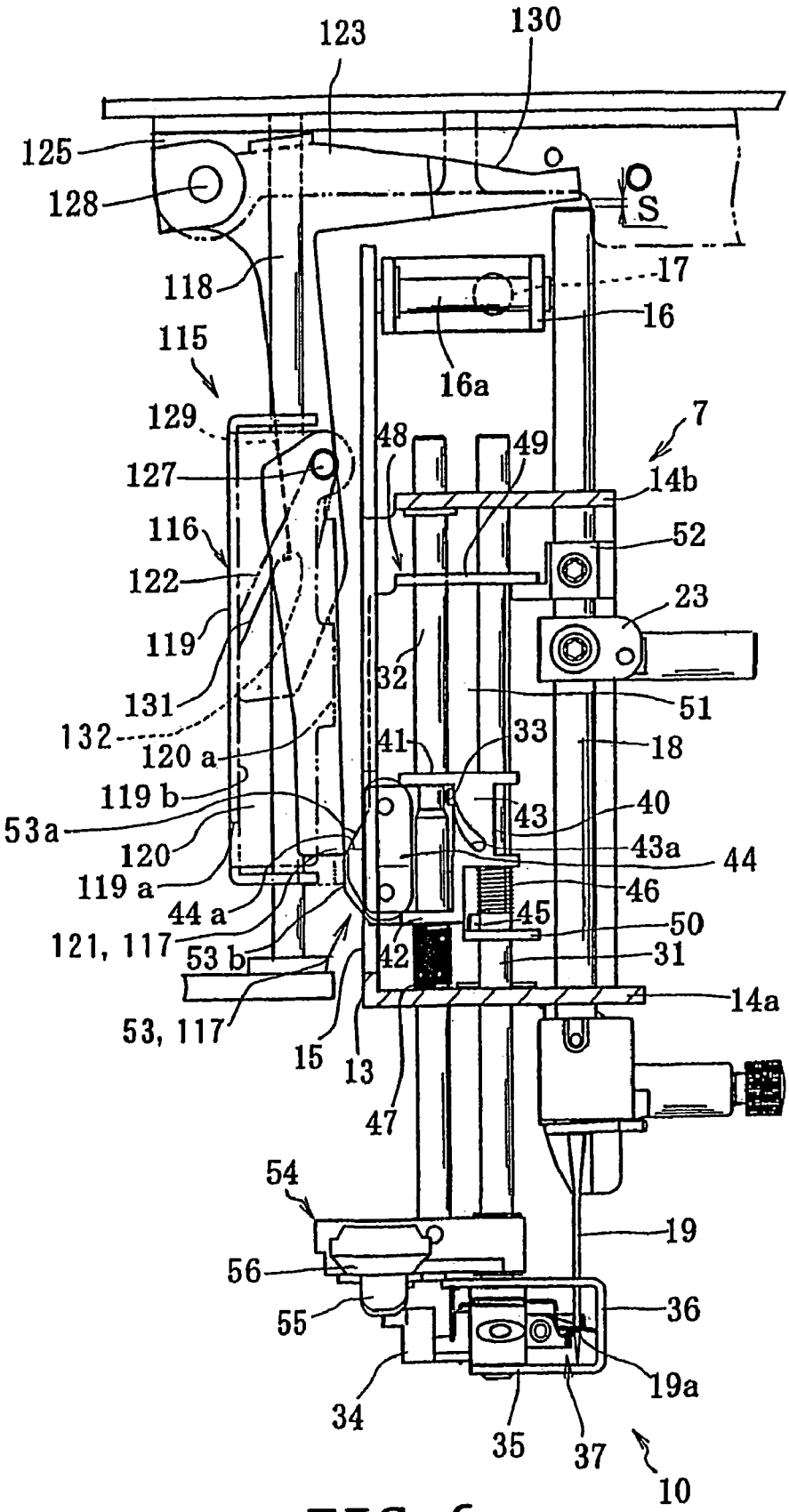
FIG. 6 is a view corresponding to FIG. 5 and shows a state immediately before the threading.

As the threading slider actuating member 119 moves downward, the stopper 123 rocks counterclockwise against the biasing force of the tension coil spring 126 so that the threading sliding actuating member 119 can move from the upper limit position to the lower limit position, as shown in FIG. 6. In case the upper end of the needle bar 18 is outside of the proper range, the stopper 123 rocks further clockwise from the position 500B (as referred to FIG. 8). Even if the threading slider actuating member 119 in this state is moved downward, the stopper engaging portion 119*a* engages with the stopper portion 132. Therefore, the threading slider actuating member 119 cannot move to inhibit the threading.

Figure 7:
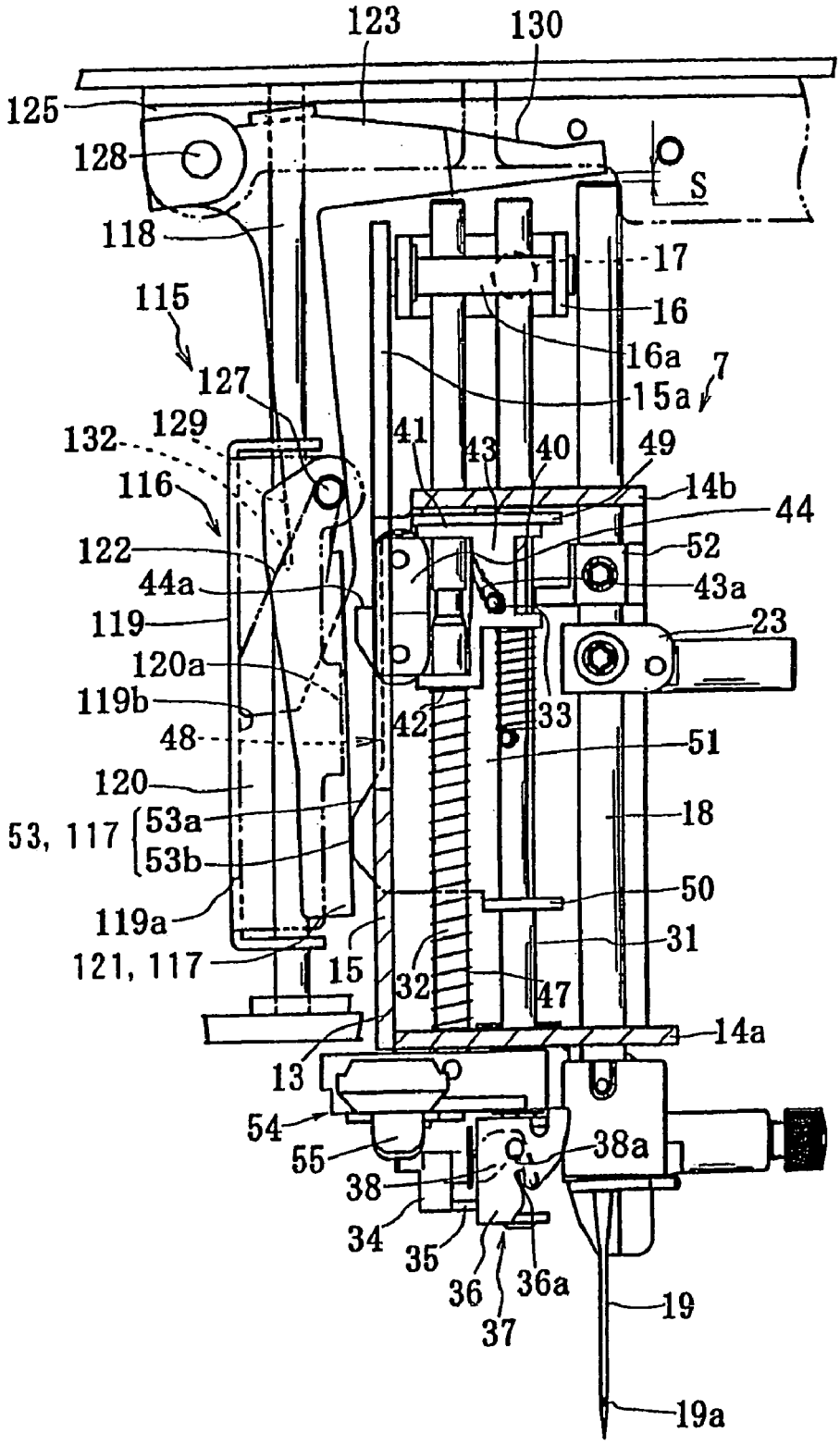
FIG. 7 is a view corresponding to FIG. 5 and shows the relations between a needle bar and a stopper.

As shown in FIG. 7, the guide wall 119*b* of the threading slider actuating member 119 slides on the slope portion 131 of the stopper 123. As a result, the height position of the horizontal portion 130 of the stopper 123 is regulated to form a small clearance S between the upper end of the needle bar 18 at the highest position and the horizontal portion 130 thereby to prevent the knocking sound between the needle bar 18 and the stopper 123.

Here will be described the thread tension regulator 9 and the interlocking mechanism 134 for the thread tension regulator 9.

The interlocking mechanism 134 is a mechanism for opening a pair of thread tension discs 133 by the needle thread cassette 2 in the course of the action to mount the needle thread cassette 2 in the cassette mount 3 and for closing the thread tension discs 133 at the time of completing the mounting operation.

In the state where the needle thread cassette 2 is mounted in the cassette mount 3, as shown in FIG. 4, FIG. 10, FIG. 16 and FIG. 37 to FIG. 45, the thread tension regulator 9 penetrates into the thread tension regulator housing portion 57*c* in the cassette case 57. The thread tension regulator 9 has a general structure including: the paired thread tension discs 133; pin members for supporting those thread tension discs 133; an actuating plate 139 located on the back side of the rear thread tension disc 133; a spring member for elastically biasing the rear thread tension disc 133 and the actuating plate 139 forward; a thread tension spring 135 for supporting the needle thread 24 elastically near the thread tension discs 133; and a thread tension dial 136 for adjusting the spring force.

As shown in FIG. 37 to FIG. 45, the interlocking mechanism 134 is provided with a cam portion 137 formed on the rear side face of the needle thread cassette 57, a cam follower member 138 having a vertical lever shape, and a turning arm 151. The cam portion 137 like a ridge slightly protruding backward is formed on the upper half of the left end side of the cassette body 60. At the upper portion of the frame 140 for supporting the thread tension regulator 9, there is formed a bracket 141, on which the longitudinal intermediate portion of the cam follower member 138 is turnably supported by a transverse horizontal pin. This cam follower member 138 is biased clockwise in FIG. 41 by a torsion spring 144.

A roller 142 is freely rotatably hinged to the upper end portion of the cam follower member 138.

At the left side portion of the rear wall of the cassette mount 3, there is formed a slit 143 (as referred to FIG. 14) for protruding the cam portion 137 of the needle thread cassette 57 backward. The roller 142 can abut against the cam portion 137 which is protruded backward from that slit 143. The right end portion of the turning arm 151 is so connected to the lower portion of a base plate 155 through a vertical pin as to turn horizontally, and the lower end portion of the cam follower member 138 abuts against the rear face of the left end portion of the turning arm 151, so that the turning arm 151 can abut at its protrusion 151*a* against the actuating plate 139.

By setting the shape of the cam portion 137 and the position of the roller 142 properly, the thread tension discs 133 are opened in the mounting course of the needle thread cassette 57 thereby to thread the paired thread tension discs 133 and the thread tension spring 135. After this, the thread tension discs 133 are closed when the needle thread cassette 57 is completely mounted. When the needle thread cassette 57 is mounted in the cassette mount 3 so that the needle thread cassette 2 reaches a predetermined distance above the thread tension regulator 9, more specifically, the roller 142 rides over the cam portion 137 so that the cam follower member 138 turns counterclockwise in FIG. 41 thereby to open the thread tension discs 133 with the turning arm 151 and the actuating plate 139.

When the needle thread cassette 57 moves down in this state, the needle thread 24 between the second and third guide portions 71 and 72 is engaged between the paired thread tension discs 133. After this, the cam portion 137 becomes lower and does not push the roller 142 backward, when the needle thread cassette 57 comes into the completely mounted state. Therefore, the turning arm 151 rotationally returns backward, and the actuating plate 139 returns backward, so that the paired thread tension discs 133 are closed. Here, the aforementioned actions of the interlocking mechanism 134 at the time of mounting the needle thread cassette 57 occur irrespective of the position (e.g., the lower turned position or the upper turned position) of the foot lifting lever 29.

Next, the mechanism for opening the paired thread tension discs 133 by the action of the foot lifting lever 29 as in the ordinary sewing machine is well known in the art so that it will be briefly described. As shown in FIG. 37 to FIG. 45, the upper end portion of the foot lifting lever 29 is turnably hinged to the machine frame, and the upper end portion of an engaging arm 152 engaging with a cam portion 29*a* of that foot lifting lever 29 is also turnably hinged to the machine frame. The engaging arm 152 is connected to the rear end portion of a triangular plate 154 by a connecting rod 153. The triangular plate 154 is arranged on the lower side of the lower plate portion of the base plate 155 on the machine frame side. The left end portion of the front end portion of the triangular plate 154 is turnably hinged to the lower plate portion of the base plate 155 through a vertical pin, and the right end portion of the front end portion of the triangular plate 154 abuts against the actuating plate 139.

When the foot lifting lever 129 takes its lower turning position, therefore, the connecting rod 153 is not pulled rightward, so that the triangular plate 154 does not turn to keep the thread tension discs 133 in their closed state. When the foot lifting lever 29 is switched to the upper turning position, the connecting rod 153 is pulled rightward, so that the triangular plate 154 turns to bring the thread tension discs 133 into the open state.

Here will be described the actions of the aforementioned sewing machine 1 and the actions of the needle thread cassette 2.

In the state where the needle thread cassette 2 is not mounted in the cassette mount 3, as shown in FIG. 14 and FIG. 23 to FIG. 27, the openable cover 61 of the needle thread cassette 2 is opened, and the thread bobbin 62 is mounted in the thread bobbin retaining portion 58. Next, the needle thread 24, as pulled out from the thread bobbin 62, is engaged with the first guide portion 69 and with the thread guide portion 80*a* of the first clamp portion 70, and is pressed by the leaf spring 81. Next, the needle thread 24 is engaged sequentially with the second and third guide portions 71 and 72 and is clamped between the guide pin 89 of the second clamp portion 73 and the thread retaining plate 90.

Next, the control button 94*a* is pressed with the finger of the operator against the biasing force of the leaf spring member 91 to bring the guide pin 89 apart from the thread retaining plate 90. After this, the needle thread 24 is pulled out by a predetermined length to the outside, and the control button 94*a* is then released. The needle thread 24 is clamped by the second clamp portion 73, and the openable cover 61 is closed. In order to make the threading procedures of the needle thread cassette 2 understandable, marks of threading orders may be adhered to the individual vicinities of the first guide portion 69, the first clamp portion 70, the second and third guide portions 71 and 72 and the second clamp portion 73 so that the threading may be done according to the mark orders.

Figure 13:
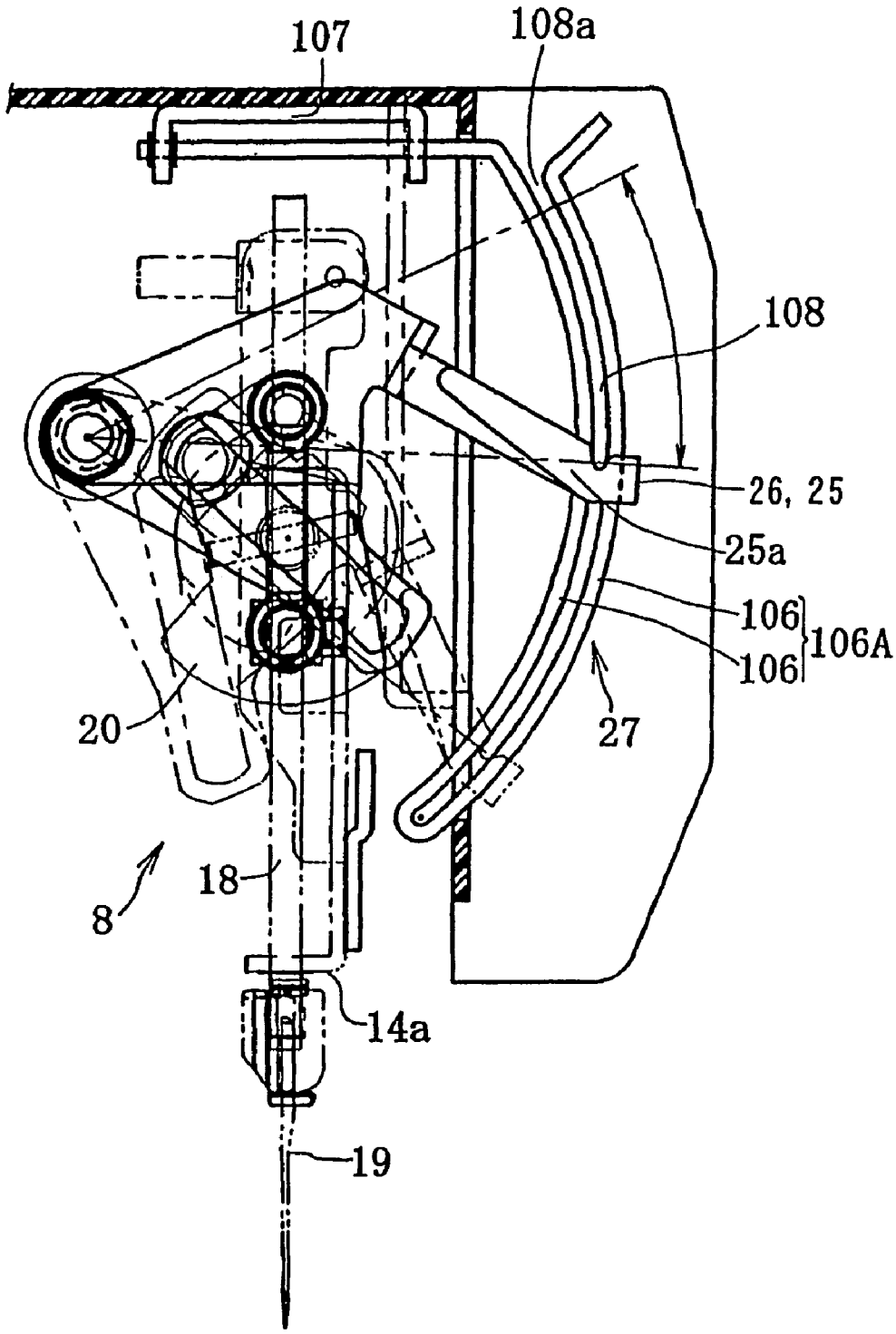
FIG. 13 is a view corresponding to FIG. 12 and shows the threading range of the thread guard.

When the sewing machine 1 is in the sewing interrupted state, on the other hand, the needle bar 18 is normally stopped at its top stop position and the thread guard 26 of the thread take-up lever 25 is stopped at the substantially intermediate position on the thread-tightening side as shown in FIG. 13. In this state, the needle thread cassette 2 is mounted from above in the cassette mount 3. The cassette mount 3 is opened both upward and downward so that the needle thread 24, as pulled out by about 20 cm from the thread exit 68 of the needle thread cassette 2, sags vertically downward of the cassette mount 3. At the time of starting the sewing operation, the thread guard 26 of the thread take-up lever 25 moves up from the substantially intermediate position on the aforementioned thread-tightening side and then moves down.

Figure 15:
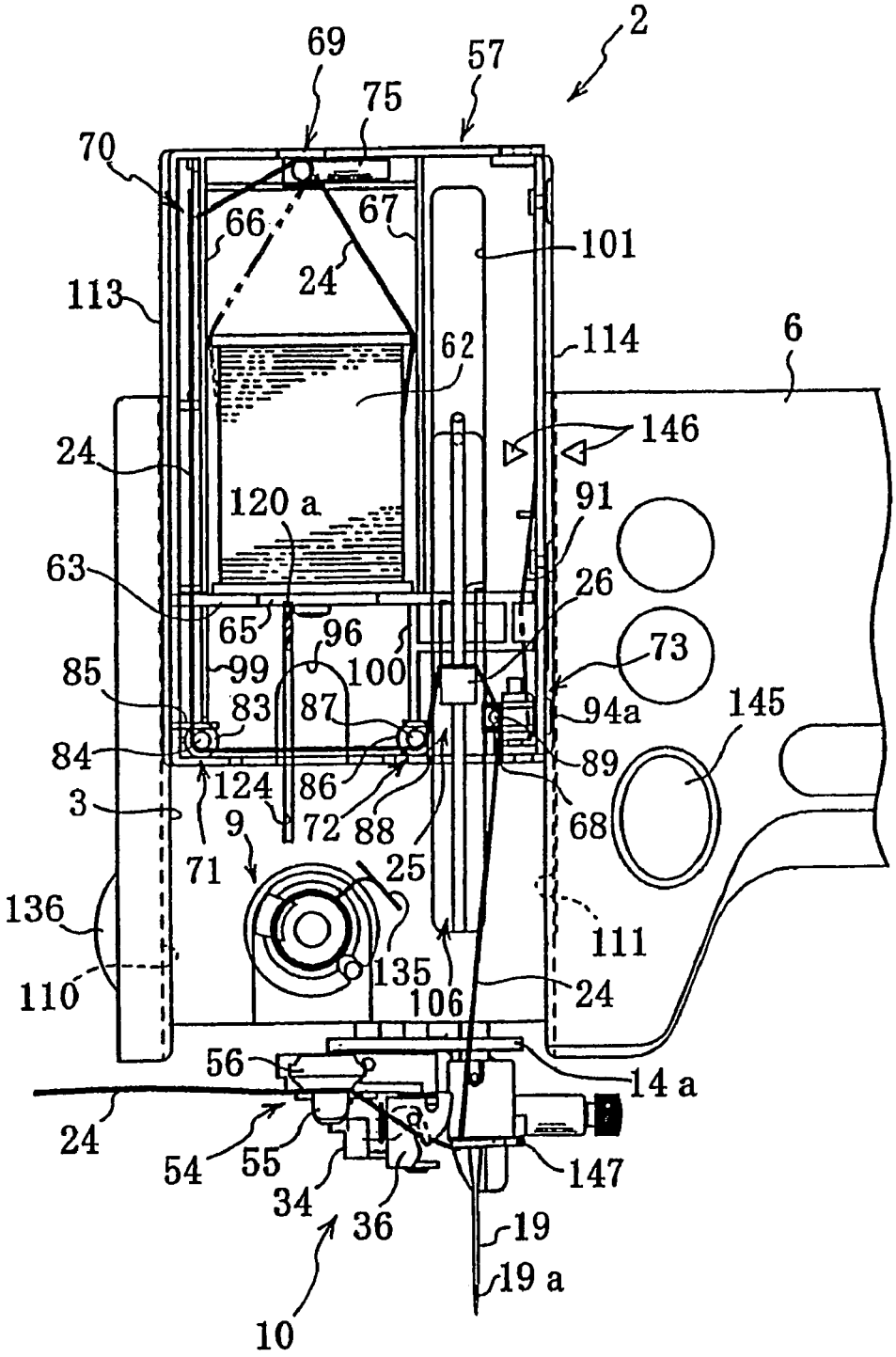
FIG. 15 is a front elevation of the needle thread cassette (in the state of being mounted) and the cassette mounting portion.
Figure 16:
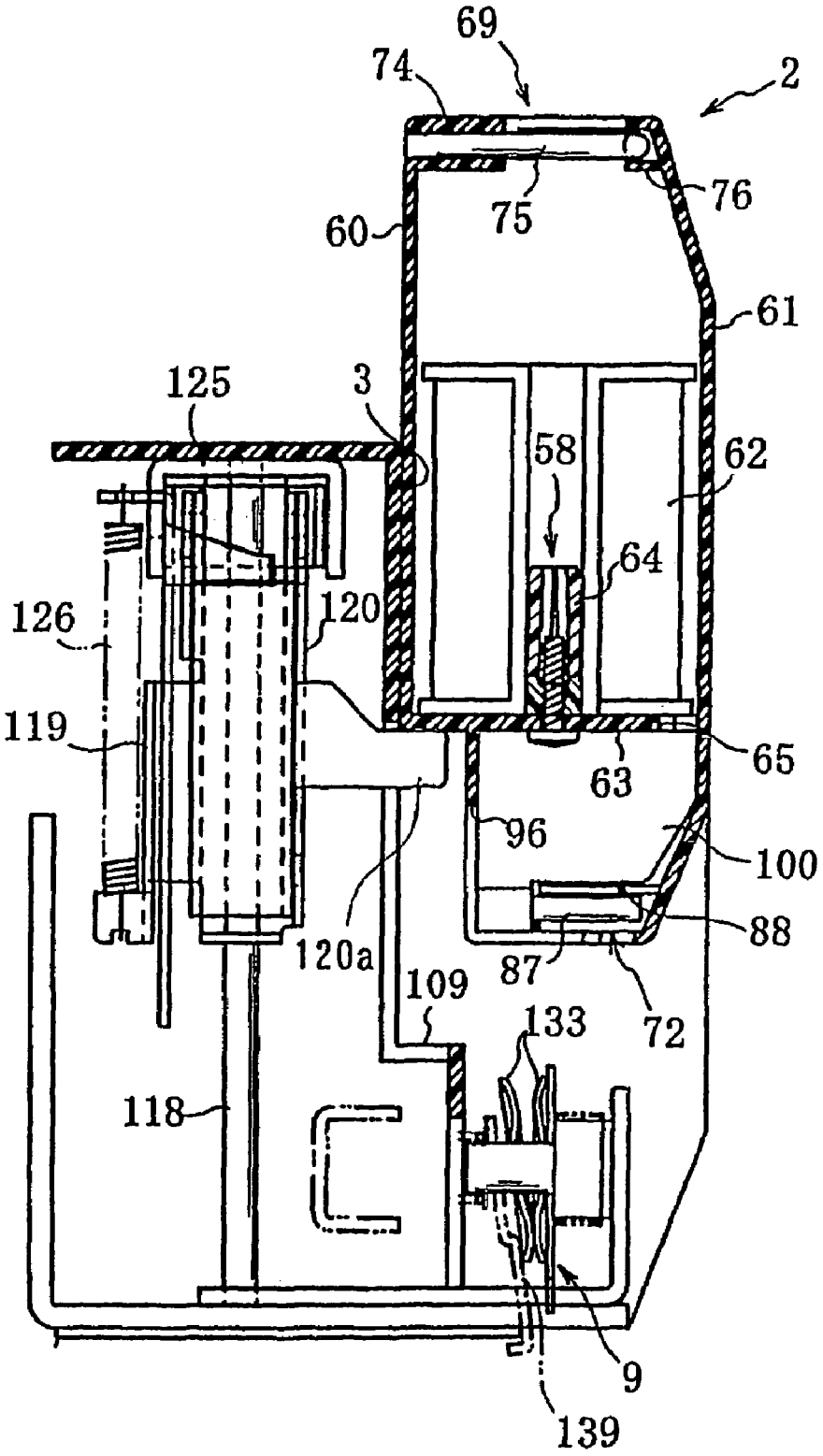
FIG. 16 is a longitudinally sectional side elevation of the needle thread cassette (in the state of being mounted) and the cassette mounting portion.

In the course of mounting the needle thread cassette 2, as shown in FIG. 15 and. FIG. 16, the needle thread cassette 2 is once stopped with its engaging portion 112 abutting against the lever portion 120*a*. At this time, the needle thread 24 between the third guide portion 72 and the second clamp portion 73 is introduced into the thread guide clearance 108 and engaged with the thread guard 26 of the thread take-up lever 25, as shown in FIG. 15. In this case, the second clamp portion 73 applies a higher passing resistance than that of the first clamp portion 70 so that the needle thread 24 is fed out by a necessary amount from the thread bobbin 62 without being pulled back into the cassette 2. Here, a pair of notch marks 146 for confirming the travel stop position are formed on the needle thread cassette 2 and the sewing machine 1.

Next, the needle thread 24 sagging downward from the thread exit 68 of the needle thread cassette 2 is engaged with the needle bar thread hook 147 and the thread guide 36*a* in the recited order and is clamped under a low pressure between the support plate 55 and the thread guide disc 56. After this, the thread end is cut with the not-shown thread trimming blade. Next, the needle thread cassette 2 is pressed downward against the biasing force of the tension coil spring 126, as shown in FIG. 17. Then, the action of the needle thread cassette 2 is transmitted through the transmission mechanism 115 to the automatic threading mechanism 10 so that the needle thread 24 is threaded into the needle eye 19*a*. The engaging portion 112 as the threading action portion of the needle thread cassette 2 moves the lever portion 120*a* at the leading end of the lever 120 downward so that the movement of the needle thread cassette 2 is transmitted to the transmission mechanism 115. In parallel with this, the needle thread cassette 57 moves downward relative to the thread take-up lever 25 so that the thread passage between the third thread guide portion 72 and the second clamp portion 73 is elongated to feed out the needle thread 24 from the thread bobbin 62.

At this time, the thread tension discs 133 of the thread tension regulator 9 are opened by the interlocking mechanism 134, as has been described hereinbefore, so that the needle thread 24 between the second and third guide portions 71 and 72 is engaged with the clearance between the thread tension discs 133 and with the thread tension spring 135. By the first clamp portion 70 and the second clamp portion 73, the needle thread 24 inbetween is subjected to a constant tension so that it is engaged with the thread take-up lever 25, the thread tension discs 133 and the thread tension spring 135 without fail. The second clamp portion 73 applies a higher passing resistance than that of the first clamp portion 70 to the needle thread 24 so that the needle thread 24 in an amount necessary for the threading is reliably fed out from the thread bobbin 62, as described above, without being fed back through the second clamp portion 73 and returned into the cassette 2. Moreover, the needle thread 24 from the first clamp portion 70 to the second clamp portion 73 does not become slack so that it is neither twisted nor interlaced.

In the state where the needle thread cassette 2 is completely mounted in the cassette mount 3 (that is, where the engaging portion 112 engages from above with the receiving portion 109), as shown in FIG. 19 and FIG. 20, the thread tension discs 133 are closed by the interlocking mechanism 134, and the threading slider actuating member 119 is retained at the lowermost position by the needle thread cassette 2. In this state, the threading pin 31 and the slider guide pin 32 are returned upward to thread the needle eye 19*a* with the needle thread 24. As shown in FIG. 20, moreover, the control button 94*a* is pushed leftward by the thread releasing cam 95, and the guide pin 89 leaves the thread retaining plate 90 to release the second clamp portion 73, so that the needle thread 24 is released to be in a sewing state.

In the state where the needle thread cassette 57 is completely mounted, moreover, the paired thread tension discs 133 may be closed, and the second clamp portion 73 may be released. Even in this case, the needle thread 24 is clamped by the first clamp portion 70 to apply the passing resistance to the needle thread 24, so that the needle thread 24 in the needle thread cassette 57 is neither twisted nor interlaced. As a result, the thread is hardly cut during the sewing operation by the interlace. With the needle thread cassette 2 being mounted in the cassette mount 3, the thread guide 106A and the thread guard 26 of the thread take-up lever 25 protrude into the needle thread cassette 57 so that the thread guard 26 of the thread take-up lever 25 can reciprocate generally vertically in the needle thread cassette 2.

Here in the thread tension regulator housing portion 57*c* of the cassette body 60, as shown in FIG. 19, an needle thread pressing member 180 (as indicated by a dotted line) including a thread guide portion notched downward may be disposed downstream of the thread tension regulator thereby to press and arrange the needle thread 24 extending downstream of the thread tension regulator 9, downward by the action of mounting the needle thread cassette 2 in the cassette mount 3. In this case, the portion of the needle thread 24 to contact with the pin member of the thread tension regulator 9 is increased to prevent the needle thread 24 from being suddenly disengaged and to increase the take-up amount of the needle thread 24 by the thread tension spring 135. When the needle thread cassette 2 is to be removed, the needle thread 24 can be easily released from the needle thread pressing member 180.

With the needle thread cassette 57 being mounted in the cassette mount 3, as has been described hereinbefore, the sewing operation can be performed while feeding the needle thread 24 to the thread bobbin 62. When the needle thread cassette 2 is demounted from the cassette mount 3 so as to change the color of the needle thread 24 or to supply the needle thread 24, the needle thread cassette 2 can be simply removed by pushing its lower end upward with the finger of the operator.

After this removal, the slack thread disengaged from the thread take-up lever 25 and the thread tension regulator 9 is left in the needle thread cassette 2. Therefore, the control button 94*a* is pressed with the finger to switch the second clamp portion 73 into the release state, and the slack thread in the needle thread cassette 2 is pulled out in that state and is wound on the outer circumference of the cassette. The end portion of the needle thread 24 is temporarily held on the thread holder 104 or the thread holder 104A. After this, the control button 94 is returned to bring the second clamp portion 73 into the closed state.

Figure 46:
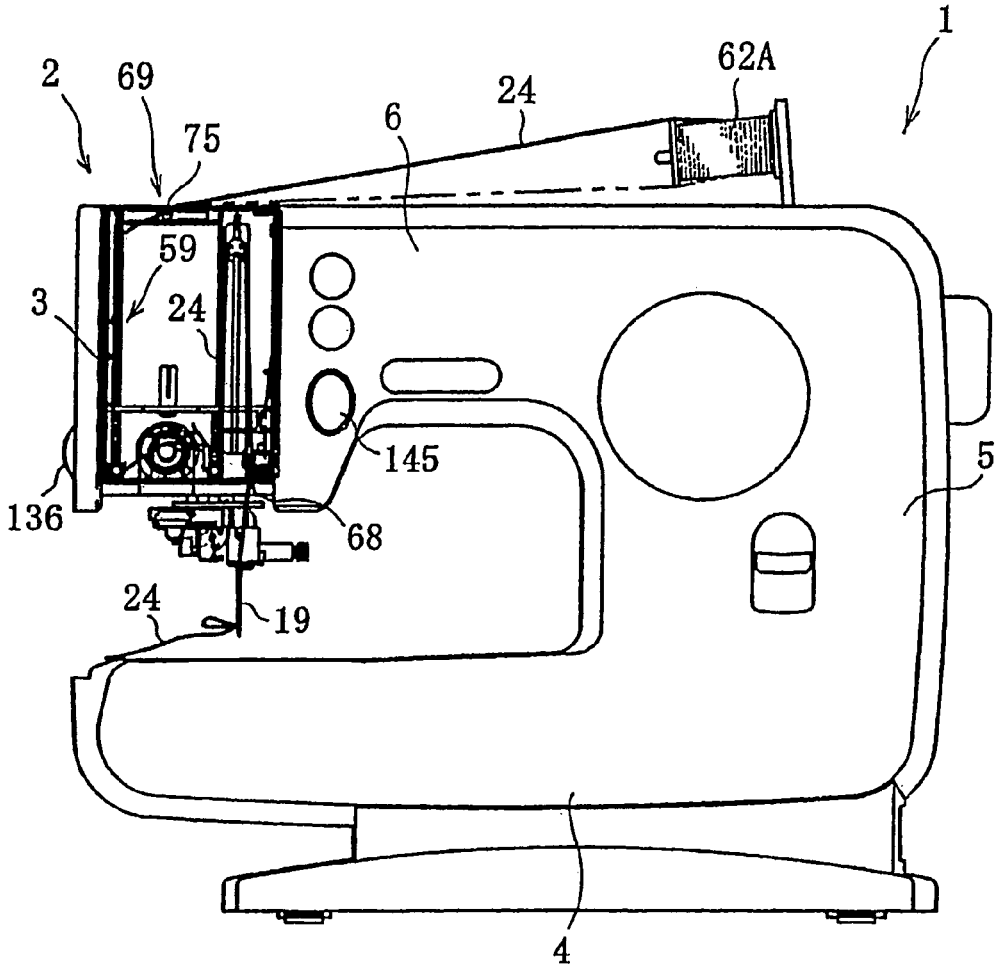
FIG. 46 is a front elevation of the case in which sewing is performed using the needle thread outside of the needle thread cassette.
Figure 47:
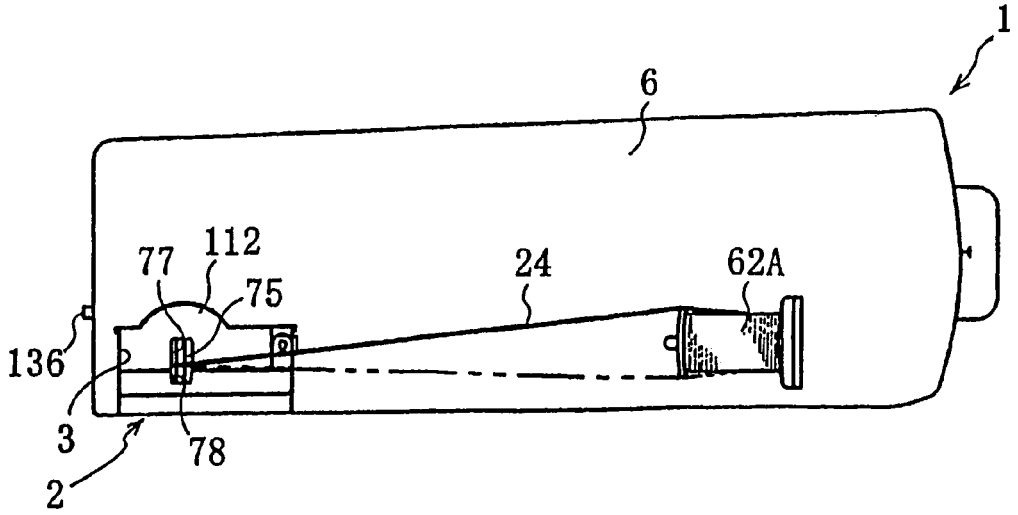
FIG. 47 is a top plan view of the case in which sewing is performed using the needle thread outside of the needle thread cassette.
Figure 48:
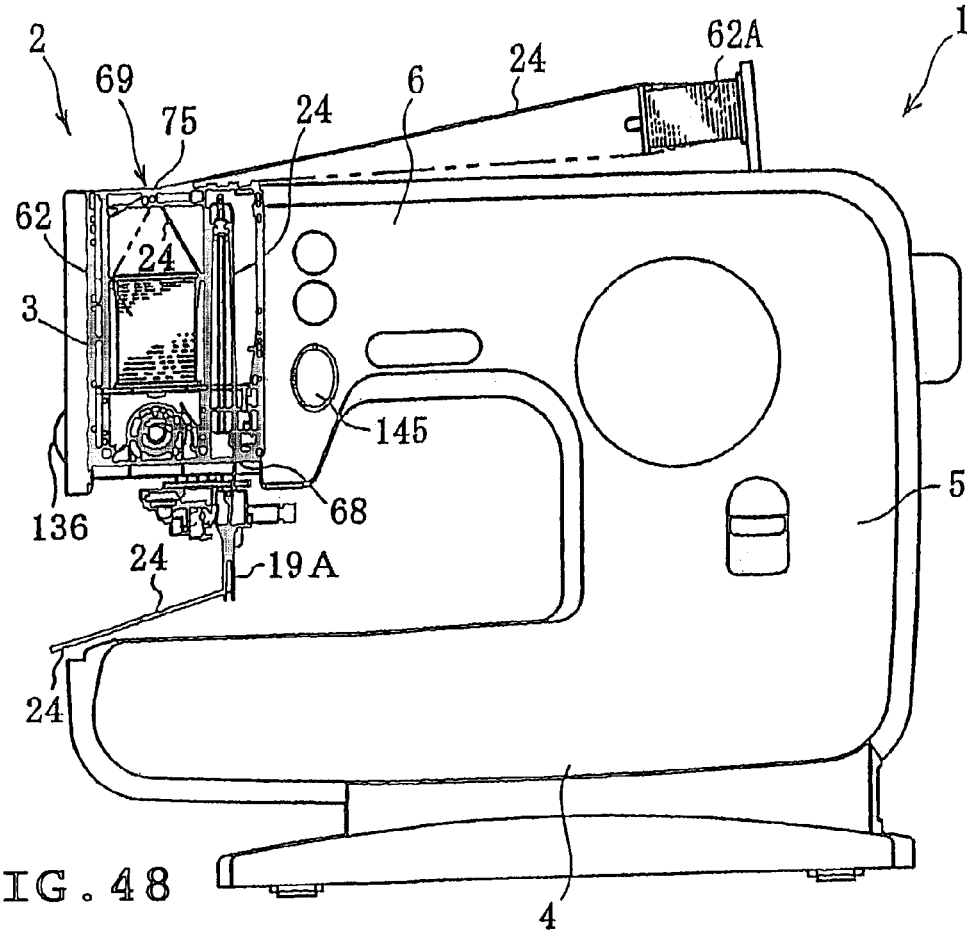
FIG. 48 is a front elevation of a sewing machine in case two needles are applied.

As shown in FIG. 46 and FIG. 47, the aforementioned openings 77 and 78 also act as the introducing openings 77 and 78 for introducing the needle thread extending from the thread bobbin 62A outside of the needle thread cassette 2, into the first guide portion 69. In the case of sewing using the needle thread 24 outside of the needle thread cassette 2 with the thread bobbin 62 in the needle thread cassette 2 being removed, the needle thread 24 extending from the thread bobbin 62A can be guided from the introducing openings 77 and 78 into the first guide portion 69 and further through the thread passage 59 into the thread exit 68. In case two needles 19A are applied as the needle, as shown in FIG. 48, the needle thread 24 of the thread bobbin 62 inside the needle thread cassette 2 and the needle thread 24 of the thread bobbin 62A outside are introduced along the thread passage 59 into the thread exit 68 so that the two needle threads 24 can be fed to the two needles 19A.

The sewing machine 1 and the needle thread cassette 2 according to the embodiment have the following effects.

1) The thread bobbin 62 is housed in the needle thread cassette 2, and the thread bobbin 62 can be exchanged by exchanging the needle thread cassette 2 so that the needle thread 24 can be easily exchanged. Especially in association with the mounting action of the needle thread cassette 2, the thread guard 26 of the thread take-up lever 25, the thread tension discs 133 of the thread tension regulator 9 and the thread tension spring 135 are automatically threaded so that the threading operation is remarkably simplified and can be efficiently performed. In association with the action of mounting the needle thread cassette 2, the automatic threading mechanism 10 is actuated to thread the needle eye 29*a* automatically so that the threading itself can be remarkably simplified to be able to exchange the needle thread 24 quickly and efficiently.

Especially in the state where the sewing operation is interrupted to stop the needle bar 18 at the needle top position and the thread guard 26 of the thread take-up lever 25 at the position of the thread tightening side, without changing the position of the thread take-up lever 25, the needle thread cassette 2 can be mounted, and the thread guard 26 of the thread take-up lever 25 and the thread tension regulator 9 can be threaded to make the mounting of the needle thread cassette 2 and the threading operation remarkably simple and efficient. Moreover, the needle thread cassette 2 can be mounted in the cassette mount 3 by moving it linearly from above and can be removed by moving the mounted needle thread cassette 2 linearly upward. Therefore, the mounting/demounting operations of the needle thread cassette 2 are so simple that the needle thread cassette 2 can be quickly exchanged.

Moreover, the cassette case 57 of the needle thread cassette 2 is transparent so that the thread color of the internal thread bobbin 62 can be easily discriminated. It is, therefore, convenient to exchange the needle thread 24 or the needle thread cassette 2. The recess 65 is formed in the support wall 63 for supporting the thread bobbin 62 in the needle thread cassette 2 so that the thread bobbin 62 can be simply removed from the thread bobbin retaining portion 58 by catching the recess 65 and pushing the lower end of the thread bobbin 62 with the finger of the operator in the recess 65.

2) The thread bobbin 62 is retained in the needle thread cassette 2 with its axis being vertical, and the needle thread 24 is fed out upward from the thread bobbin 62 and is guided through the thread passage 59 into the thread exit 68, so that the needle thread cassette 2 can be reduced in the transverse width. Alternatively, the axis of the thread bobbin 62 and the feed-out direction of the needle thread 24 from the thread bobbin 62 are generally parallel to the reciprocating direction of the thread guard 26 of the thread take-up lever 25 thereby to mount the needle thread cassette 2 in the cassette mount 3. Therefore, it is possible to reduce the transverse width of the needle thread cassette 2 and the transverse width of the cassette mount 3.

Thus, the needle thread cassette 2 is small-sized elongated box shape having a small transverse width so that the cassette mount 3 can be arranged in the reciprocal travel region and its left side portion of the thread guard 26 of the thread take-up lever 25, that is, in the arm head. As a result, the cassette mount 3 can be formed in a region overlapping the reciprocal travel region of the thread guard 26 of the thread take-up lever 25 so that it is advantageous in space. Moreover, the cassette mount 3 can be arranged as backward as possible without any interference with the internal mechanism of the arm 6. As a result, the needle thread cassette 2 does not protrude, when mounted, from the front face of the arm 6, and the appearance of the arm 6 is not deteriorated while retaining the degree of freedom for the design of the front face of the arm 6.

3) The first clamp portion 70 for applying the passing resistance always to the needle thread 24 is disposed upstream of the thread passage 59 in the needle thread cassette 2, and the needle thread 24 between the first clamp portion 70 and the thread tension regulator 9 is kept tense with the needle thread cassette 24 being mounted. Therefore, it is possible to prevent the thread from being twisted or interlaced and to prevent the thread from being broken or frayed due to the interlace during the sewing operation.

Moreover, the second clamp portion 73 is disposed near the thread exit 68 to apply the passing resistance to the needle thread 24 before the needle thread cassette 2 is mounted or completely mounted. The second clamp portion 73 applies a higher passing resistance than that of the first clamp portion 70 so that the needle thread 24 is not accidentally fed out while the needle thread cassette 2 being handled. When the thread guard 26 of the thread take-up lever 25 and the thread tension regulator 9 are threaded at the time of mounting the needle thread cassette 2, moreover, the needle thread can be fed out without fail from the thread bobbin 62.

With the needle thread cassette 2 being not mounted, moreover, the control button 94*a* is operated with the finger of the operator so that the second clamp portion 73 can be released to feed out the needle thread 24 freely.

After the needle thread cassette 2 was completely mounted, the control button 94*a* is pressed by the needle thread releasing cam 95 to switch the second clamp portion 73 into the released state. During the sewing operation, therefore, the passing resistance of the second clamp portion 73 does not act on the needle thread 24 to smoothen the feed-out of the needle thread 24.

When the needle thread cassette 2 is demounted from the cassette mount 3, the needle thread 24 extending to the outside of the cassette case 57 can be wound on the outer face of the cassette case 57 and can be remarkably conveniently held on the thread holder 104 or 104A. Therefore, it is very convenient.

4) On the top of the needle thread cassette 2, there are disposed the first guide portion 69, the longitudinally long openings 77 and 78 and the thread guide portion of the guide pin 75 confronting them in parallel. Therefore, the needle thread 24 can be freely moved along the guide pin 75 and can be smoothly fed out from the thread bobbin 62 without any resistance in a manner to draw an arc. In addition, the needle thread from the thread bobbin arranged outside of the needle thread cassette 2 can be introduced from the openings 77 and 78 into the needle thread cassette 2 and can be guided for the sewing operation from the inside thread passage 59 to the thread exit 68. When the needle 19 is replaced by two needles for the sewing operation with two needle threads, therefore, the needle threads can be fed for the sewing operations from the thread bobbin 62 in the needle thread cassette 2 and from the thread bobbin retained in the thread bobbin retaining portion at the top of the arm 6 outside of the needle thread cassette 2.

5) There is provided the interlocking mechanism 134 for releasing the thread tension regulator 9 in association with the mounting action of the needle thread cassette 2 and for closing the thread tension discs 133 after the needle thread cassette 2 was mounted. Therefore, the thread tension regulator 9 can be threaded in association with the action of mounting the needle thread cassette 2, as described hereinbefore. Here, the thread tension regulator 9 is arranged on the lower end side of the cassette mount 3. Therefore, it is especially advantageous to thread the thread tension regulator 9 in association with the mounting action to mount the needle thread cassette 2 from above in the cassette mount 3.

6) The thread take-up lever mechanism 8 has such an especial structure as to thread the thread guard 26 in association with the action of mounting the needle thread cassette 2. Specifically, the thread guide 106A is provided for forming the curved thread guide clearance 108 extending throughout the length of the moving locus of the thread guard 26 of the thread take-up lever 25, so that the needle thread 24 can be introduced from the inlet port 108*a* at the upper end of the thread guide clearance 108 and can be engaged with the thread guard 26. Therefore, the thread inlet 108*a* is so positioned as not to retract from the moving locus of the thread guard 26. With the thread guard 26 of the thread take-up lever 25 being stopped in the position (corresponding to the needle top stop position of the needle bar 18) on the aforementioned thread tightening side, therefore, the thread guard 26 can be threaded in association with the action to mount the needle thread cassette 2 in the cassette mount 3.

Moreover, the thread guide clearance 108 extends throughout the length of the moving locus of the thread guard 26, and the paired thread guide members 106 composing the thread guide 106A are made so slidable relative to the U-shaped guide portion 25*a* of the thread take-up lever 25. Even if the thread take-up lever 25 is vertically reciprocated at the time of sewing, therefore, the needle thread 24 is so guided by the thread guide members 106 that it does not come out of the thread guard 26.

Moreover, the thread guide member 106 on the back side is turnably hinged at its upper end portion so that the U-shaped guide portion 25*a* of the thread take-up lever 25 can be guided by the paired thread guide members 106. Therefore, the paired thread guide members 106 can be made of such a material of a wire member at a low cost as can be easily worked, and little sliding resistance acts on between the U-shaped guide portion 25*a* and the paired thread guide members 106 thereby to cause little sliding sound.

Figure 8:
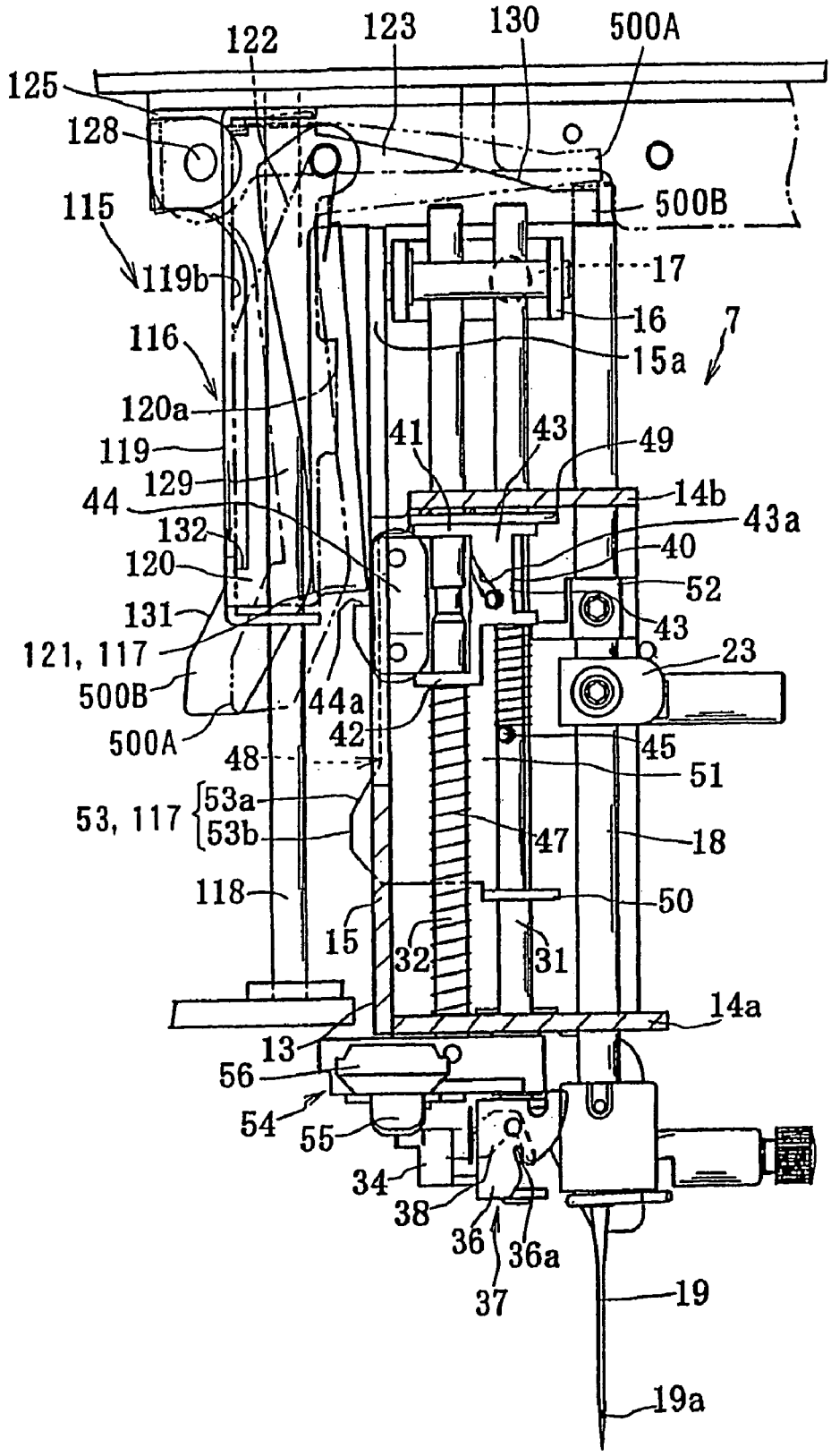
FIG. 8 is a view corresponding to FIG. 5 and explains a proper height range of the needle bar.

7) In the aforementioned automatic threading mechanism 10, the automatic passing of a thread through the needle eye 19*a* in association with the operation to mount the needle thread cassette 2 can be effected only in case the needle bar 18 is within a predetermined height range at the needle top position, that is, only in case the stopper 123 is within the proper range from 500A to 500B of FIG. 8. This makes no fear of causing a passing error of the thread into the needle eye 19*a*, as might otherwise be caused by mounting the needle thread cassette 2 with the needle bar 18 being at an improper position, so that the operations are excellent in reliability and controllability. Considering that the needle bar 18 may be stopped at an erroneous top position, moreover, the threading slider 40 and the threading positioning member 52 disposed in the needle bar 18 are engaged to adjust the height position of the automatic threading mechanism 10 to the needle bar 18. Therefore, the thread can be reliably passed through needle eye 19*a*.

Here will be described a modified mode, in which the foregoing embodiment is partially modified.

Figure 49:
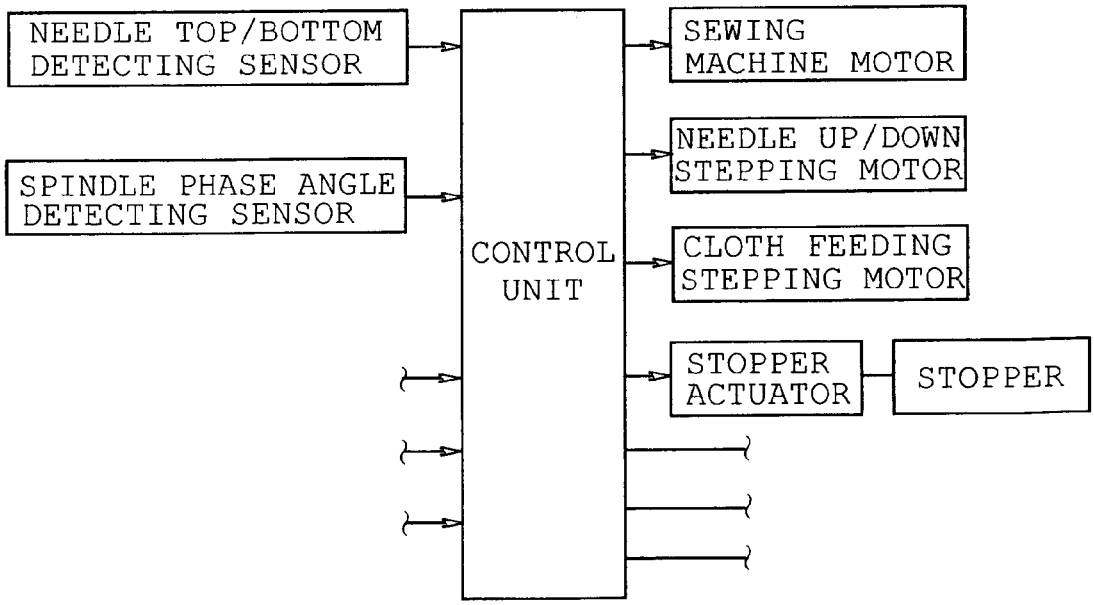
FIG. 49 is a schematic block diagram of a control system of the sewing machine.

FIG. 49 shows the control system of the aforementioned sewing machine 1 schematically. To a control unit, there are inputted signals from a needle top/bottom detecting sensor, a spindle phase angle detecting sensor, and other not-shown sensors and switches. The control unit includes a computer for controlling on the basis of various control programs for controlling the sewing machine, and a plurality of drive circuits for a plurality of devices to be driver. This control unit controls the drives of a sewing machine motor, a needle up/down stepping motor, a cloth feeding stepping motor and so on. In order to allow the mounting of the needle thread cassette 2 on the cassette mount 3 only in case the aforementioned needle bar 18 is at the top position but to inhibit the mounting in case the needle bar 18 is at a position other than the top position, a stopper capable of going into and out of the cassette mount 3 is disposed near the upper end of the cassette mount 3, and an electric actuator such as a solenoid actuator is provided for driving the stopper to go. On the basis of the signal detected by the needle top/bottom detecting sensor, the electric actuator is driven and controlled by the control unit. Only in case the needle bar 18 is at its top position, the mounting of the needle thread cassette 2 is allowed by retaining the stopper at a retracted position. In case the needle bar 18 is at a position other than the top position, the stopper is switched to an advanced position to inhibit the mounting of the needle thread cassette 2.

Next, another embodiment of the invention will be described with reference to the accompanying drawings.

However, the same members as those of the foregoing embodiment will be suitably omitted in description by designating them by the common reference numerals.

Figure 50:
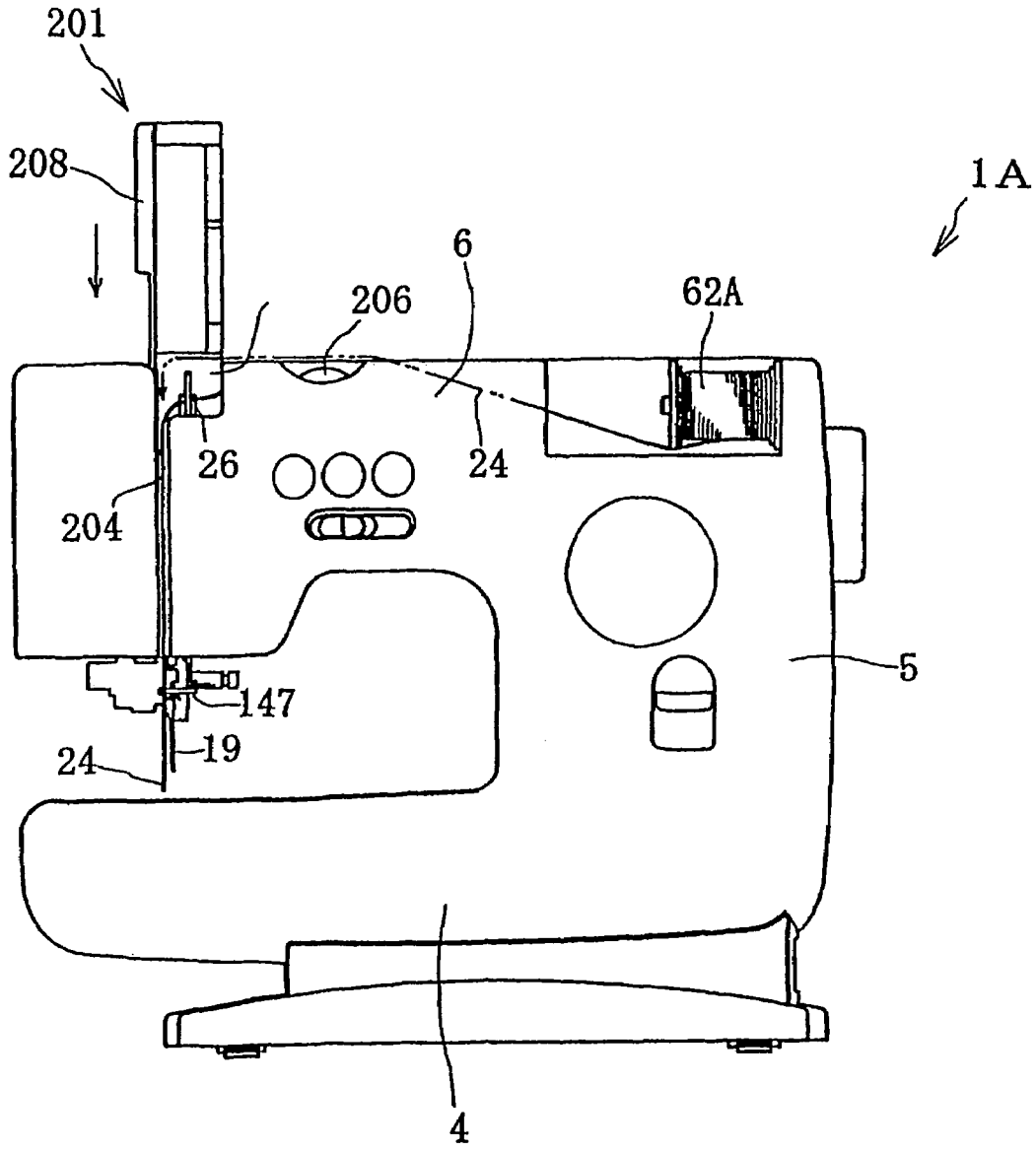
FIG. 50 is a front elevation of an electronic control type sewing machine and a threading controller of another embodiment.
Figure 51:
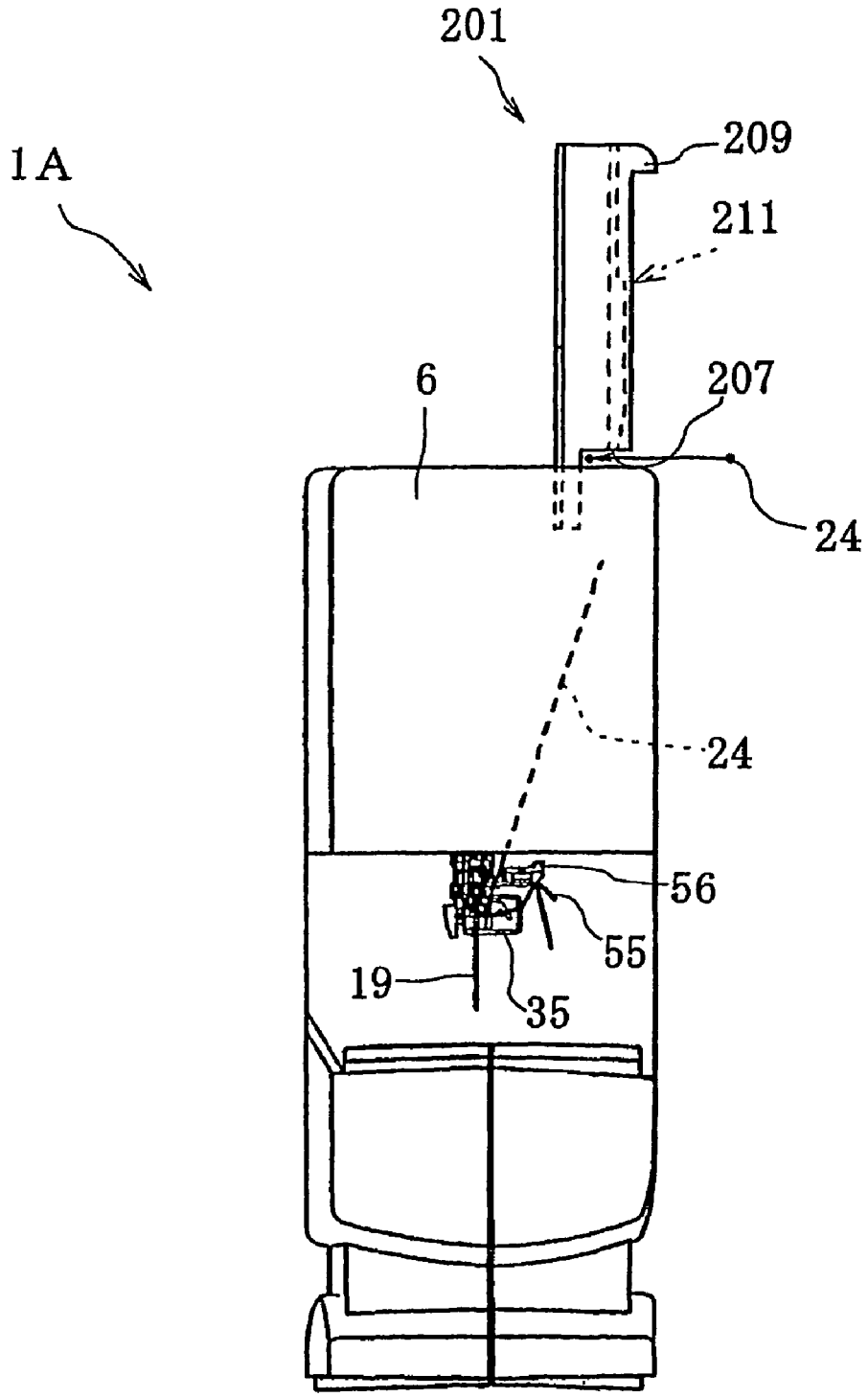
FIG. 51 is a side elevation of the sewing machine and the threading controller.
Figure 52:
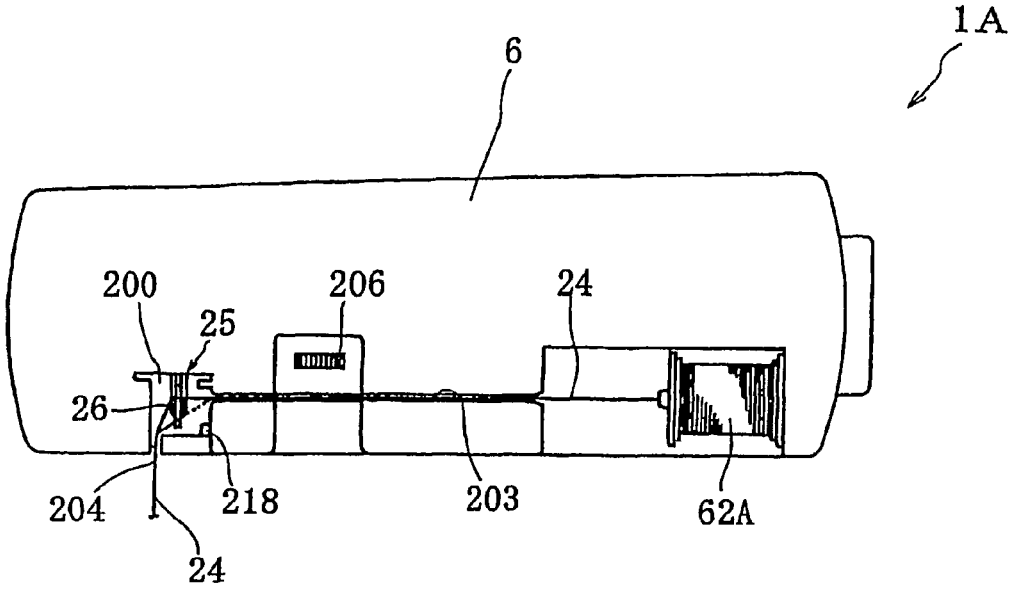
FIG. 52 is a top plan view of the sewing machine.
Figure 53:
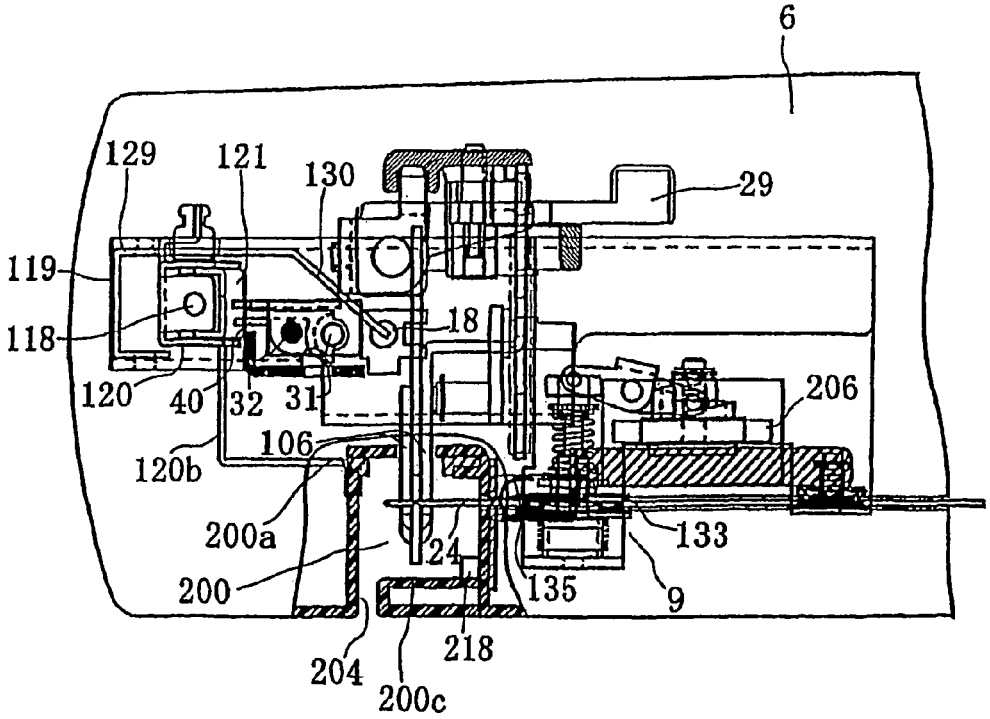
FIG. 53 is a partially cut-away transverse section showing an essential portion of the internal structure near a controller mount.

In an electronic control type sewing machine 1A according to another embodiment, as shown in FIG. 50 to FIG. 52, a controller mount 200 is formed in the thread take-up lever travel region, in which the thread guard 26 of the thread take-up lever 25 reciprocally travels up and down, and in the front face near the region. There are provided a thread engaging controller 201 as the movable controller to be removably mounted in that controller mount 200, a thread tension regulator 9, a resistance applicator 205, and an interlocking mechanism 202 (as referred to FIG. 58) for opening/closing the thread tension discs 133 of the thread tension regulator 9 and the resistance applicator 205 in association with the mounting action of the thread engaging controller 201.

The thread passage will be described at first. As shown in FIG. 50 to FIG. 52, the needle thread 24 extending from a thread bobbin 62A retained horizontally at the top of the root end side of the arm 6 is guided sequentially through a transverse thread guide groove 203 formed in the upper face side of the arm 6, the controller mount 200 and a vertical thread guide groove 204 formed in the front face on the leading end of the arm 6 and is engaged with the needle bar thread hook 147, the thread guide 36*a* and the thread guide disc 56. The resistance applicator 205 and the thread tension regulator 9 are arranged sequentially from the upstream of the thread guide groove 203. The thread guard 26 of the thread take-up lever 25 is so arranged at the central portion of the controller mount 200 as to reciprocate up and down. Here is also provided a thread tension dial 206 for adjusting the spring force of the thread tension regulator 9.

Here will be described the thread engaging controller 201.

As shown in FIG. 50, FIG. 51, FIG. 54, FIG. 55 and FIG. 57 to FIG. 59, the thread engaging controller 201 is formed into a general box shape elongated in the vertical direction and can travel at least within a predetermined range with respect to the controller mount 200. The thread engaging controller 201 is provided with a front wall 201*c* leading from the upper end to above the lower end, a left side wall 201*a* and a right side wall 201*b*. At the rear end of the left side wall 201*a*, there is formed a guided portion 208, which is folded leftward. This guided portion 208 is vertically movably guided by a slit 200*a* of the controller mount 200. At the rear end of a right side wall 201*b*, there is formed a guided portion 208*b*, which is folded rightward. This guided portion 208*b* is vertically movably guided by the guide groove 200*b* of the controller mount 200. The front wall 201*c* of the thread engaging controller 201 is vertically movably guided by a guide wall 200*c* on the front side of the controller mount 200.

The lower end faces of the left side wall 201*a* and the right side wall 201*b* are formed horizontal, and the lower end portion of the right side wall 201*b* provides a needle thread control portion for controlling the needle thread 24 extending from the thread tension regulator 9 to the thread take-up lever 25 to engage with the thread guard 26 when the thread engaging controller 201 is to be inserted and mounted in the controller mount 200.

A small forward protrusion 209 is formed at the upper end portion of the thread engaging controller 201 which is disengagiable from the controller mount 200 by catching the protrusion by a finger so as to move the thread engaging controller 201 upward.

At the lower end portion of the guided portion 208, as shown in FIG. 50, FIG. 53 to FIG. 55 and FIG. 62, there is formed an actuation portion 208*a*, which acts as a threading actuation portion to actuate the automatic threading mechanism 10 when the needle thread 24 is passed into the needle eye 19*a*. In the threading slider actuating mechanism 116, there is formed in the lever 120 a lever portion 120*b*, which protrudes forward in an L-shape from the upper step portion of the right end. The automatic threading mechanism 10 like that of the foregoing embodiment is actuated by pushing the lever portion 120*b* from above in the course of the mounting operation of the thread engaging controller 201.

Figure 54:
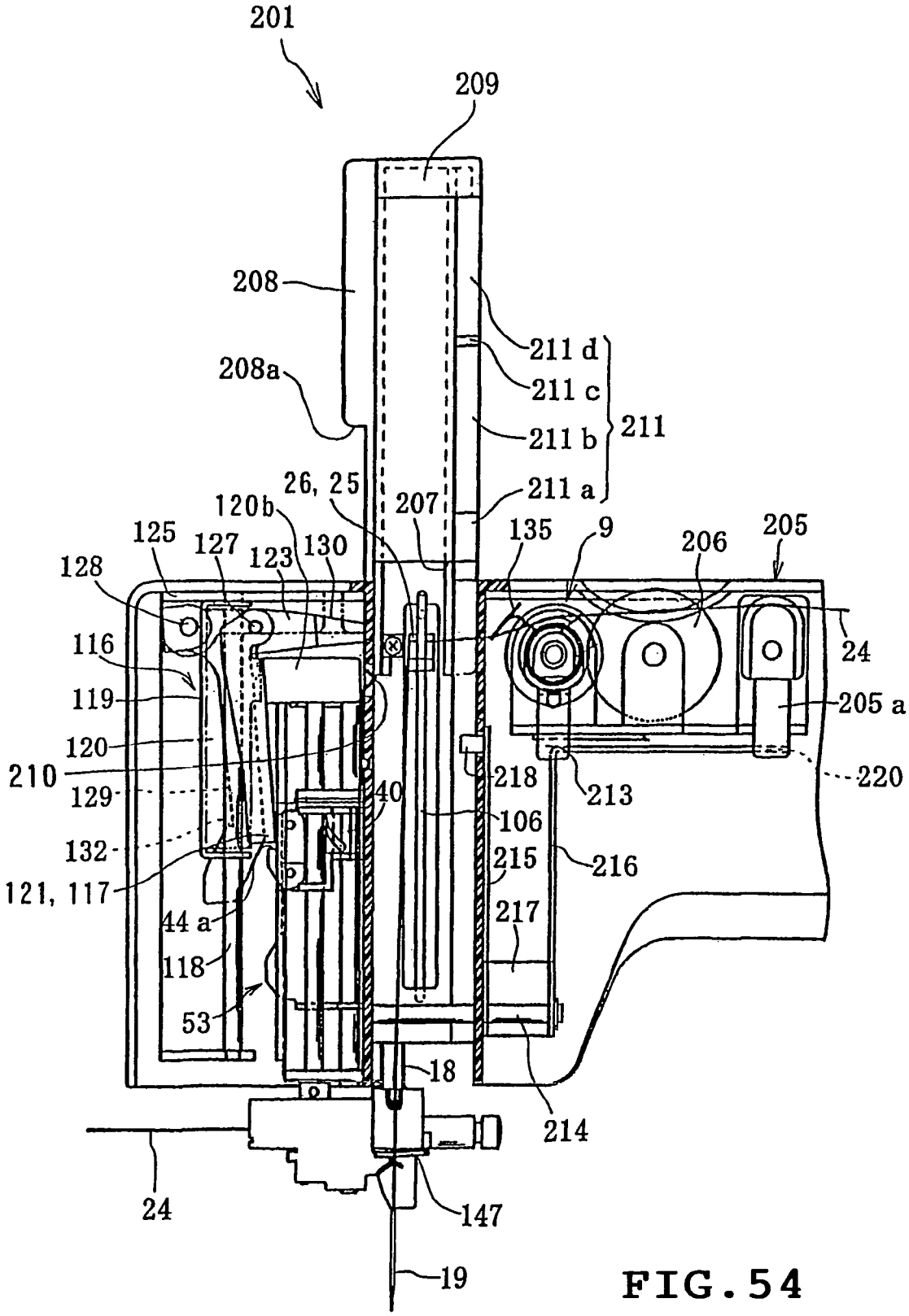
FIG. 54 is a longitudinal section of the vicinity of the controller mount and the threading controller.
Figure 55:
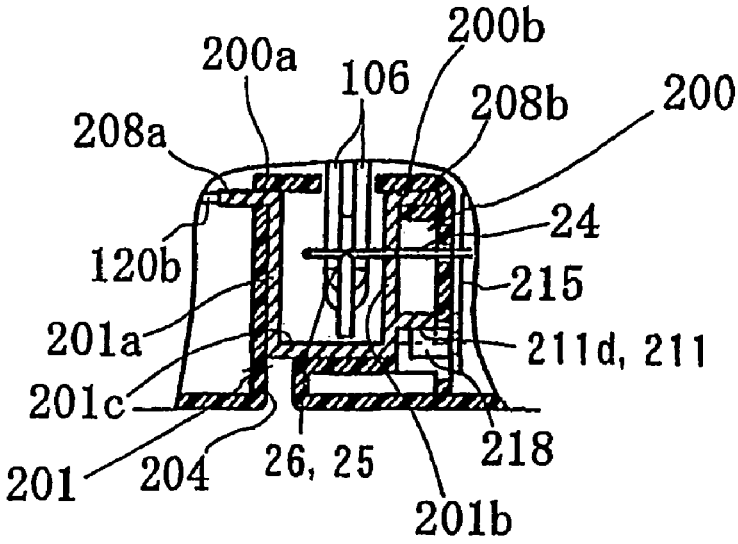
FIG. 55 is a transverse section of an essential portion and shows the state in which the threading controller is completely mounted.
Figure 56:
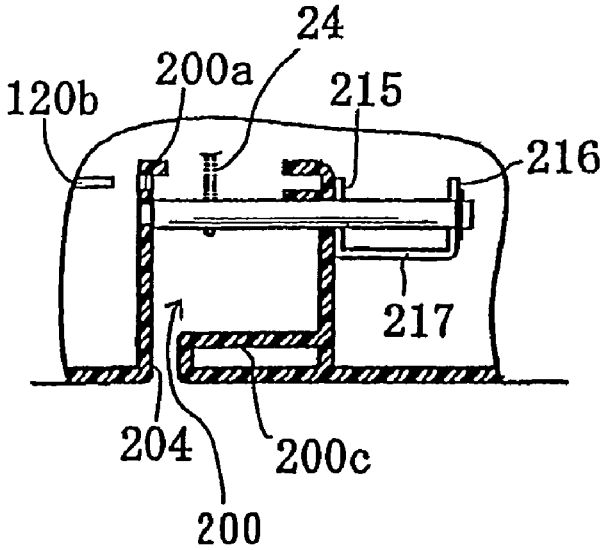
FIG. 56 is a transverse section of an essential portion near the lower end portion of the controller mount.
Figure 57:
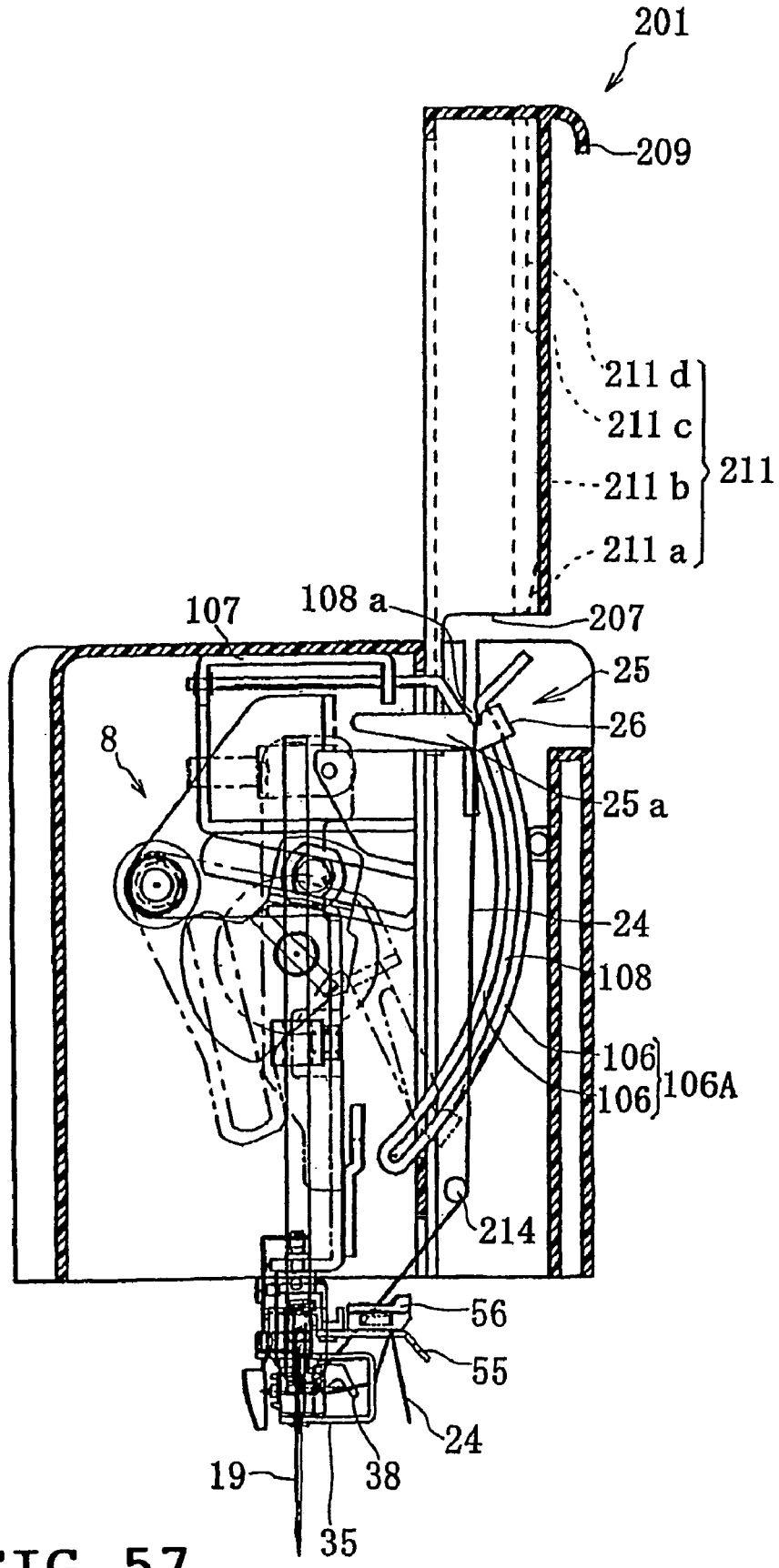
FIG. 57 is a transverse section showing the relations among a thread take-up lever mechanism, the thread guard and the threading controller.

On the wall face of the controller mount 200, there is fastened with screws a leaf spring 210 for retaining the thread engaging controller 201 removed from the controller mount 200 at the upper most position shown in FIG. 54. Here, the thread engaging controller 201 can also be made removable from the controller mount 200. In this modification, the thread can be easily engaged with the thread guard 26 of the thread take-up lever 25. The controller mount 200 is so formed in the vicinity of the front face of the arm 6 and in the vicinity of the thread take-up lever travel region as to mount the thread engaging controller 201 by the vertical and linear travel so that it can insert and mount the thread engaging controller 201 smoothly.

Here will be described the interlocking mechanism 202 for associating the mounting actions of the thread engaging controller 201 with the thread tension regulator 9. As shown in FIG. 53 to FIG. 62, the interlocking mechanism 202 includes a cam portion 211, a cam follower member 212 and an actuation plate 213. In the course of mounting action to mount the thread engaging controller 201 in the controller mount 200, the thread tension discs 133 of the thread tension regulator 9 and the resistance applicator 205 are opened by the thread engaging controller 201. At the completion of the mounting action, the thread tension discs 133 and the resistance applicator 205 are closed. As shown in FIG. 54, more specifically, the cam portion 211 is vertically formed in the right lower half of the thread engaging controller 201 and is provided with a slope portion 211*a*, a flat portion 211*b*, a slope portion 211*c* and a flat portion 211*d* sequentially from below.

On a support pin 214 hinged to the sewing machine frame, there is turnably supported the lower end portion of the cam follower member 212. This cam follower member 212 includes two lever portions 215 and 216, a connection portion 217 connecting those lever portions 215 and 216 integrally at their lower end portions, and a cam follower pin 218. The two lever portions 215 and 216 are so arranged in parallel at a suitable spacing as to take a phase angle of about 15 degrees, as viewed in a side elevation. The lever portion 215 is provided at its end, i.e., at its upper end portion with the cam follower pin 218, which protrudes leftward to abut against the cam portion 211.

Figure 58:
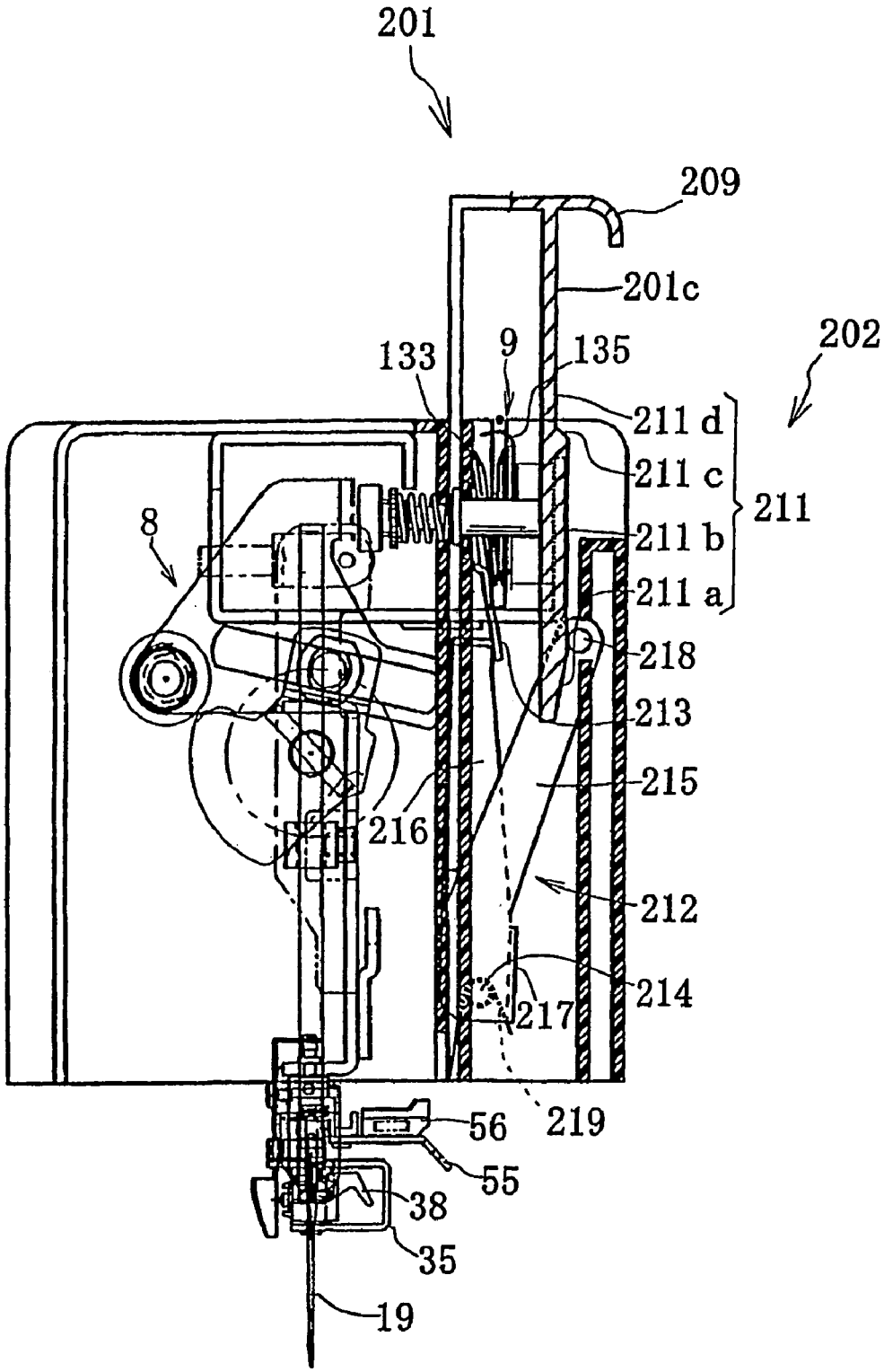
FIG. 58 is a longitudinal section showing the relations between the interlocking mechanism and the thread tension regulator.
Figure 59:
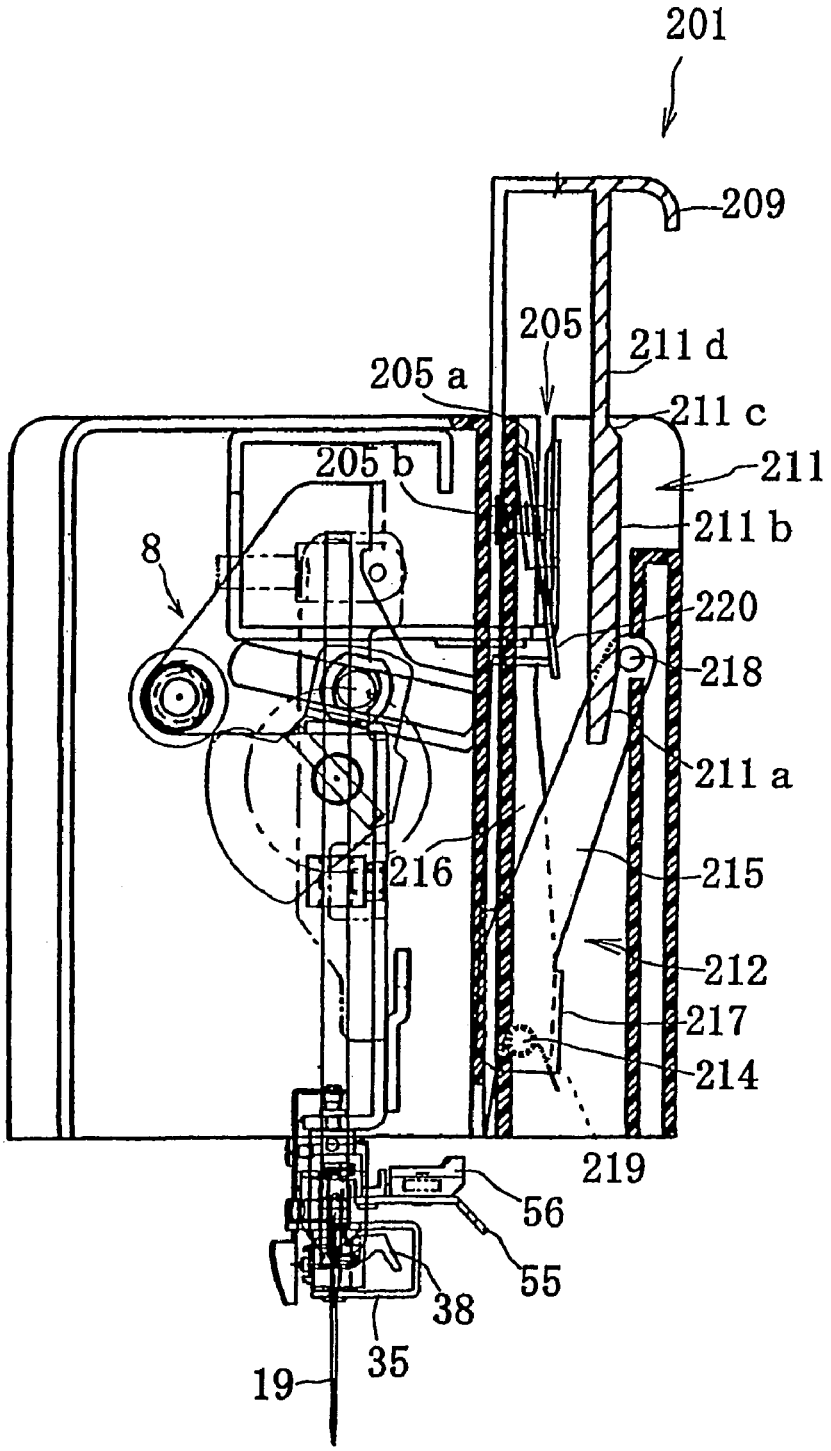
FIG. 59 is a longitudinal section showing relations between the interlocking mechanism and a resistance applicator.
Figure 60:
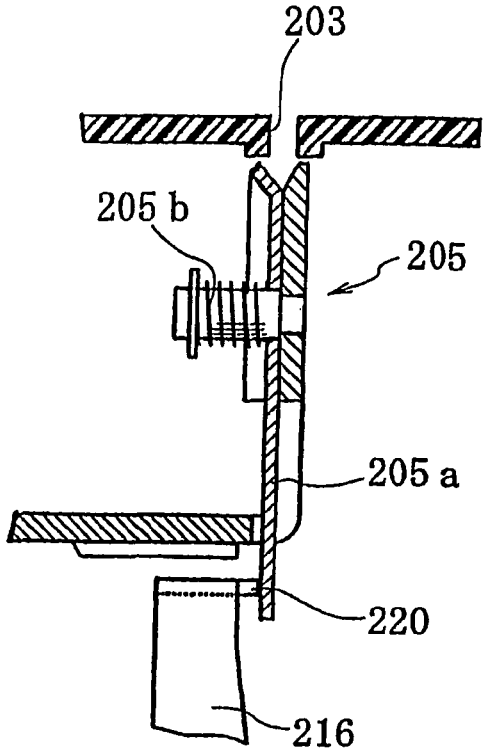
FIG. 60 is an enlarged section of the resistance applicator (in the closed state).
Figure 61:
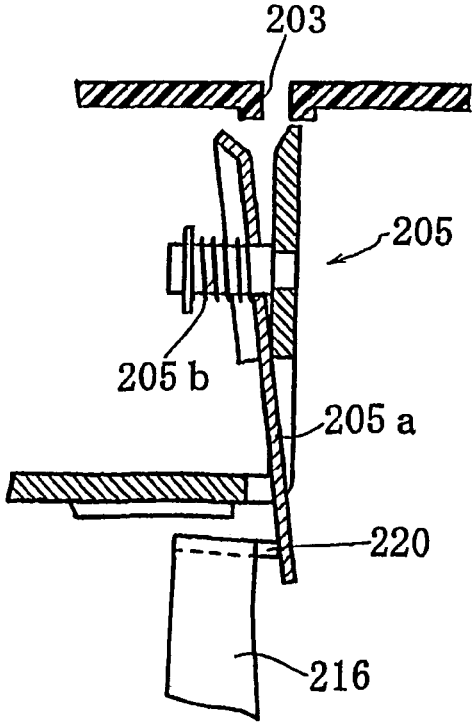
FIG. 61 is an enlarged section of the resistance applicator (in the open state).

As shown in FIG. 54 and FIG. 58, the thread tension regulator 9 is provided with the actuation plate 213, which is pushed and driven by the upper end portion of the lever portion 216 (i.e., the other end portion of the cam follower member) so that the thread tension discs 133 are opened by the pushing drive of the actuation plate 213. Around the support pin 214, there is mounted a torsion spring 219, which biases the cam follower member 212 counterclockwise in FIG. 58.

The resistance applicator 205 applies a proper passing resistance to the needle thread 24 on the upstream side of the thread tension regulator 9 thereby to prevent the needle thread 24 from being twisted or interlaced. The upper end portion of the aforementioned lever portion 216 is folded rightward at a right angle to form a horizontal plate portion 220. This horizontal plate portion 220 pushes and drives a holding plate 205*a* of the resistance applicator 205 to open the holding plate 205*a* synchronously as the actuation plate 213 opens the thread tension discs 133 (as referred to FIG. 60 and FIG. 61). While the horizontal plate portion 220 is inactive, the holding plate 205*a* is retained in the closed state by the biasing force of a resistance applying spring 205*b*.

The actions of the sewing machine 1A thus far described will be explained in the following.

As shown in FIG. 50 to FIG. 52, the needle thread 24, as fed out from the thread bobbin 62A, is passed into the thread guide groove 203 by the operator. In the state where the thread engaging controller 201 is moved to the upper most position, the needle thread 24 is engaged with the thread guard 26 of the thread take-up lever 25 and is pulled out through the thread guide groove 204 to the vicinity of the needle 19 and engaged with the needle bar thread hook 147, the thread guide 36*a* and the thread guide disc 56 (as referred to FIG. 5). Next, the tread end is cut to a predetermined length, and the thread engaging controller 201 is linearly pushed into the controller mount 200 so that it is inserted and mounted in the controller mount 200.

In accordance with this mounting action, the cam follower pin 218 abuts at first against the slope portion 211*a* of the cam portion 211 so that the thread tension discs 133 and the holding plate 205*a* are opened to catch the needle thread 24. Concurrently with this, the needle thread 24 is further engaged with the thread tension spring 135 so that its portion between the thread tension regulator 9 and the thread guard 26 of the thread take-up lever 25 is pushed downward to elongate the thread passages on the two sides of the thread take-up lever 25 by the needle thread control portion at the lower end portion of the right side wall 201*b* of the thread engaging controller, thereby to retain the thread take-up amount of the thread take-up lever 25.

Figure 62:
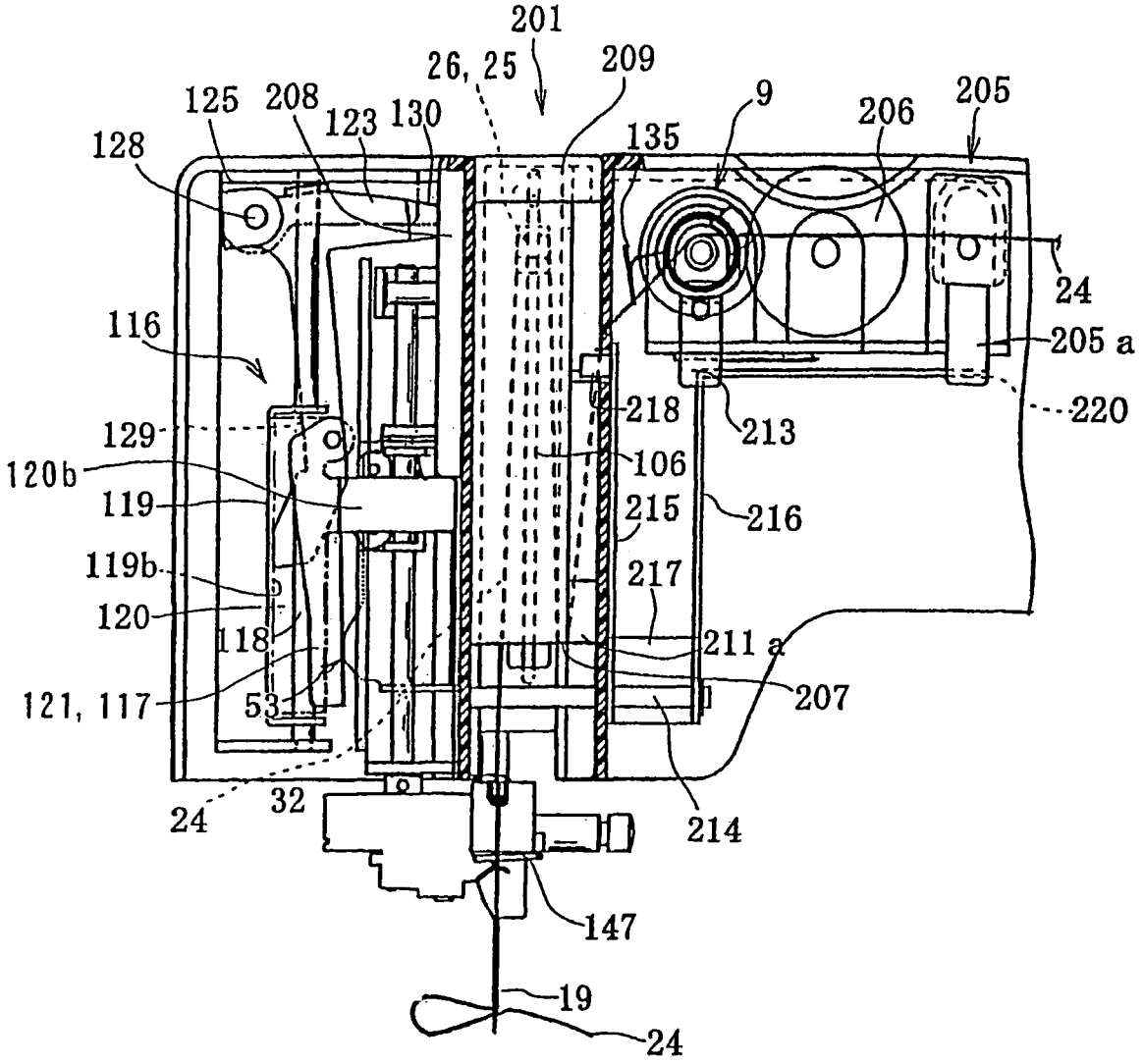
FIG. 62 corresponds to FIG. 54 but shows the vicinity of the controller mount and the threading controller (in the completely mounted state).
Figure 63:
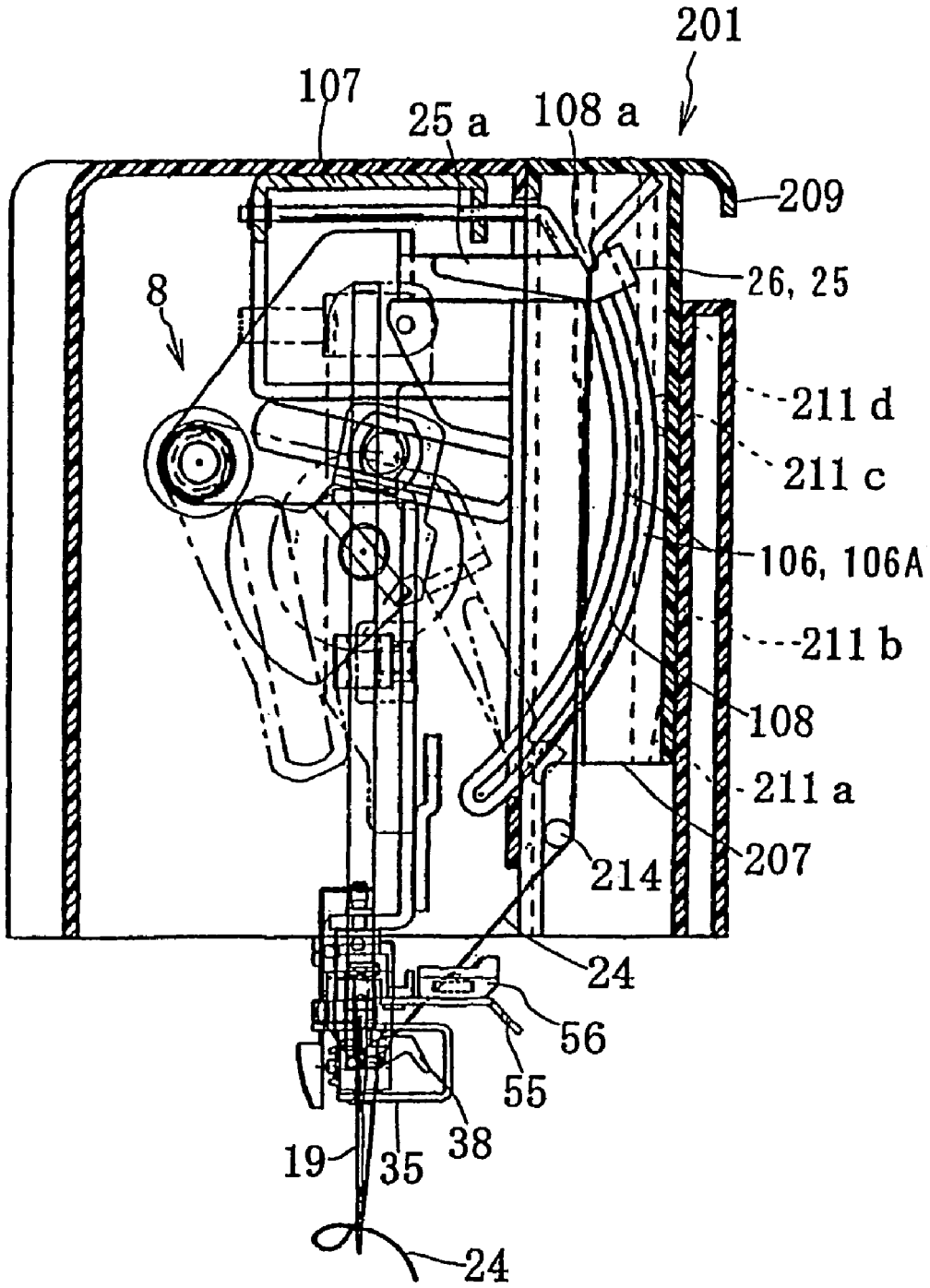
FIG. 63 corresponds to FIG. 57 but shows the vicinity of the controller mount and the threading controller (in the completely mounted state).

After this, the flat portion 211*b* and the slope portion 211*c* come to abut to the pin 218 and then the flat portion 211*d* comes into abutment against the pin 218 substantially in the completely mounted state, as shown in FIG. 62 and FIG. 63, so that the thread tension regulator 9 and the holding plate 205*a* are closed. In the course of the inserting and mounting the thread engaging controller 201 in the controller mount 200, on the other hand, the action of the thread engaging controller 201 is transmitted through the transmission mechanism 115 to the automatic threading mechanism 10 substantially like the foregoing embodiment, by which the thread passing into the needle eye 10*a* is executed to make the state ready for the sewing operation. At this time, the actuation portion 208*a* pushes the lever portion 120*b* downward so that the mounting action of the thread engaging controller 201 is transmitted to the transmission mechanism 115.

The sewing machine 1A and the thread engaging controller 201 thus far described have the following effects.

1) The thread engaging controller 201 elongated in the vertical direction is adopted in place of the aforementioned needle thread cassette 2 so that the thread engaging controller 201 and the controller mount 200 can be small-sized to reduce the affection on the appearance of the front face portion of the arm 6.

2) The interlocking mechanism 202 enables the thread engaging controller 201, in the course of the mounting action to mount the thread engaging controller 201 in the controller mount 200, to open the thread tension discs 133 of the thread tension regulator 9 and the holding plate 205*a* of the resistance applicator 205 in association with the mounting action so that the needle thread 24 can be engaged with the thread tension regulator 9 and the resistance applicator 205 in the open state. When the thread engaging controller 201 is completely mounted, moreover, the thread tension regulator 9 and the resistance applicator 205 can be closed. Concurrent with this threading action, the threading can also be automated in association with the mounting action to mount the thread engaging controller 201 in the controller mount 200.

Thus, in association with the operation for mounting the thread engaging controller 201, the needle thread 24 can be engaged with the thread tension regulator 9 and the resistance applicator 205 and can be automatically threaded. Therefore, the thread engaging operation and the thread passing operation at the time of supplying and exchanging the needle thread 24 can be simplified to enhance the operating efficiency.

3) The interlocking mechanism 202 includes: the cam portion 211 formed on the thread engaging controller 201; the cam follower member 212 supported to abut at its one end against the cam portion 211 and to freely turn at its longitudinal intermediate portion; and the actuation plate 213 pushed and driven by the other end portion of the cam follower member 212 to open the thread tension regulator 9. Therefore, an inexpensive thread tension regulator 9 having a general construction can be adopted as the thread tension regulator 9.

Here, the aforementioned thread engaging controller 201 is not directly connected to the arm 6 of the sewing machine 1A but can be removed from the arm 6. However, the thread engaging controller 201 can be connected to the arm 6 through a parallel link, another link mechanism or a rocking link member.

INDUSTRIAL APPLICABILITY

According to the present invention, the handling of the needle thread such as the engagement of the thread with the thread take-up lever or the thread tension regulator can be simplified to enhance the operating efficiency.

What is claimed is:

1. A sewing machine, comprising:

a thread take-up lever and a thread tension regulator each disposed along a predetermined needle thread passage from a thread bobbin to a needle;

an arm having a front face; and a movable controller provided in the front of the arm so as to be movable at least within a predetermined range, the movable controller not protruding out of the front face of the arm when moved in the predetermined range, wherein the needle thread is engaged with at least one of the thread take-up lever and the thread tension regulator when the movable controller is moved within the predetermined range while the needle thread has been drawn from the thread bobbin near to the needle substantially along the predetermined needle thread passage.

2. The sewing machine as set forth in claim 1, wherein said needle thread is engaged with both said thread take-up lever and said thread tension regulator by moving said movable controller within said predetermined range.

3. The sewing machine as set forth in claim 2, wherein said arm is provided with an automatic threading mechanism for passing said needle thread through the eye of the needle; and said movable controller is moved within said predetermined range to perform said engagement of the thread and to actuate said automatic threading mechanism thereby to pass the needle thread through the eye of said needle.

4. The sewing machine as set forth in claim 3, wherein a threading actuation portion is so disposed within a predetermined range, in which said movable controller of said arm travels, as to engage with said movable controller thereby to transmit the force to act on said travel of said movable controller, to said automatic threading mechanism, and said automatic threading mechanism is actuated for the threading operation by the force transmitted as a drive force through said threading actuation portion.

5. The sewing machine as set forth in claim 4, wherein said automatic threading mechanism includes:

a guide member, by receiving the force transmitted through said threading actuation portion, to proceed toward the eye of the needle and to guide the thread into the eye;

a needle eye detecting member for detecting the needle eye position by engaging with a needle bar or an engagement member fixed on the needle bar; and a drive releasing mechanism being activated to release the transmission of the drive force given through said threading actuation portion, on the basis of the detection of the needle eye position by said needle eye detecting member.

6. The sewing machine as set forth in claim 3, further comprising a needle bar position detecting member for detecting at least the acting position of the needle bar; and a stopper member for receiving the detection result of said needle bar position detecting means, for allowing said movable controller to move only in case the needle bar is within the predetermined positional range but for inhibiting the movement at a position outside of said predetermined position range.

7. The sewing machine as set forth in claim 1, wherein a controller mount for mounting said movable controller removably is formed on the arm of said sewing machine.

8. The sewing machine as set forth in claim 1, wherein said movable controller includes:

a cassette case;

a thread bobbin retaining portion capable of housing the thread bobbin; and a thread passage for guiding the needle thread extending from the thread bobbin, to the thread exit of the cassette case.

9. The sewing machine as set forth in claim 8, wherein the axis of the thread bobbin housed in said needle thread cassette is arranged in the vertical direction in the state of said needle thread cassette being mounted in said cassette mount.

10. The sewing machine as set forth in claim 8, wherein said needle thread cassette is mounted as it is in the arm after said traveling operation and forms part of a cover member for covering said arm.

11. The sewing machine as set forth in claim 8, wherein said cassette case has an introducing opening for introducing the needle thread extending from the thread bobbin outside of the needle thread cassette, into said needle passage in the cassette case.

12. The sewing machine as set forth in claim 8, wherein said cassette case is formed into a shape similar to an elongated box shape, and said thread passage includes a first guide portion formed at the top of the cassette case, a first clamp portion formed at the upper portion of the cassette case for applying a passing resistance to the needle thread, a second guide portion disposed at one corner of the lower end portion of the cassette case, a third guide portion disposed on the other side of the lower end portion of the cassette case, and a second clamp portion disposed at the other corner of the lower end portion of the cassette case for applying the passing resistance to the needle thread.

13. The sewing machine as set forth in claim 12, wherein in association with the mounting action to mount said needle thread cassette in the cassette mount, the needle thread between the second and third guide portions is engaged with the thread tension regulator whereas the needle thread between the third guide portion and the second clamp portion is engaged with a thread engaging portion of the thread take-up lever.

14. The sewing machine as set forth in claim 6, wherein said needle thread cassette is so made of a transparent member at least partially of the corresponding wall face of the cassette case that the thread bobbin retaining portion capable of housing said thread bobbin can be viewed from the outside.

15. The sewing machine as set forth in claim 8, wherein there is formed in the front face portion of the head of said arm a grooved cassette mount as said controller mount for guiding the needle thread cassette linearly when the mounting side of the needle thread cassette is opened and when the needle thread cassette is mounted/demounted.

16. The sewing machine as set forth in claim 15, wherein said thread take-up lever and said thread tension regulator are arranged in the head of said arm corresponding to the back portion of said cassette mount.

17. The sewing machine as set forth in claim 16, wherein the cassette case of said needle thread cassette includes a slit for introducing the thread guard of the thread take-up lever into the cassette case, and an opening for penetrate said thread tension regulator into the cassette case.

18. The sewing machine as set forth in claim 15, wherein said cassette mount is opened both upward and downward and has a receiving portion for receiving the needle thread cassette at a predetermined position.

19. The sewing machine as set forth in claim 1, wherein the thread tension regulator includes a pair of thread tension discs opened and closed, the sewing machine further comprising an interlocking mechanism opening and closing the thread tension discs in association with movement of the movable controller within the predetermined range, wherein the interlocking mechanism opens the thread tension discs at a first half stage of the movement of the movable controller within the predetermined range, the interlocking mechanism releases the thread from an open state at a second half stage of the movement of the movable controller within the predetermined range, and the needle thread is introduced into a space defined between the thread tension discs with movement of the movable controller after the thread tension discs are opened.

20. The sewing machine as set forth in claim 19, wherein said interlocking mechanism includes a cam portion formed at said movable controller, a cam follower member capable of abutting at its one end against the cam portion and supported movably at its longitudinal intermediate portion, and an actuation plate driven by the other end portion of the cam follower member for opening the thread tension discs.

21. The sewing machine as set forth in claim 1, wherein the travel of said movable controller within the predetermined range is from upward to downward.

22. The sewing machine as set forth in claim 1, wherein said movable controller is a controller disposed near the region of said arm, in which said thread take-up lever travels reciprocally, and capable of traveling in parallel with the reciprocal direction of the thread take-up lever.

23. The sewing machine as set forth in claim 22, wherein said movable controller is housed as it is in the arm after said movable control thereby to construct a design integral with a cover member for covering said arm.

24. The sewing machine as set forth in claim 22, wherein the thread take-up lever includes a thread guard and with the thread guard of said thread take-up lever being retained at a position on a thread tightening side, the needle thread is engaged with the thread guard of the thread take-up lever in association with the movement of said movable controller within the predetermined range.

25. A sewing machine comprising a needle thread cassette mounted removably in a cassette mount formed in an arm, for housing a thread bobbin to feed a needle thread fed out from the thread bobbin to a thread take-up lever, wherein the thread take-up lever includes a thread guard reciprocated between a position at a thread tightening side and a position at a side opposed to the thread tightening side; said cassette mount is disposed near a region of reciprocation of the thread guard; and with the thread guard of said thread take-up lever being retained at a position on the thread tightening side, the needle thread is engaged with the thread guard of the thread take-up lever in association with the mounting action to mount the needle thread cassette in the cassette mount.

26. The sewing machine as set forth in claim 25, wherein said cassette mount is formed in a vertical groove at the front face portion of the head of said arm, and said needle thread cassette can be mounted from above in said grooved cassette mount.

27. The sewing machine as set forth in claim 25, wherein said needle thread cassette includes:

a cassette case;

a thread bobbin retaining portion disposed in the cassette case; and a thread passage for guiding the needle thread extending from the thread bobbin retained in the thread bobbin retaining portion, to the thread exit of the cassette case.

28. The sewing machine as set forth in claim 27, wherein said cassette case has an introducing opening for introducing the needle thread extending from the thread bobbin outside of the needle thread cassette, into said needle passage in the cassette case.

29. The sewing machine as set forth in claim 27, wherein said cassette case is formed into a shape similar to an elongated box shape; and said thread passage includes:

a first guide portion formed at the top of the cassette case;

a first clamp portion formed at the upper portion of the cassette case for applying a passing resistance to the needle thread;

a second guide portion disposed at one corner of the lower end portion of the cassette case;

a third guide portion disposed on the other side of the lower end portion of the cassette case; and a second clamp portion disposed at the other corner of the lower end portion of the cassette case for applying the passing resistance to the needle thread.

30. The sewing machine as set forth in claim 29, wherein in association with the mounting action to mount said needle thread cassette in the cassette mount, the needle thread between the second and third guide portions is engaged with the thread tension regulator whereas the needle thread between the third guide portion and the second clamp portion is engaged with a thread engaging portion of the thread take-up lever.

31. The sewing machine as set forth in claim 27, wherein said arm has a thread tension regulator disposed to penetrate into the lower portion of the cassette mount, and said cassette case includes a slit for introducing the thread guard of the thread take-up lever into the cassette case, and an opening for penetrating said thread tension regulator into the cassette case.

32. The sewing machine as set forth in claim 25, wherein said cassette mount is opened both upward and downward and has a receiving portion for receiving the needle thread cassette at a predetermined position.

33. A sewing machine, comprising:

a control member for moving a presser foot up and down;

a thread tension regulator having thread tension discs adapted to be released, when the presser foot is moved up by said control member, and closed when the presser foot is moved down;

a movable controller provided in an arm so as to be movable at least within a predetermined range; and an interlocking mechanism including a cam formed in the movable controller, a cam driven member having one of ends capable of abutting the cam and the other end converting a pressing force said one end receives from the cam to an operation thereof, and an actuating plate driven by said other end of the cam driven member to open the thread tension discs, the interlocking mechanism opening the thread tension discs in association with movement of the movable controller within the predetermined range while the presser foot is retained at a bottom position, wherein the needle thread is engaged with the thread tension discs in said open state in the course of the moving action of said movable controller within said predetermined range.

34. The sewing machine as set forth in claim 33, wherein said movable controller is a controller disposed near the region of said arm, in which said thread take-up lever travels reciprocally, and capable of traveling in parallel with the reciprocal direction of the thread take-up lever.

35. The sewing machine as set forth in claim 33, wherein said movable controller is a needle thread cassette including:

a cassette case;

a thread bobbin retaining portion capable of housing the thread bobbin in the cassette case; and a thread passage for guiding the needle thread extending from the thread bobbin, to the thread exit of the cassette case, whereby the thread tension discs of the thread tension regulator are opened in association with the intermediate mounting action on the cassette mount disposed in the front face portion of the arm.

36. The sewing machine as set forth in claim 35, wherein the axis of the thread bobbin housed in said needle thread cassette is so arranged in the vertical direction in the state where said needle thread cassette is mounted in said cassette mount.

37. The sewing machine as set forth in claim 35, wherein said thread tension regulator penetrates into the lower portion of the cassette case of the needle thread cassette in the state where the needle thread cassette is mounted in the cassette mount, and the downstream portion of said thread passage is constructed to guide the needle thread transversely along the lower end portion of the cassette case.

38. The sewing machine as set forth in claim 33, wherein when the moving action of said movable controller is completed, the open state of the thread tension discs of the thread tension regulator, as opened in association with the moving action of the movable controller, is released.

39. The sewing machine as set forth in claim 33, further comprising a needle thread pressing member disposed downstream of said thread tension regulator for pressing the needle thread extending downstream from said thread tension regulator, in association with the moving action of said movable controller.

40. A sewing machine, comprising:

a thread take-up lever for reciprocating while being timed with the motion of a needle to take up a needle thread fed out from a thread bobbin;

an automatic threading mechanism for passing the needle thread through a needle eye;

an arm having a front face; and a movable controller provided in the front of the arm so as to be movable at least within a predetermined range, the movable controller not protruding out of the front face of the arm when moved in the predetermined range, wherein said movable controller is moved within said predetermined range to control and set the needle thread in a thread guard of the thread take-up lever and to actuate said automatic threading mechanism to pass the needle thread through the needle eye.

41. The sewing machine as set forth in claim 40, wherein the thread take-up lever has a thread guard and said movable controller includes a needle thread control portion for controlling the needle thread when the needle thread is engaged with the thread guard of the thread take-up lever, and a threading actuation portion for actuating said automatic threading mechanism when the needle thread is passed through the needle eye.

42. The sewing machine as set forth in claim 41, wherein said automatic threading mechanism includes:

a guide member, by receiving the force transmitted through said threading actuation portion, to proceed toward the eye of the needle and to guide the thread into the eye;

a needle eye detecting member for detecting the needle eye position by engaging with a needle bar or an engagement member fixed on the needle bar; and a drive releasing mechanism being activated to release the transmission of the drive force given through said threading actuation portion, on the basis of the detection of the needle eye position by said needle eye detecting member.

43. The sewing machine as set forth in claim 40, wherein a controller mount for mounting said movable controller removably is formed on the arm of said sewing machine.

44. The sewing machine as set forth in claim 40, wherein said movable controller is a needle thread cassette for housing the thread bobbin and for feeding the needle thread fed out from the thread bobbin, to the thread take-up lever.

45. The sewing machine as set forth in claim 44, wherein a grooved cassette mount is formed as said controller mount in the front face portion of the arm of said sewing machine and is opened on the mounting side of the needle thread cassette, for guiding the needle thread cassette linearly when the needle thread cassette is mounted/demounted.

46. The sewing machine as set forth in claim 45, wherein a thread take-up lever travel region, in which the thread guard of the thread take-up lever moves up and down, is formed in a portion of said cassette mount; and in that a thread tension regulator protruding into another portion of the cassette mount is provided, whereby in association with the action to mount said needle thread cassette in the cassette mount, the needle thread in the needle thread cassette is engaged with at least the thread take-up lever and the thread tension regulator, and the automatic threading mechanism is actuated to pass the needle thread through the needle eye.

47. The sewing machine as set forth in claim 46, wherein the thread tension regulator including thread tension discs and a thread tension spring is disposed to protrude into aid cassette mount, whereby in association with the action to mount said needle thread cassette in the cassette mount, the needle thread in the needle thread cassette is engaged with the thread guard of the thread take-up lever, the thread tension discs and the thread tension spring, and the automatic threading mechanism is actuated to pass the needle thread through the needle eye.

48. The sewing machine as set forth in claim 45, wherein with said needle thread cassette being mounted to an intermediate position in the cassette mount, the needle thread is manually engaged with the automatic threading mechanism so that the automatic threading mechanism is actuated by the subsequent action to mount the needle thread cassette.

49. The sewing machine as set forth in claim 40, further comprising a needle bar position detecting member for detecting at least the acting position of the needle bar; and a stopper member for receiving the detection result of said needle bar position detecting means, for allowing said movable controller to move only in case the needle bar is within the predetermined positional range but for inhibiting the movement at a position outside of said predetermined position range.

* * * * *